US012696942B2

(12) United States Patent
Chen et al.

(10) Patent No.: US 12,696,942 B2
(45) Date of Patent: Aug. 4, 2026

(54) SINGLE HAND WEARABLE GLOVE

(71) Applicants: Jinghua Chen, Camarillo, CA (US); Jin Zhang, Camarillo, CA (US)

(72) Inventors: Jinghua Chen, Camarillo, CA (US); Jin Zhang, Camarillo, CA (US)

( * ) Notice: Subject to any disclaimer, the term of this patent is extended or adjusted under 35 U.S.C. 154(b) by 0 days.

(21) Appl. No.: 19/001,862

(22) Filed: Dec. 29, 2024

(65) Prior Publication Data

US 2025/0212979 A1 Jul. 3, 2025

Related U.S. Application Data

(60) Provisional application No. 63/666,108, filed on Jun. 29, 2024, provisional application No. 63/616,509, filed on Dec. 29, 2023.

(51) Int. Cl.
*A41D 13/08* (2006.01)

(52) U.S. Cl.
CPC ..... *A41D 13/087* (2013.01)

(58) Field of Classification Search
CPC .. A41D 13/087; A41D 19/00; A41D 19/0058; A41D 19/0062; A61F 13/105; A61F 13/107; A61F 13/10
USPC ..... 2/21, 16
See application file for complete search history.

(56) References Cited

U.S. PATENT DOCUMENTS 342,341 A 5/1886 Edwards
408,912 A * 8/1889 Chesterton ..... A61F 13/105 2/21
1,416,001 A 5/1922 Detwiler
1,990,553 A 2/1935 Hirsch et al.
(Continued)

FOREIGN PATENT DOCUMENTS

CN 201675627 U 12/2010
CN 202068995 U 12/2011
(Continued)

OTHER PUBLICATIONS

Aortdes Silicone Cooking Pinch Grips Oven Mitts—Mini Finger Protector Pot Holder for Kitchen,Cooking,Baking, BBQ—Heat Resistant Gloves, 2 Pairs (Black and Red) as sold by Aortdes on Amazon.com at the url: https://www.amazon.in/AORTDES-Silicone-Cooking-Pinch-Grips/dp/B081DQ2G3N/ref=asc_df_B081DPJ5GM/?ext_vrnc=hi&gclid=Cj0KCQiAj_CrBh.
(Continued)

*Primary Examiner* — Alissa L Hoey
*Assistant Examiner* — Akwokwo Olabisi Redhead

(57) ABSTRACT

A single hand wear and take off (SHWT) glove may protect the hand and fingers from directly contacting undesirable objects such as those that are heated, dirty, or corrosive while preserving the nimbleness of the finger movements to effectively accomplish the task. The SHWT glove provides for different combinations of fingers, optionally including a thumb as one of the fingers, usable by people with different finger and hand size, donned and doffed with a single hand (for single-handed operation), with improved mechanics and leverage. Human hands vary in size from small to large with the SHWT glove suitable for small, medium and large hands. The SHWT glove may be constructed of different materials and vary the material thickness at different parts of the finger glove. The material chosen and the applied thickness may change the SHWT glove's elasticity, stiffness, bend ability or stretch-ability.

25 Claims, 24 Drawing Sheets

(56) References Cited

U.S. PATENT DOCUMENTS

| | | | | |
|---|---|---|---|---|
| 2,069,449 | A | 2/1937 | Jensen | |
| 2,471,308 | A | 5/1949 | Casnati | |
| D231,513 | S | 4/1974 | Adams | |
| 4,751,747 | A | 6/1988 | Banks et al. | |
| 5,345,608 | A | 9/1994 | Mergens et al. | |
| D368,330 | S | 3/1996 | Robinson | |
| 5,749,097 | A | 5/1998 | Garrett-Roe | |
| 6,145,128 | A | 11/2000 | Suzuki | |
| 7,117,536 | B2 | 10/2006 | Burnett et al. | |
| 7,165,270 | B2 * | 1/2007 | DeYoung | A41D 13/087 2/161.6 |
| D558,929 | S | 1/2008 | Bleakney | |
| D634,898 | S | 3/2011 | Lion et al. | |
| 8,919,838 | B2 | 12/2014 | Zimmermann et al. | |
| 9,033,383 | B2 | 5/2015 | Rampersad | |
| 9,578,982 | B2 | 2/2017 | Rampersad | |
| D831,896 | S | 10/2018 | Krahe | |
| 10,136,686 | B2 | 11/2018 | Savides | |
| D849,360 | S | 5/2019 | Lugar et al. | |
| 10,588,364 | B2 | 3/2020 | Walker | |
| 10,918,146 | B1 | 2/2021 | Dickerson et al. | |
| D961,167 | S | 8/2022 | Dickerson et al. | |
| 2002/0010957 | A1 | 1/2002 | Katz | |
| 2007/0210596 | A1 | 9/2007 | Stewart et al. | |
| 2008/0092262 | A1 | 4/2008 | James Carr | |
| 2014/0028039 | A1 | 1/2014 | Rampersad | |
| 2014/0283279 | A1 * | 9/2014 | Pratho | A41D 13/087 2/163 |
| 2015/0189930 | A1 | 7/2015 | Roth et al. | |
| 2018/0199643 | A1 * | 7/2018 | Walker | A47G 21/00 |
| 2022/0030989 | A1 | 2/2022 | Raymond | |

FOREIGN PATENT DOCUMENTS

| | | | |
|---|---|---|---|
| CN | 103393331 | A | 11/2013 |
| CN | 110267558 | B | 3/2021 |
| FR | 2626444 | A1 | 8/1989 |
| GB | 2597647 | A | 2/2022 |
| JP | 2007100282 | A | 4/2007 |
| JP | 2021188140 | A | 12/2021 |
| KR | 100987532 | B1 | 10/2010 |
| WO | 2018107174 | A1 | 6/2018 |

OTHER PUBLICATIONS

Silicone Finger Guard Protector for Grating Cheese & Vegetables with Mandolin Slicer, Kitchen Accessories, 2 Pack as sold by Ready Grips Store on Amazon.com at the url: https://www.amazon.com/dp/B0BN2KRGN4?ref=ppx_yo2ov_dt_b_product_details&th=1.

International Searching Authority, International Search Report in re Int'l Appl. No. PCT/US2024/062220, Apr. 14, 2025.

International Searching Authority, Written Opinion of the International Searching Authority in re Int'l Appl. No. PCT/US2024/062220, Apr. 14, 2025.

* cited by examiner

FIG. 1
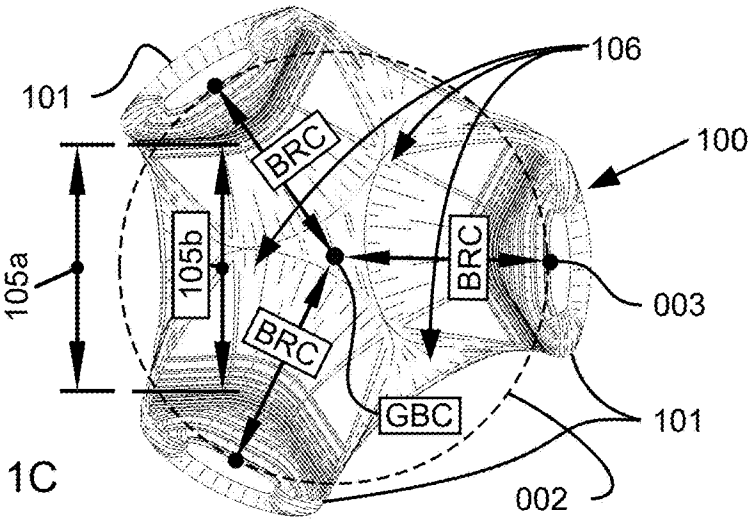
FIG. 1C
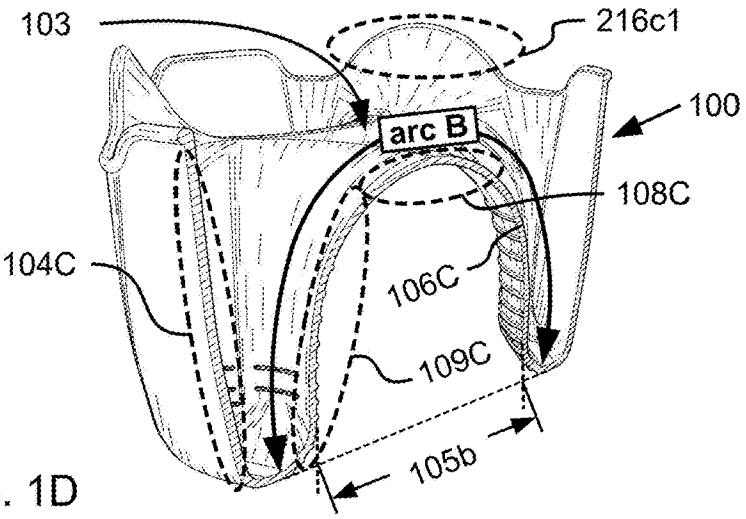
FIG. 1D
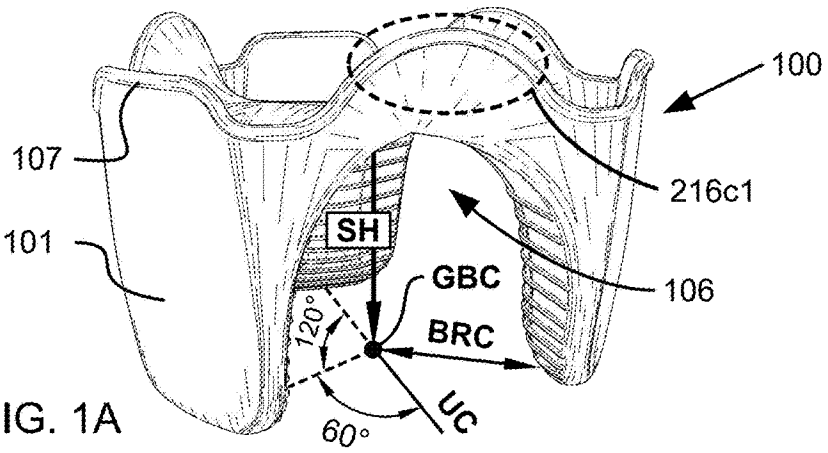
FIG. 1A
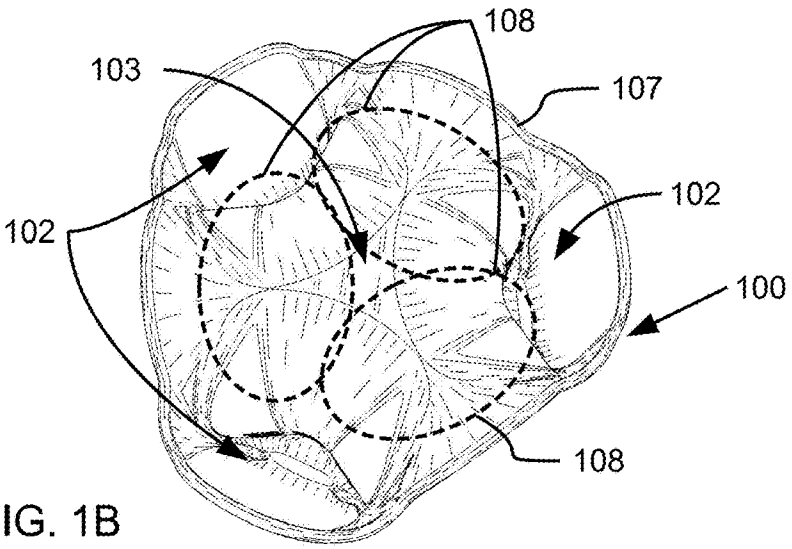
FIG. 1B

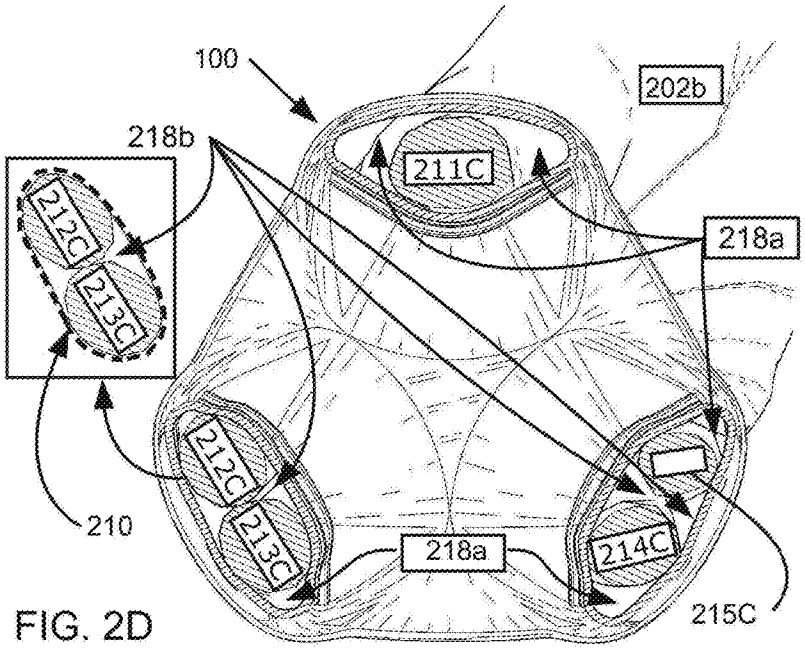
FIG. 2D
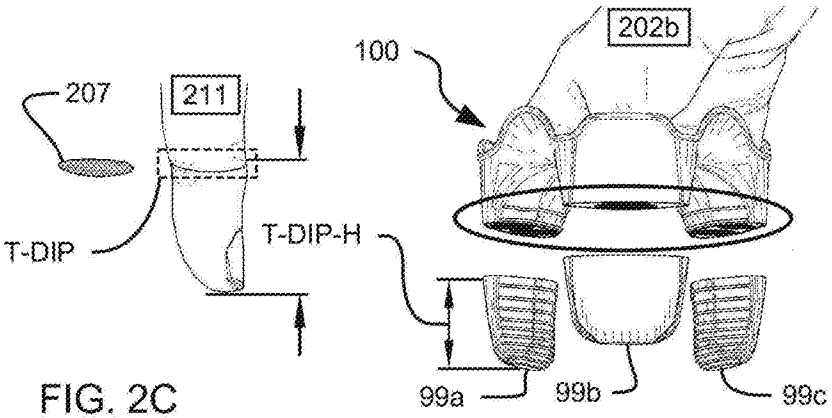
FIG. 2C
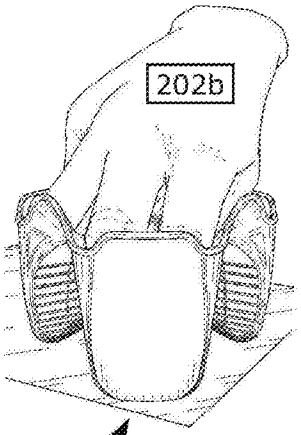
FIG. 2B
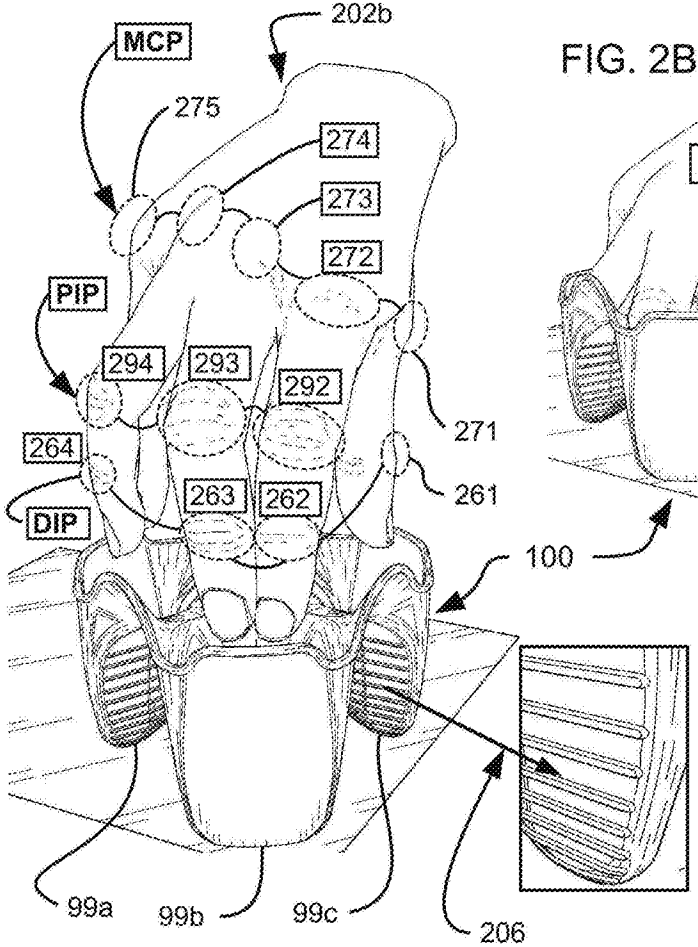
FIG. 2
FIG. 2A

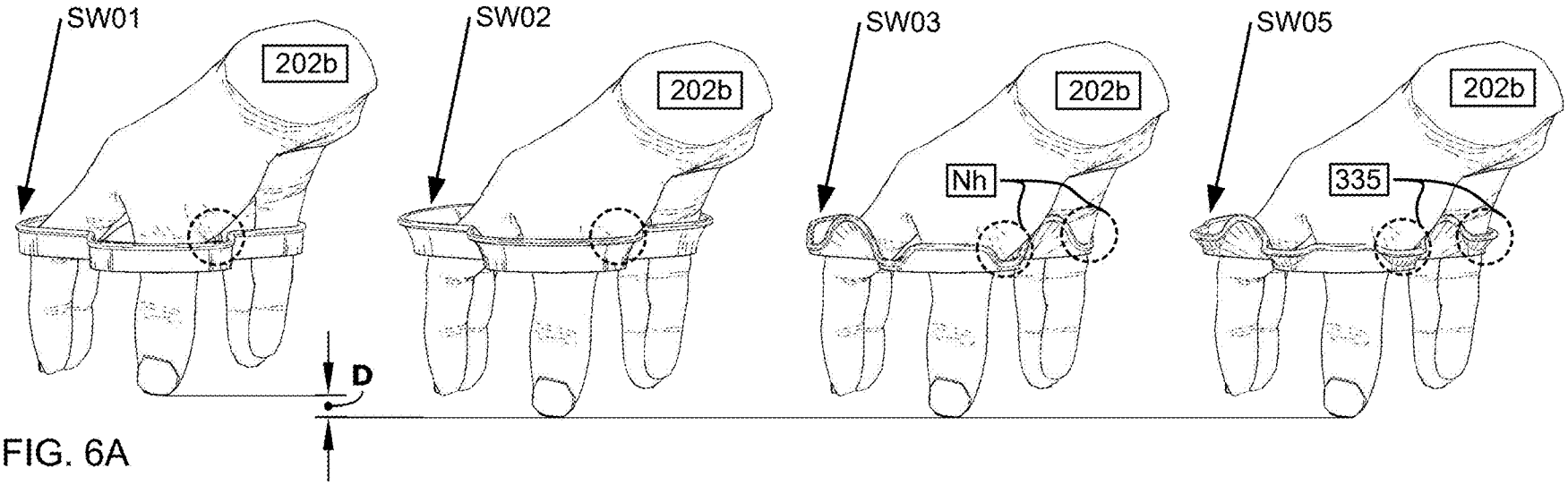
FIG. 6
FIG. 6A
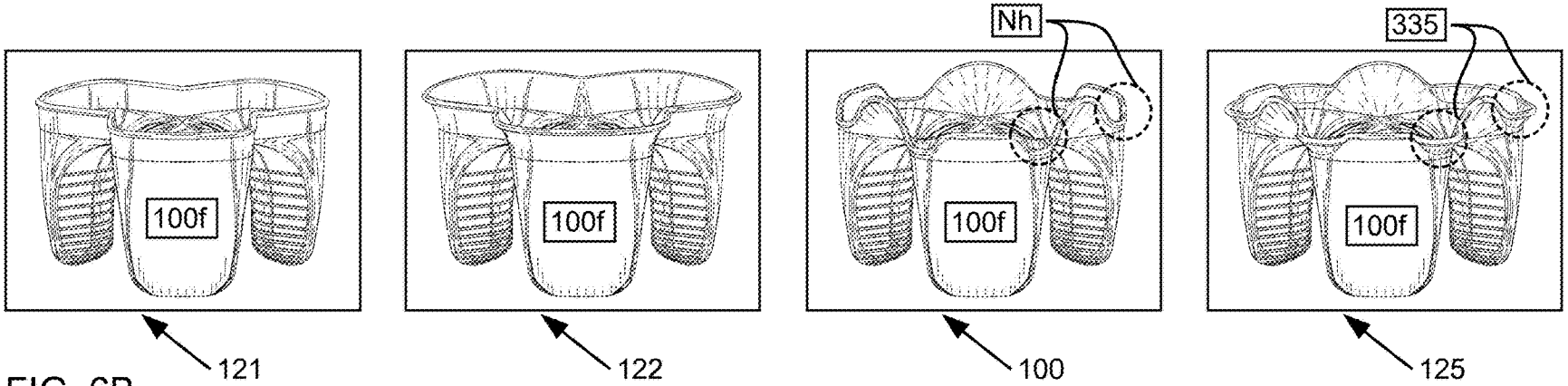
FIG. 6B

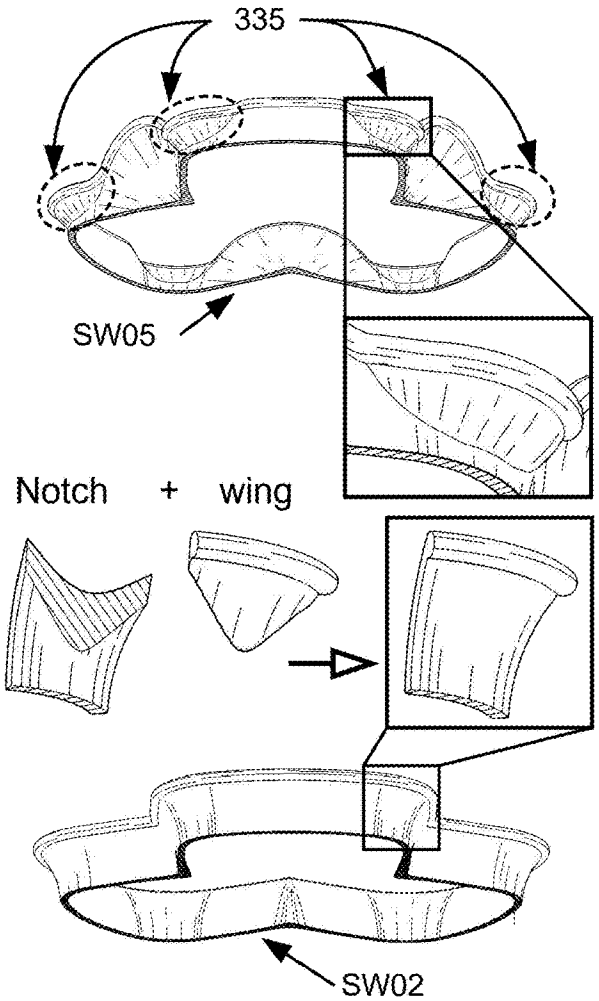
FIG. 7C
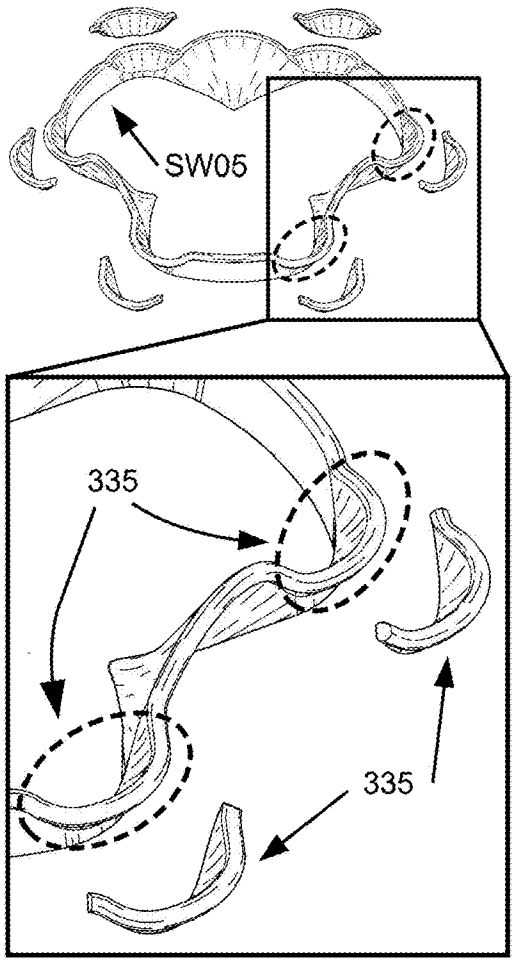
FIG. 7B
FIG. 7
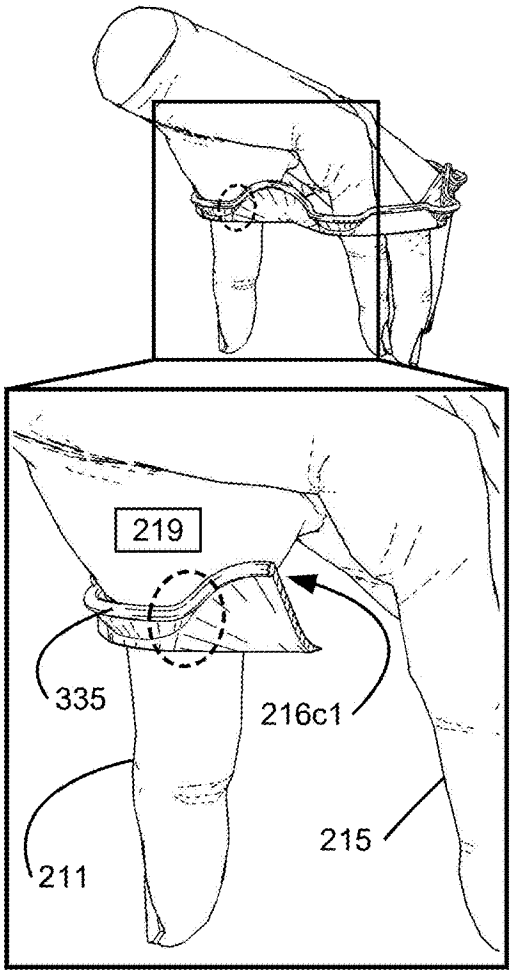
FIG. 7A 103
007
arc C
arc C
99c
SH
VD
GBC
BRC
120°
ISD
99b
99a
100

OL
99b
99c
99a
100

100
180
230
180

202b
CMC
T-MCP 271
T-DIP 261
800
211
I-MCP 272
288
I-PIP 292
212
I-DIP 262
100

202b
007
T-DIP 261
211
99b
99c
I-MCP 272
282
I-PIP 292
212
800
99a 207
211
T-DIP-H
T-DIP
100

100S
100M2
ARC IN
100M1

OW/3
OH
OW
230

006
OH
100S
130
531C
RC
RC
RC 150
500C
OW
OH 170
501C
503C
531C
531C

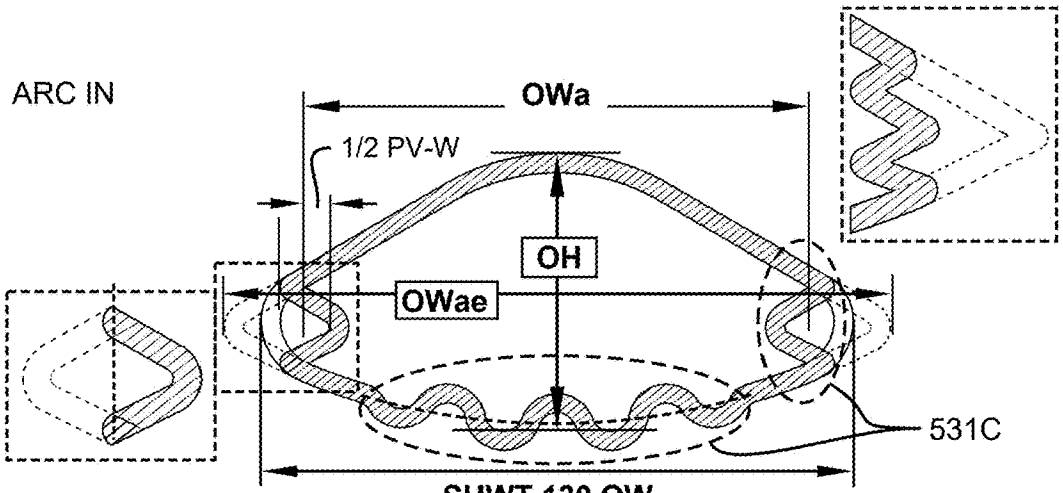
FIG. 11B
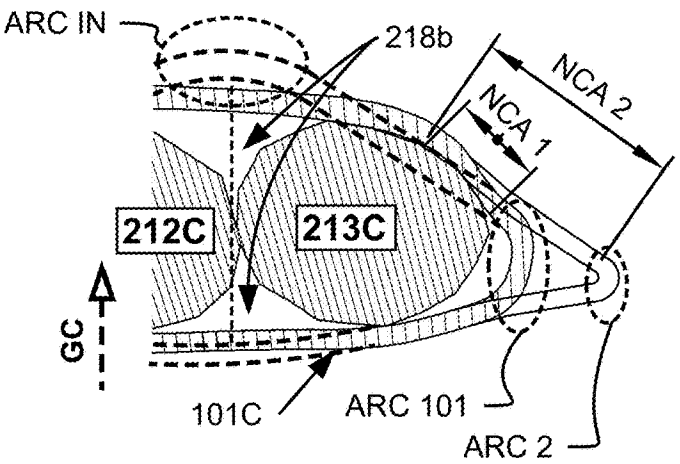
FIG. 11D
FIG. 11
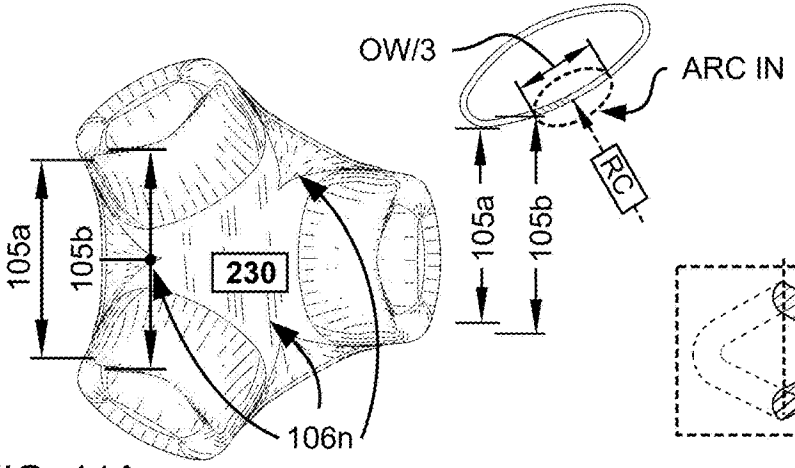
FIG. 11A
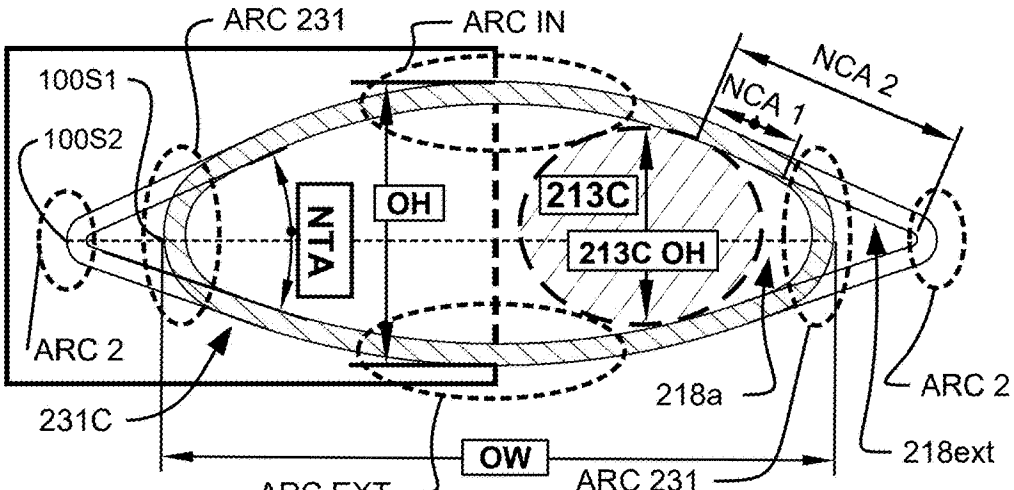
FIG. 11C FIG. 13
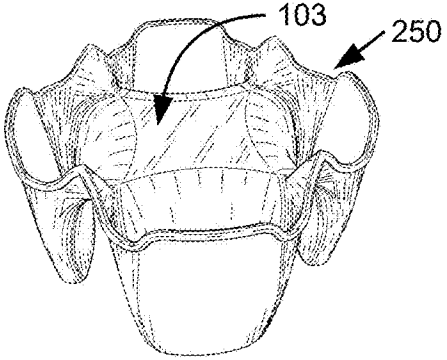
FIG. 13A
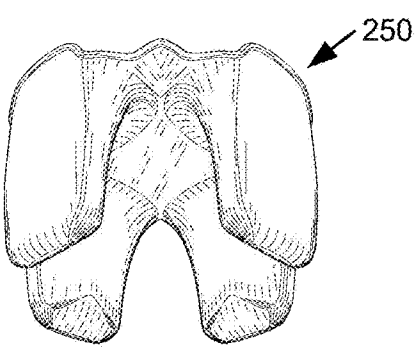
FIG. 13B
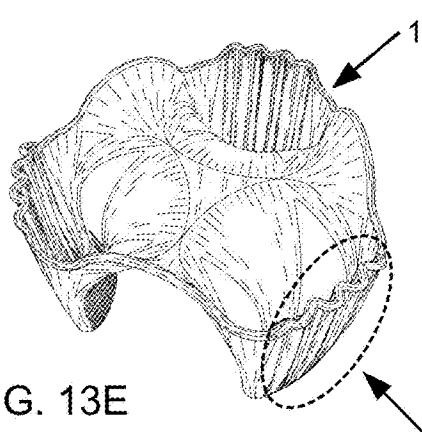
FIG. 13E
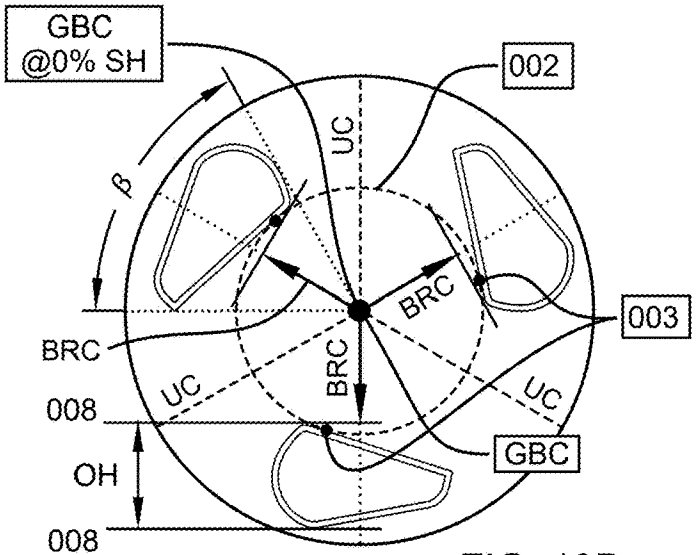
FIG. 13D
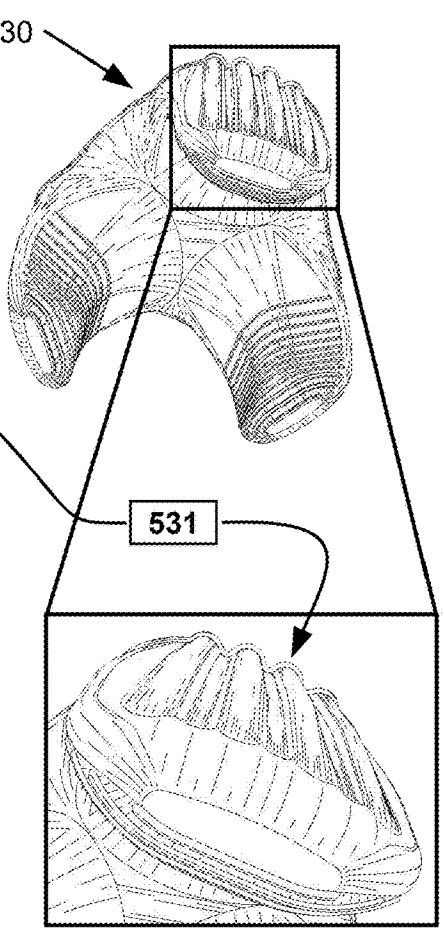
FIG. 13F
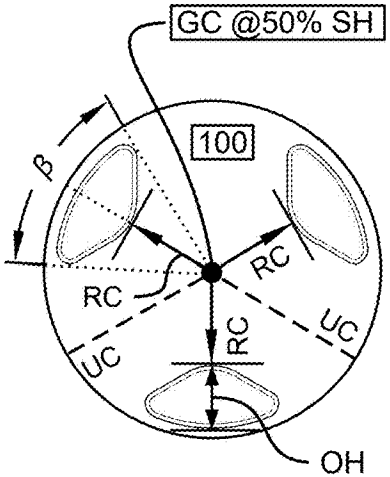
FIG. 13C

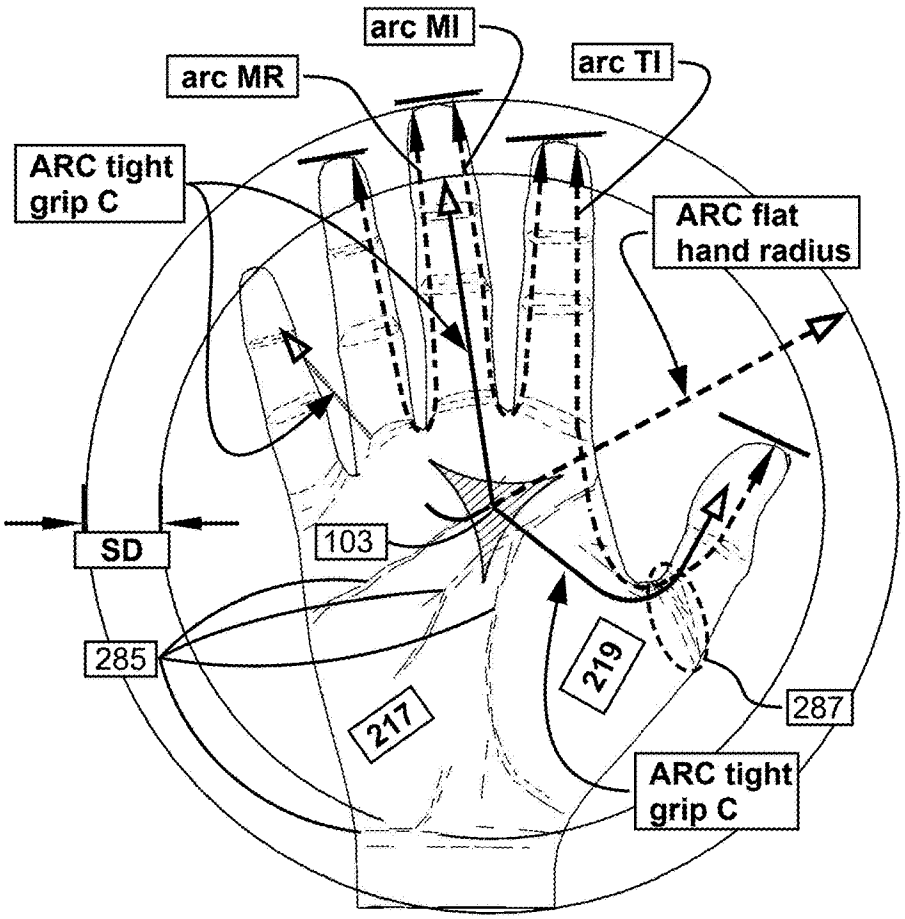
FIG. 14D
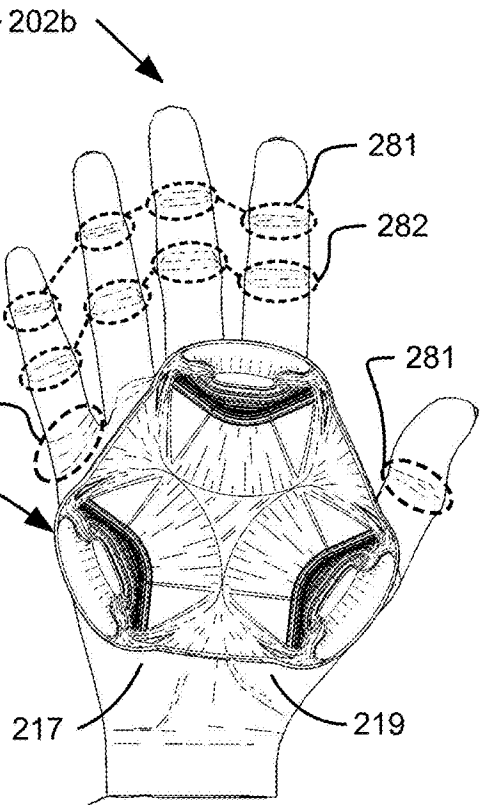
FIG. 14C
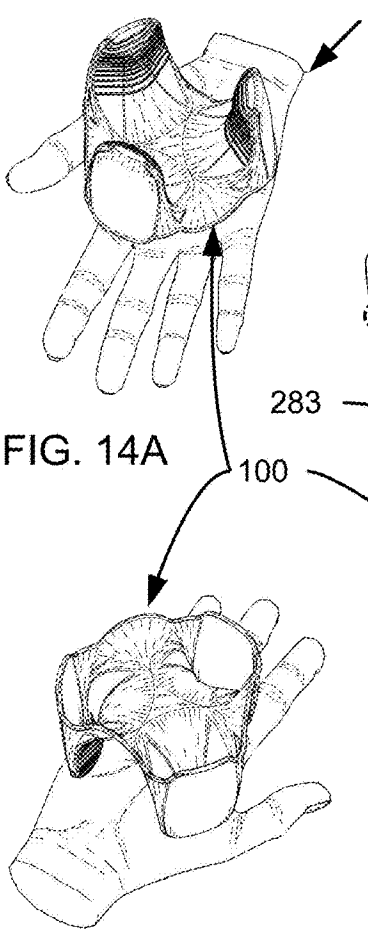
FIG. 14A
FIG. 14B
FIG. 14

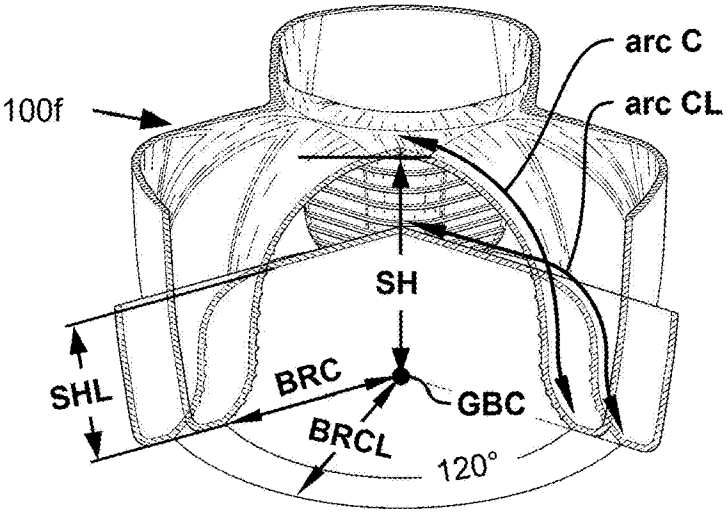
FIG. 15E
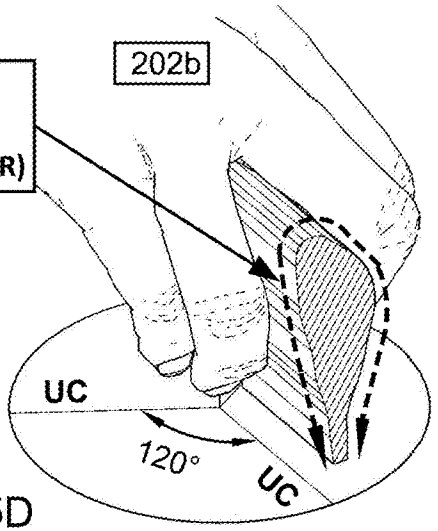
FIG. 15D
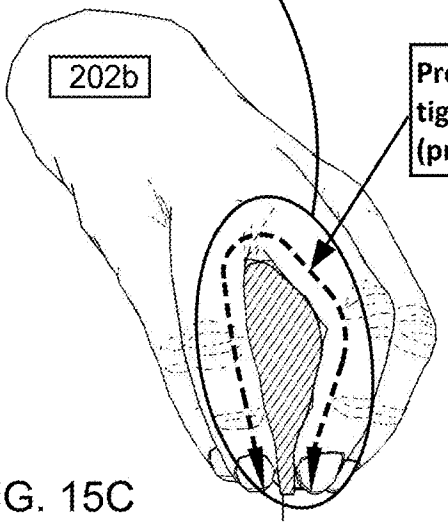
FIG. 15C
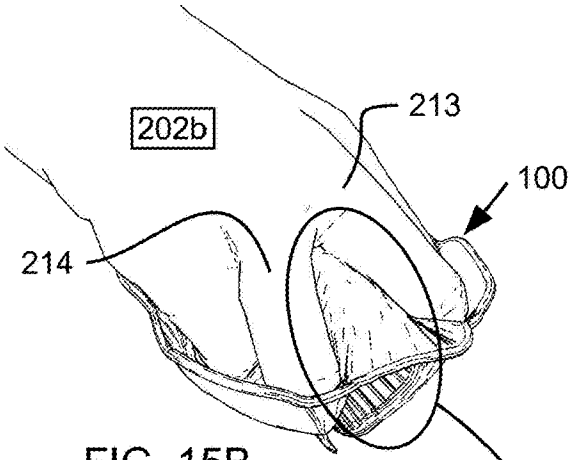
FIG. 15B
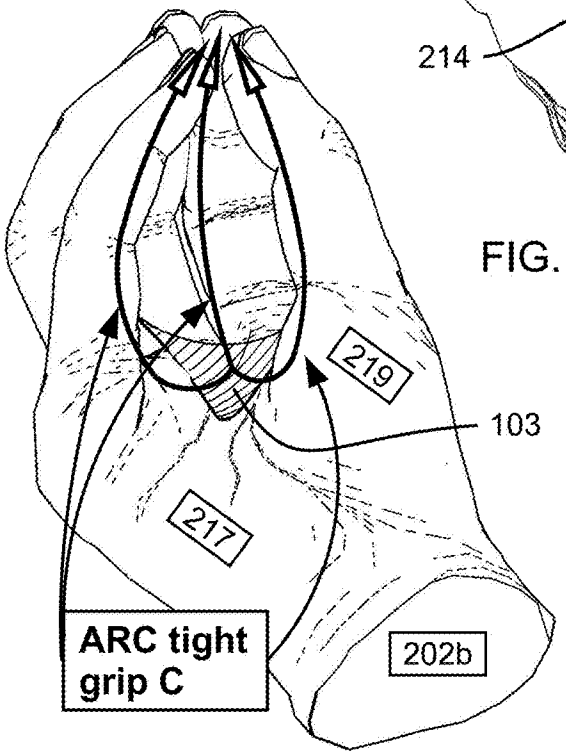
FIG. 15A
FIG. 15

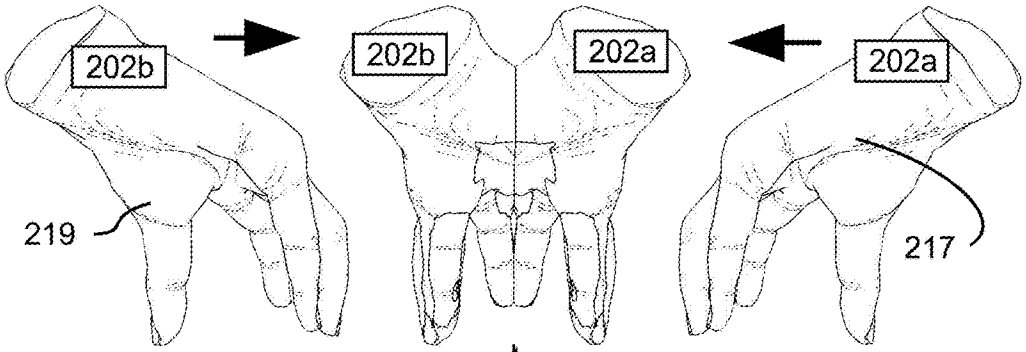
FIG. 17C
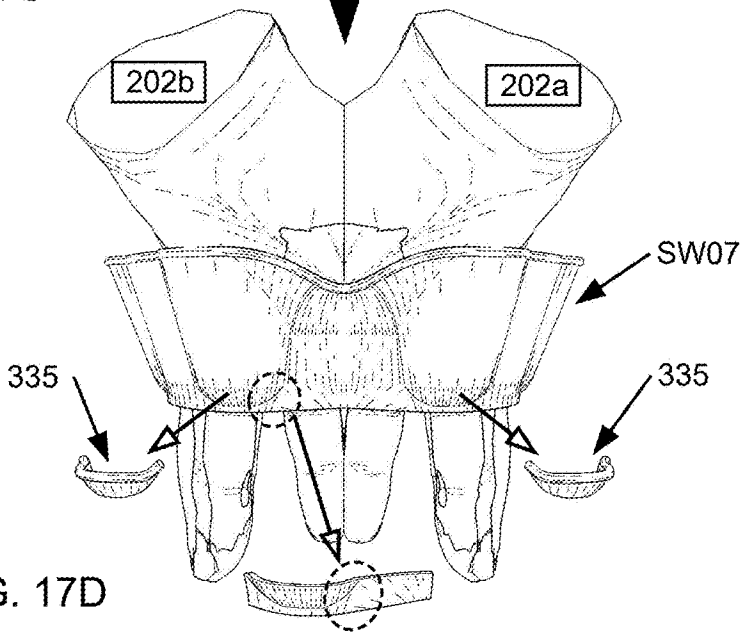
FIG. 17D
FIG. 17
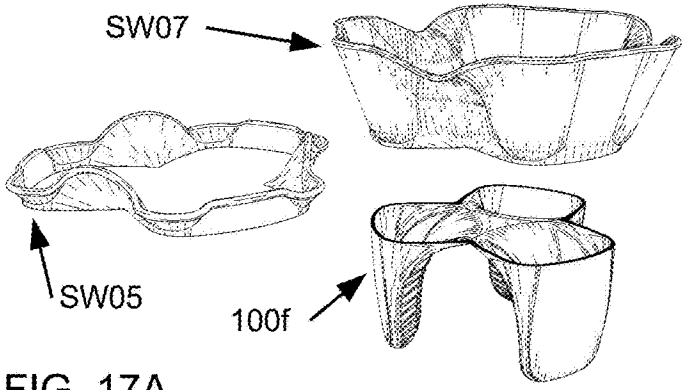
FIG. 17A
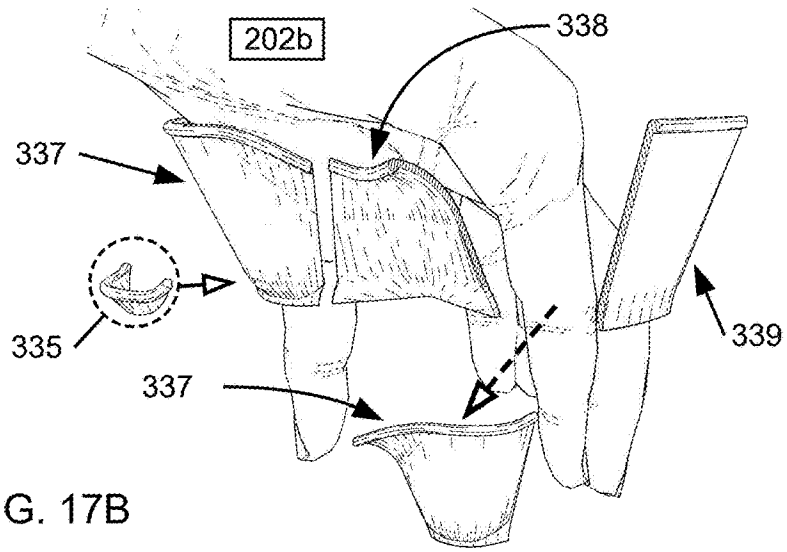
FIG. 17B

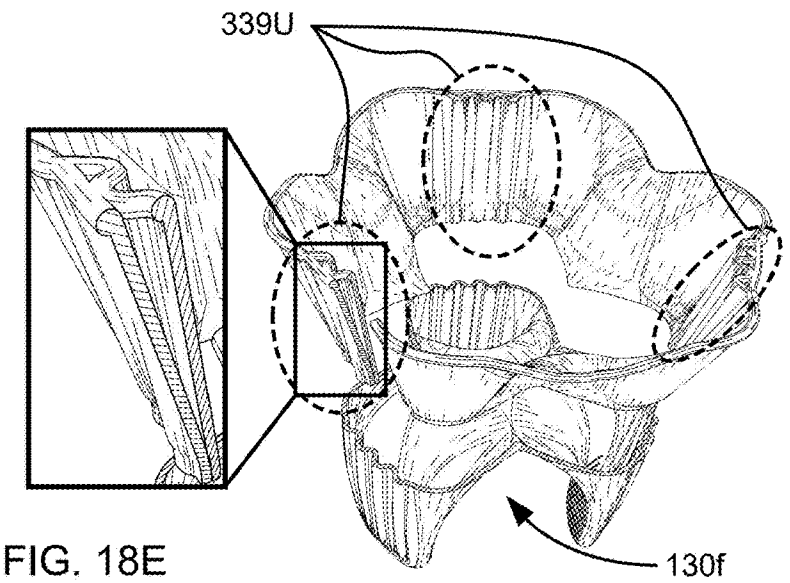
FIG. 18E
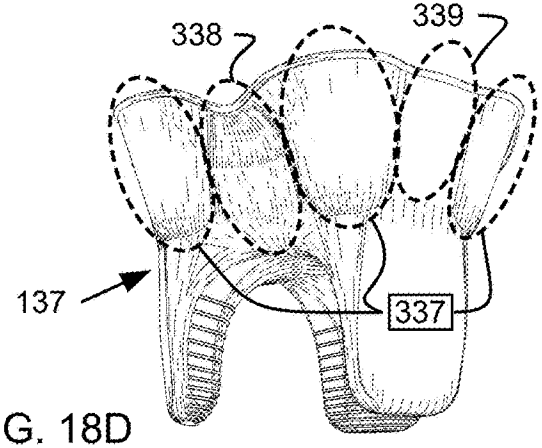
FIG. 18D
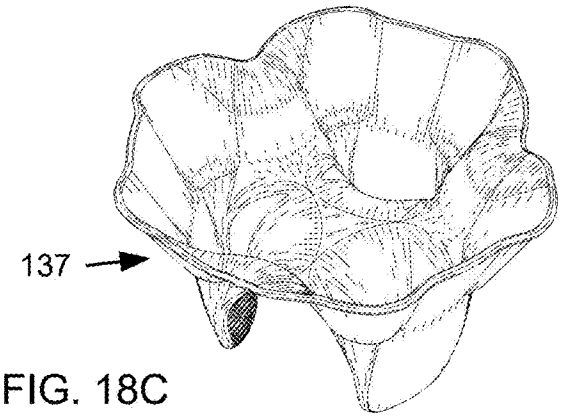
FIG. 18C
FIG. 18
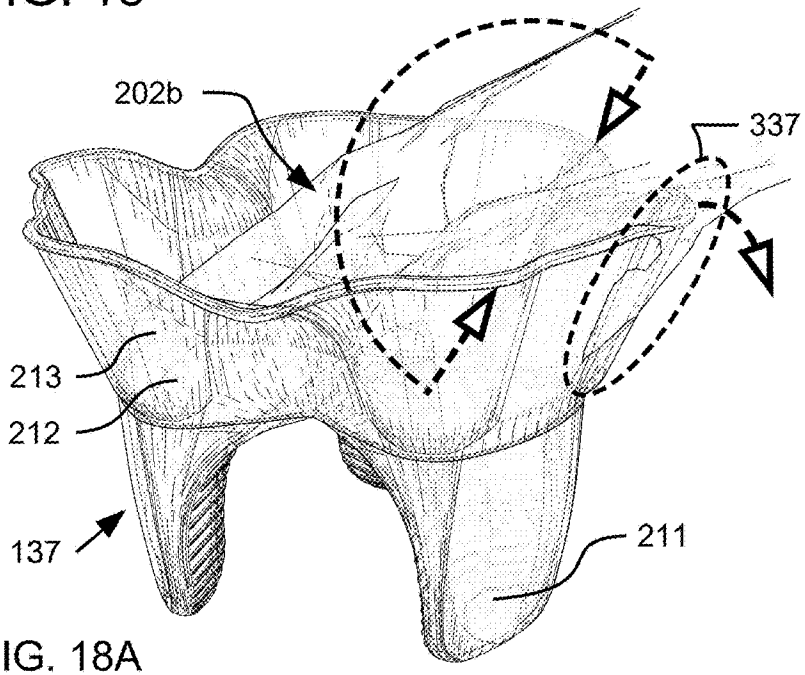
FIG. 18A
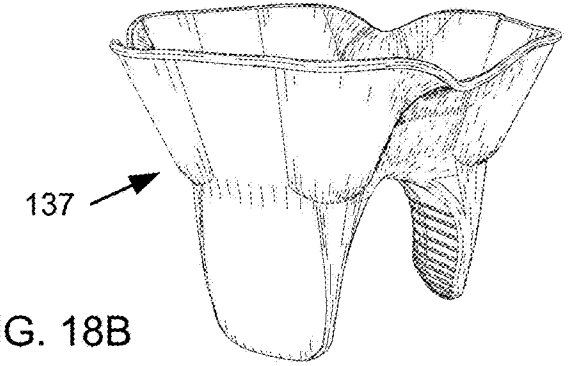
FIG. 18B

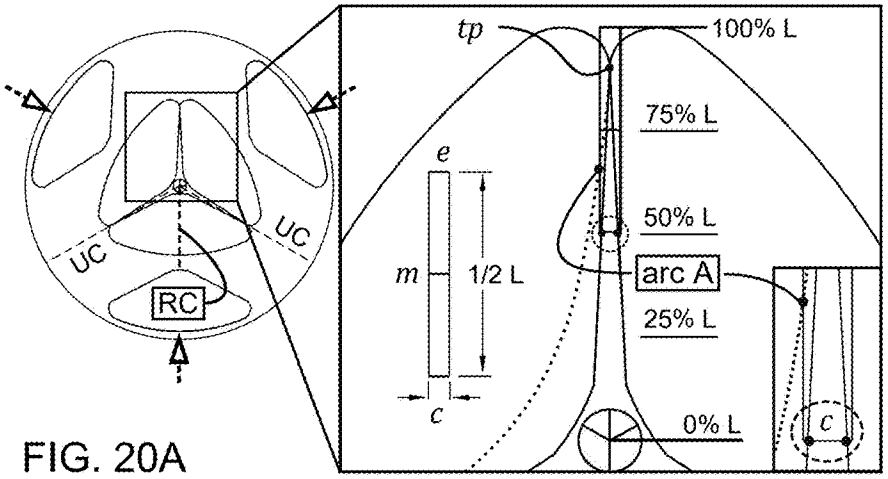
FIG. 20
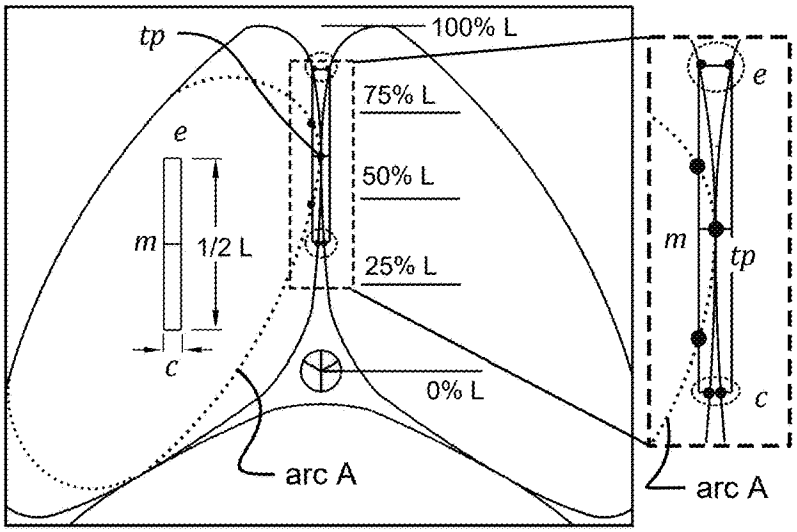
FIG. 20A
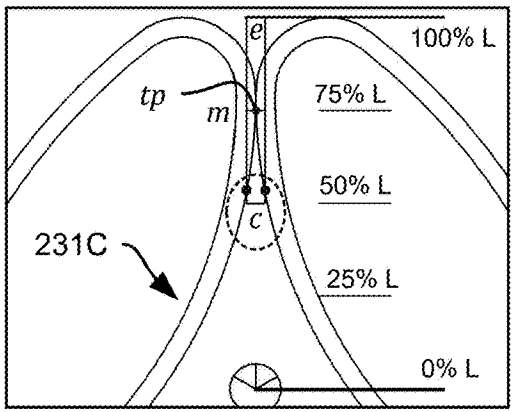
FIG. 20B
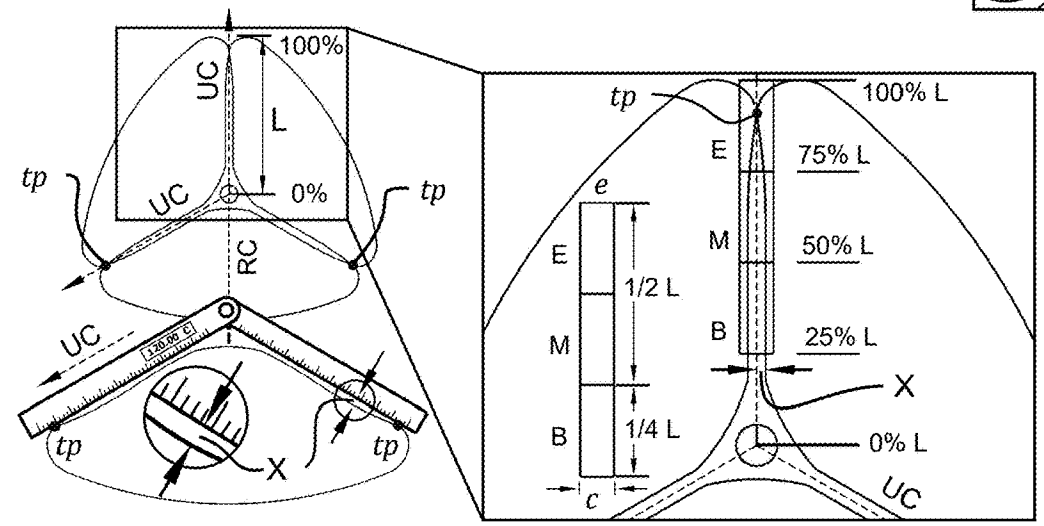
FIG. 20C
FIG. 20D

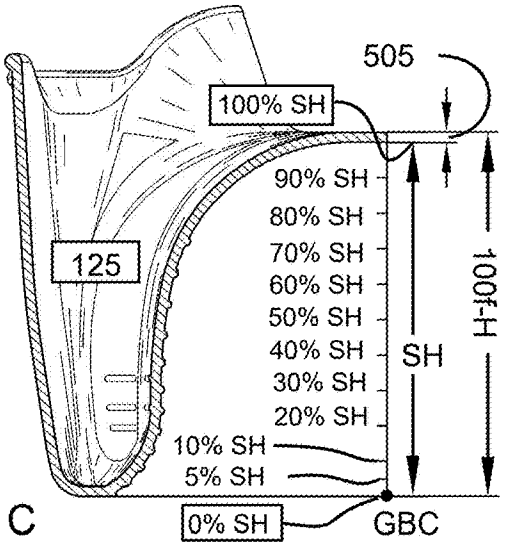
FIG. 21C
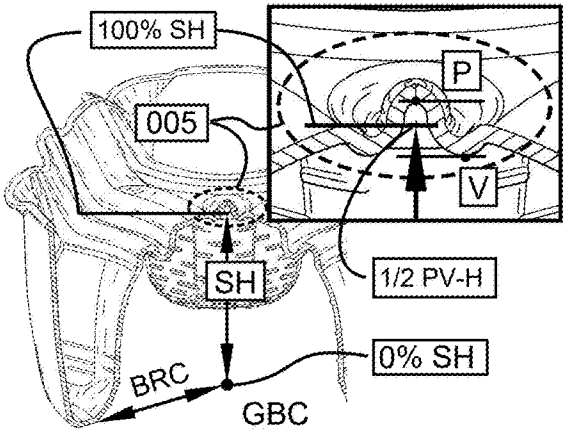
FIG. 21B
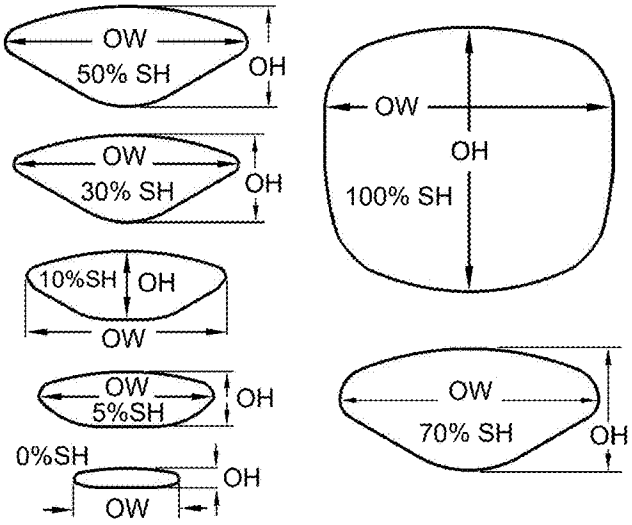
FIG. 21E
FIG. 21
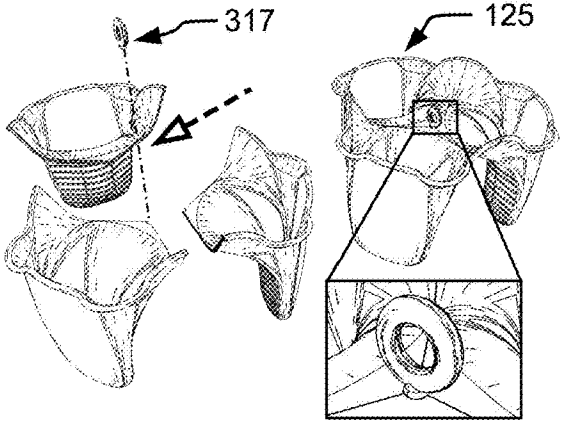
FIG. 21A
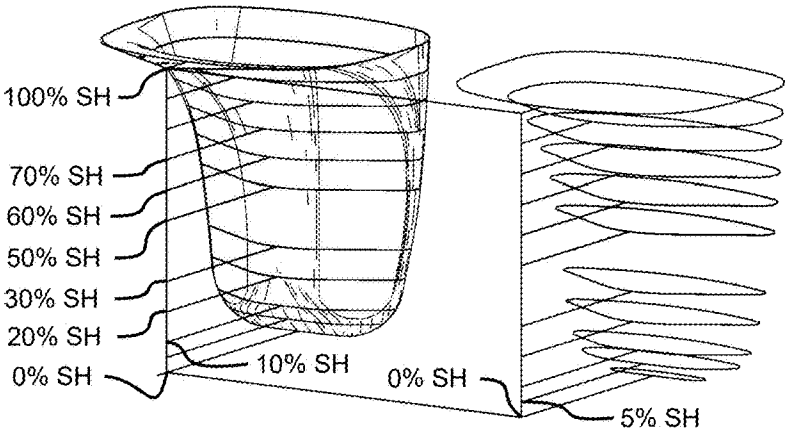
FIG. 21D

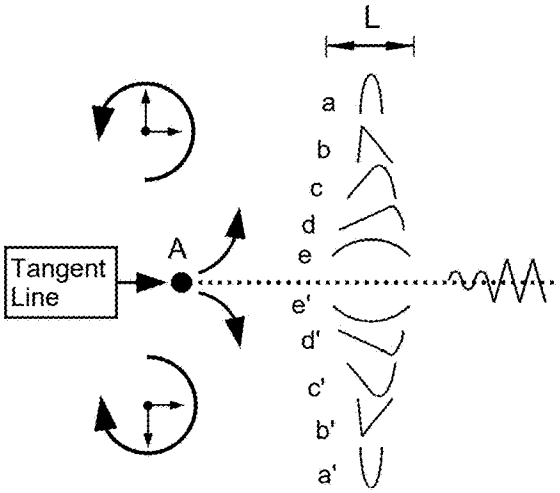
FIG. 22
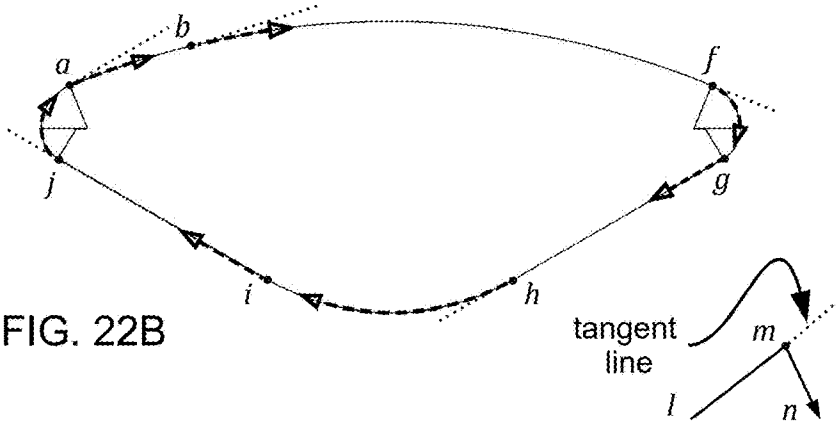
FIG. 22B
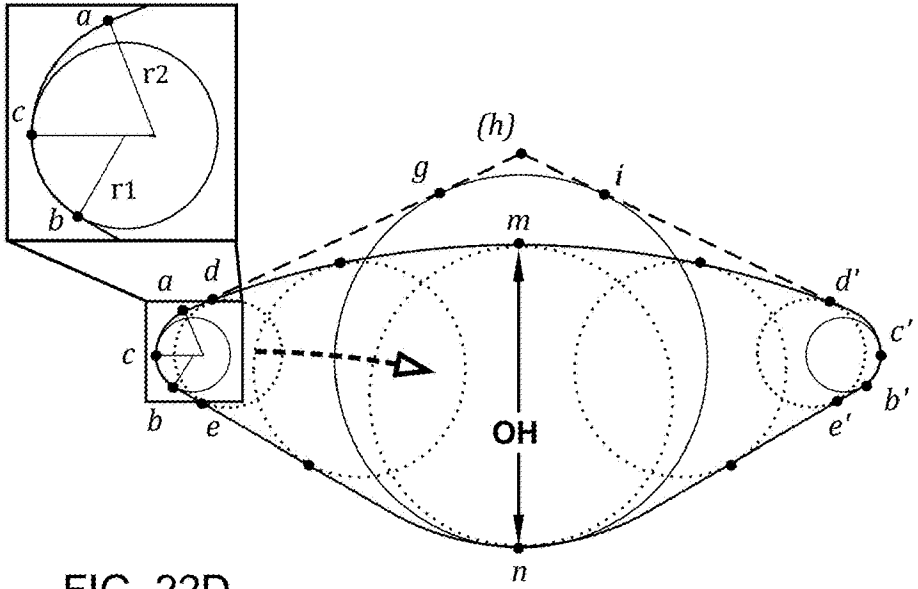
FIG. 22D
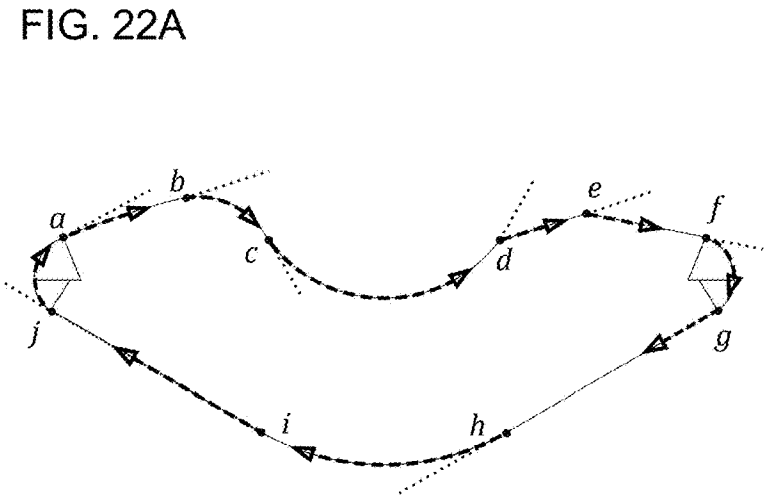
FIG. 22A
FIG. 22C

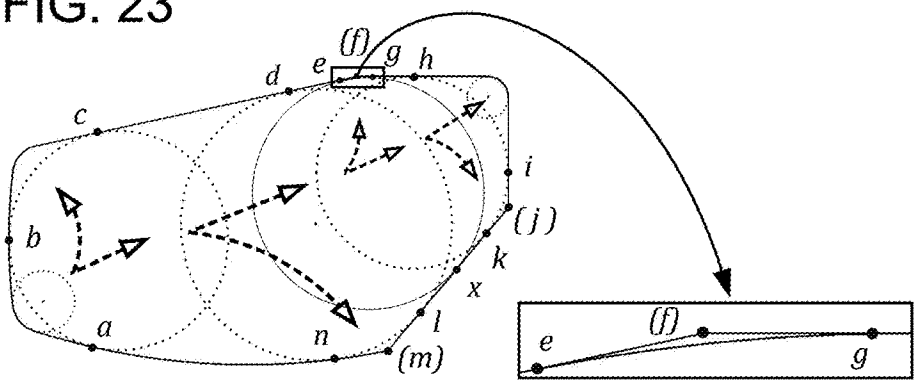
FIG. 23
FIG. 23A
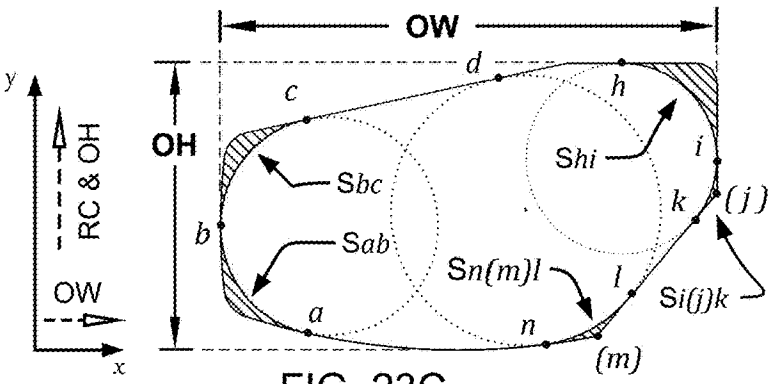
FIG. 23C
FIG. 23B
FIG. 23D

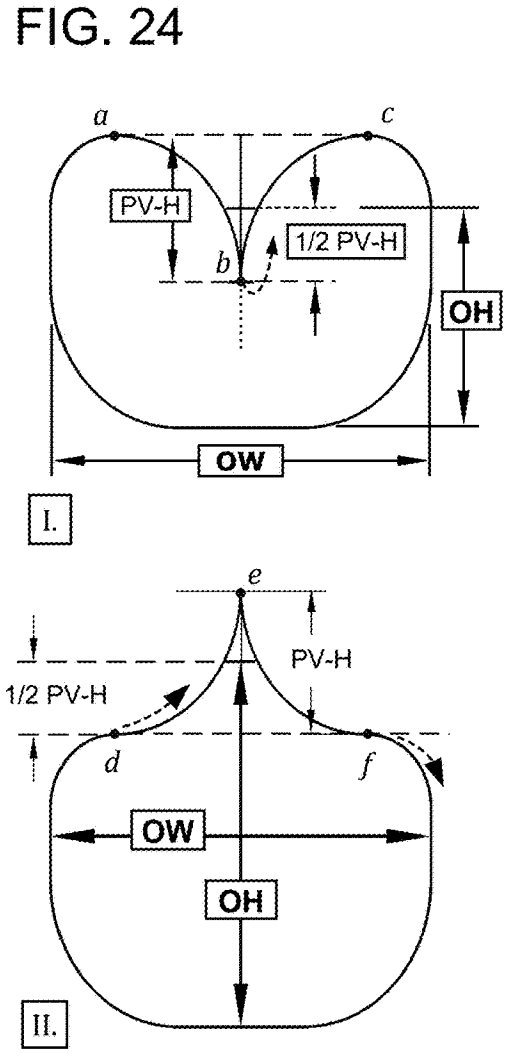
FIG. 24
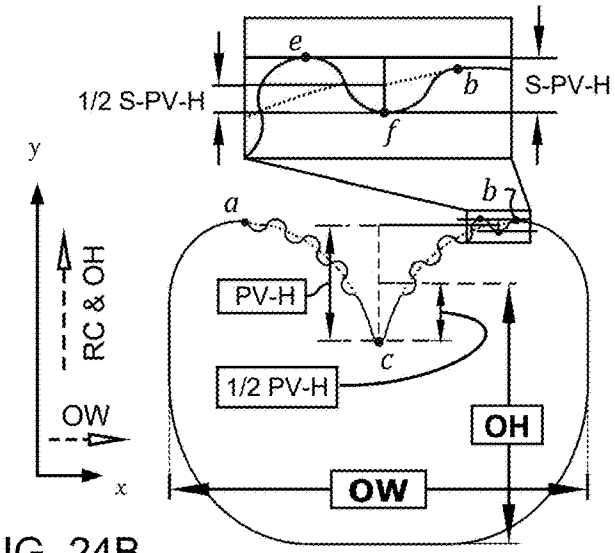
FIG. 24B
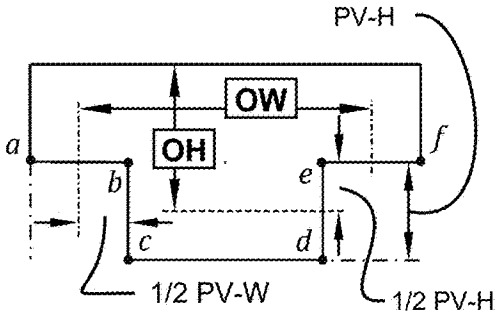
FIG. 24C
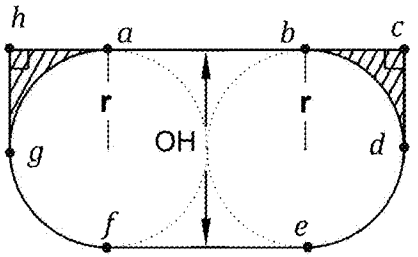
FIG. 24D
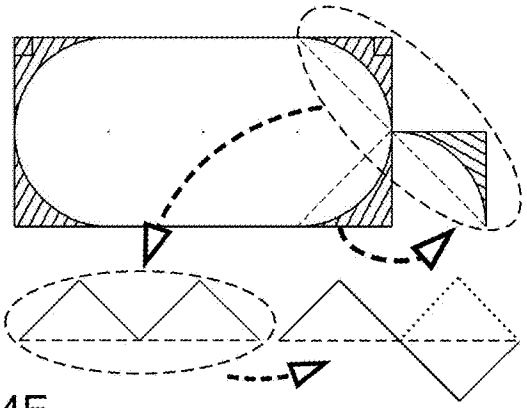
FIG. 24E
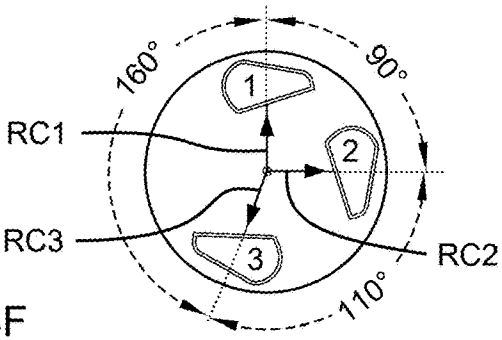
FIG. 24F
FIG. 24A

SINGLE HAND WEARABLE GLOVE

CROSS-REFERENCE TO RELATED APPLICATIONS

This application claims priority under 35 U.S.C. § 119 to provisional patent application No. 63/616,509, filed Dec. 29, 2023, entitled Single Hand Wearable Glove and to provisional patent application No. 63/666,108, filed Jun. 29, 2024, entitled Single Hand Wearable Glove, both of which are hereby incorporated by reference in their entirety.

BACKGROUND

Field of the Disclosure

Aspects of this disclosure relate to personal protective equipment, more specifically finger and hand protection for a kitchen, lab, hospital, shop, factory, office, garage, studio or other environment for the protection of fingers and hand.

Description of Related Art

The gripping of objects is an important aspect of everyday life due to the fact that people use their hands to grip objects throughout the day. Oven mitts, pot holders, and dish holders are most commonly used for holding heated kitchen utensils. Since oven mitts are usually large and clumsy, a user may find it difficult to securely grasp the object and further may need help from their other hand to put on the oven mitt. Pot holders do not cover the area to be held very well and can easily slip. Thus, the user's hand is susceptible to the heated utensils unless extra caution is exercised while using oven mitts and pot holders. Hence, neither oven mitts nor pot holders provide a safe and convenient mechanism for handling cooking utensils.

Sometimes gloves are used to protect hands from heated surfaces or other undesirable objects (for example raw meat, corrosive or dangerous substances, etc.) and enhance grip. Gloves used for such purposes may suffer from bunching of the material from which they are constructed, causing discomfort. Furthermore, gloves should be sized to fit the user's hand to provide the user with grip enhancing capabilities and protection.

Existing finger mitts are either too limited in how they can be used, provide inadequate protection for the hand or fingers, fail to enhance grip and fail to sufficiently enable a user to grab items, or they have other problems. None of the existing solutions provide an effective means for gripping and protecting a user's hand during cooking or other activities.

Therefore, what is needed is a single hand wear and take off glove.

SUMMARY

The systems, methods and devices of this disclosure each have several innovative aspects, no single one of which is solely responsible for the desirable attributes disclosed herein.

A single hand wear and take off glove may comprise a center conjunction area and exactly three finger sleeves connected to the center conjunction area. Each finger sleeve may have an open end and a tip, the open end at the connection to the center conjunction area and opposite the tip. The tips of the three finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH). The shape of the transverse cross section may be a closed shape with interconnected convex segments and may have less than three simple "S" segments. The transverse cross section of each finger sleeve may have a ratio of width (OW) to height (OH), at the sleeve height (SH), from the ratios selected from the following: greater than 2.1:1-sleeve height (SH) from 10% to 20%; greater than 2:1-sleeve height (SH) from 10% to 30%; greater than 1.8:1-sleeve height (SH) from 10% to 50%; and greater than 1.6:1-sleeve height (SH) from 10% to 70%.

The single hand wear and take off glove may include each finger sleeve having an interior wall and an exterior wall, the interior wall being closer to the center conjunction area, along the transverse cross section, than the exterior wall. The single hand wear and takeoff glove may include a plurality of horizontal U/V grooves across at least some part of the interior wall of at least one of the finger sleeves.

The single hand wear and take off glove may include a print pattern on at least one of the finger sleeves.

The single hand wear and take off glove may include the three finger sleeves being rotationally symmetric around a line orthogonal to the sitting plane.

The single hand wear and take off glove may include each finger sleeve having an interior wall and an exterior wall, where the interior wall may be closer to the center conjunction area, along the transverse cross section, than the exterior wall. The tips of the three finger sleeves may be configured to contact a contact circle in the sitting plane. For each finger sleeve, the contact point may be on the interior wall at 0% of the sleeve height (SH), where the center of the contact circle may be a glove bottom center (GBC). For each finger sleeve, at 0% of the sleeve height (SH), there may be a clamp angle β with a vertex at the glove bottom center (GBC), and the clamp angle β may contact the finger sleeve at each side. The clamp angle β may be bisected by a bottom grip radius (BRC). The height (OH) may be parallel to the bottom grip radius (BRC). The height (OH) may be configured to have an OH end level line perpendicular to the height (OH) and contacting the interior wall. The bottom grip radius (BRC) may be measured from the glove bottom center (GBC) to the OH end level line. There may be an average of the bottom grip radius (BRC) for all the finger sleeves with a ratio of the average to sleeve height (SH) being between 1:0.9 and 1:1.65.

A single hand wear and take off glove may include a center conjunction area and exactly four finger sleeves connected to the center conjunction area. Each finger sleeve may have an open end and a tip. The open end may be at the connection to the center conjunction area and opposite the tip. The tips of the four finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH). The shape of the transverse cross section may be a closed shape with interconnected convex segments and may have less than three simple "S" segments. The transverse cross section of each finger sleeve may have a ratio of width (OW) to height (OH), at the sleeve height (SH), with the ratio selected from the following: greater than 1.5:1-sleeve height (SH) from 10% to 30%, and greater than 1.4:1-sleeve height (SH) from 10% to 50%.

The single hand wear and take off glove may include each finger sleeve having an interior wall and an exterior wall, the interior wall being closer to the center conjunction area, along the transverse cross section, than the exterior wall. The single hand wear and take off glove may include a plurality of horizontal U/V grooves across at least some part of the interior wall of at least one of the finger sleeves.

The single hand wear and take off glove may include a print pattern on at least one of the finger sleeves.

The single hand wear and take off glove may have the four finger sleeves rotationally symmetric around a line orthogonal to the sitting plane.

The single hand wear and take off glove may have each finger sleeve with an interior wall and an exterior wall, with the interior wall closer to the center conjunction area, along the transverse cross section, than the exterior wall. The glove may include the tips of the four finger sleeves being configured to contact a plurality of contact circles in the sitting plane. For each finger sleeve, the contact point may be on the interior wall at 0% of the sleeve height (SH), with the center of the smallest of the plurality of contact circles being a glove bottom center (GBC). For each finger sleeve, at 0% of the sleeve height (SH), there may being a clamp angle β with a vertex at the glove bottom center (GBC) and the clamp angle β may contact the finger sleeve at each side. The clamp angle β may be bisected by a bottom grip radius (BRC). The height (OH) may be parallel to the bottom grip radius (BRC). The height (OH) may be configured to have an OH end level line perpendicular to the height (OH) and may contact the interior wall. The bottom grip radius (BRC) may be measured from the glove bottom center (GBC) to the OH end level line. There may be an average of the bottom grip radius (BRC) for all the finger sleeves, where a ratio of the average to sleeve height (SH) may be between 1:0.9 and 1:1.65.

A single hand wear and take off glove may include a center conjunction area and exactly three finger sleeves connected to the center conjunction area. Each finger sleeve may have an open end and a tip, the open end at the connection to the center conjunction area and opposite the tip. The tips of the three finger sleeves may form a sitting plane, with each finger sleeve having a sleeve height (SH) that may be measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH). The shape of the transverse cross section may be a closed shape with interconnected convex segments and may have more than two simple "S" segments. The transverse cross section of each finger sleeve may have a ratio of width (OW) to height (OH), at the sleeve height (SH), with the ratio selected from the following: greater than 1.8:1-sleeve height (SH) from 10% to 20%; greater than 1.7:1-sleeve height (SH) from 10% to 30%; and greater than 1.5:1-sleeve height (SH) from 10% to 50%.

The single hand wear and take off glove may include each finger sleeve having an interior wall and an exterior wall, with the interior wall closer to the center conjunction area, along the transverse cross section, than the exterior wall. The glove may include a plurality of horizontal U/V grooves across at least some part of the interior wall of at least one of the finger sleeves.

The single hand wear and take off glove may include a print pattern on at least one of the finger sleeves.

The single hand wear and take off glove may have the three finger sleeves being rotationally symmetric around a line orthogonal to the sitting plane.

The single hand wear and take off glove may have each finger sleeve with an interior wall and an exterior wall, where the interior wall is closer to the center conjunction area, along the transverse cross section, than the exterior wall. The glove may include the tips of the three finger sleeves being configured to contact a contact circle in the sitting plane. For each finger sleeve the contact point may be on the interior wall at 0% of the sleeve height (SH) with the center of the contact circle being a glove bottom center (GBC). For each finger sleeve, at 0% of the sleeve height (SH), there may be a clamp angle β with a vertex at the glove bottom center (GBC). The clamp angle β may contact the finger sleeve at each side. The clamp angle β may be bisected by a bottom grip radius (BRC). The height (OH) may be parallel to the bottom grip radius (BRC). The height (OH) may be configured to have an OH end level line perpendicular to the height (OH) and may contact the interior wall. The bottom grip radius (BRC) may be measured from the glove bottom center (GBC) to the OH end level line. There may be an average of the bottom grip radius (BRC) for all the finger sleeves, where a ratio of the average to sleeve height (SH) may be between 1:0.9 and 1:1.65.

A single hand wear and take off glove may include a center conjunction area and exactly four finger sleeves connected to the center conjunction area. Each finger sleeve may have an open end and a tip, the open end at the connection to the center conjunction area and opposite the tip. The tips of the four finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH). The shape of the transverse cross section may be a closed shape with interconnected convex segments and may have more than two simple "S" segments. The transverse cross section of each finger sleeve may have a ratio of width (OW) to height (OH), at the sleeve height (SH), with the ratio selected from the following: greater than 1.35:1-sleeve height (SH) from 10% to 30%; and greater than 1.25:1-sleeve height (SH) from 10% to 50%.

The single hand wear and take off glove may include each finger sleeve with an interior wall and an exterior wall, the interior wall closer to the center conjunction area, along the transverse cross section, than the exterior wall. The glove may further include a plurality of horizontal U/V grooves across at least some part of the interior wall of at least one of the finger sleeves.

The single hand wear and take off glove may include a print pattern on at least one of the finger sleeves.

The single hand wear and take off glove may include the four finger sleeves being rotationally symmetric around a line orthogonal to the sitting plane.

The single hand wear and take off glove may include each finger sleeve having an interior wall and an exterior wall, with the interior wall closer to the center conjunction area, along the transverse cross section, than the exterior wall. The glove may include the tips of the four finger sleeves being configured to contact a plurality of contact circles in the sitting plane. For each finger sleeve, the contact point may be on the interior wall at 0% of the sleeve height (SH). The center of the smallest of the plurality of contact circles may be a glove bottom center (GBC). For each finger sleeve, at 0% of the sleeve height (SH), there may be a clamp angle β with a vertex at the glove bottom center (GBC) and the clamp angle β may contact the finger sleeve at each side. The clamp angle β may be bisected by a bottom grip radius (BRC). The height (OH) may be parallel to the bottom grip radius (BRC). The height (OH) may be configured to have an OH end level line perpendicular to the height (OH) and contacting the interior wall. The bottom grip radius (BRC) may be measured from the glove bottom center (GBC) to the OH end level line. There may be an average of the bottom grip radius (BRC) for all the finger sleeves, with a ratio of the average to sleeve height (SH) being between 1:0.9 and 1:1.65.

A single hand wear and take off glove may include a center conjunction area and exactly three finger sleeves connected to the center conjunction area. Each finger sleeve may have an open end and a tip, with the open end at the connection to the center conjunction area and opposite the tip. The tips of the three finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH), with the shape of the transverse cross section being a closed shape and having at least one concave segment and at least one convex segment. The transverse cross section of each finger sleeve may have a ratio of width (OW) to height (OH), at the sleeve height (SH), with the ratio selected from the following: greater than 1.8:1-sleeve height (SH) from 10% to 20%; greater than 1.7:1-sleeve height (SH) from 10% to 30%; and greater than 1.5:1-sleeve height (SH) from 10% to 50%.

The single hand wear and take off glove may include each finger sleeve having an interior wall and an exterior wall, the interior wall closer to the center conjunction area, along the transverse cross section, than the exterior wall. The glove may include a plurality of horizontal U/V grooves across at least some part of the interior wall of at least one of the finger sleeves.

The single hand wear and take off glove may include a plurality of vertical U/V grooves across at least some part of at least one of the finger sleeves.

The single hand wear and take off glove may include a plurality of zigzag U/V grooves across at least some part of at least one of the finger sleeves.

The single hand wear and take off glove may include a print pattern on at least one of the finger sleeves.

The single hand wear and take off glove may include the three finger sleeves being rotationally symmetric around a line orthogonal to the sitting plane.

The single hand wear and take off glove may include each finger sleeve having an interior wall and an exterior wall, with the interior wall closer to the center conjunction area, along the transverse cross section, than the exterior wall. The glove may include the tips of the three finger sleeves being configured to contact a contact circle in the sitting plane. For each finger sleeve, the contact point may be on the interior wall at 0% of the sleeve height (SH). The center of the contact circle may be a glove bottom center (GBC). For each finger sleeve, at 0% of the sleeve height (SH), there may be a clamp angle β with a vertex at the glove bottom center (GBC) and the clamp angle β may contact the finger sleeve at each side. The clamp angle β may be bisected by a bottom grip radius (BRC). The height (OH) may be parallel to the bottom grip radius (BRC). The height (OH) may have an OH end level line perpendicular to the height (OH) and contacting the interior wall. The bottom grip radius (BRC) may be measured from the glove bottom center (GBC) to the OH end level line. There may be an average of the bottom grip radius (BRC) for all the finger sleeves, with a ratio of the average to sleeve height (SH) being between 1:0.9 and 1:1.65.

A single hand wear and take off glove may include a center conjunction area and exactly four finger sleeves connected to the center conjunction area. Each finger sleeve may have an open end and a tip, the open end at the connection to the center conjunction area and opposite the tip. The tips of the four finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH), with the shape of the transverse cross section being a closed shape and having at least one concave segment and at least one convex segment. The transverse cross section of each finger sleeve may have a ratio of width (OW) to height (OH), at the sleeve height (SH), with the ratio selected from the following: greater than 1.35:1-sleeve height (SH) from 10% to 30%; and greater than 1.25:1-sleeve height (SH) from 10% to 50%.

The single hand wear and take off glove may include each finger sleeve having an interior wall and an exterior wall, with the interior wall closer to the center conjunction area, along the transverse cross section, than the exterior wall. The glove may include a plurality of horizontal U/V grooves across at least some part of the interior wall of at least one of the finger sleeves.

The single hand wear and take off glove may include a plurality of vertical U/V grooves across at least some part of at least one of the finger sleeves.

The single hand wear and take off glove may include a plurality of zigzag U/V grooves across at least some part of at least one of the finger sleeves.

The single hand wear and take off glove may include a print pattern on at least one of the finger sleeves.

The single hand wear and take off glove may include the four finger sleeves being rotationally symmetric around a line orthogonal to the sitting plane.

The single hand wear and take off glove may include each finger sleeve having an interior wall and an exterior wall, with the interior wall closer to the center conjunction area, along the transverse cross section, than the exterior wall. The glove may include the tips of the four finger sleeves being configured to contact a plurality of contact circles in the sitting plane. For each finger sleeve, the contact point may be on the interior wall at 0% of the sleeve height (SH), the center of the smallest of the plurality of contact circles being a glove bottom center (GBC). For each finger sleeve, at 0% of the sleeve height (SH), there may be a clamp angle β with a vertex at the glove bottom center (GBC) and the clamp angle β contacting the finger sleeve at each side. The clamp angle β may be bisected by a bottom grip radius (BRC). The height (OH) may be parallel to the bottom grip radius (BRC). The height (OH) may have an OH end level line perpendicular to the height (OH) and contacting the interior wall. The bottom grip radius (BRC) may be measured from the glove bottom center (GBC) to the OH end level line. There may be an average of the bottom grip radius (BRC) for all the finger sleeves, with a ratio of the average to sleeve height (SH) being between 1:0.9 and 1:1.65.

A single hand wear and take off glove may include a center conjunction area and at least three finger sleeves connected to the center conjunction area. Each finger sleeve may have an open end and a tip, with the open end at the connection to the center conjunction area and opposite the tip. The tips of the at least three finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH). The width (OW) may be greater than the height (OH) between 10% and 50% of the sleeve height (SH). The shape of the transverse cross section between 20% and 70% of the sleeve height (SH) may be a triangular shape.

The single hand wear and take off glove may include each finger sleeve having an interior wall and an exterior wall, with the interior wall closer to the center conjunction area, along the transverse cross section, than the exterior wall. The glove may include a plurality of horizontal U/V grooves across at least some part of the interior wall of at least one of the finger sleeves.

The single hand wear and take off glove may include a plurality of vertical U/V grooves across at least some part of at least one of the finger sleeves.

The single hand wear and take off glove may include a plurality of zigzag U/V grooves across at least some part of at least one of the finger sleeves.

The single hand wear and take off glove may include a print pattern on at least one of the finger sleeves.

The single hand wear and take off glove may include the at least three finger sleeves being rotationally symmetric around a line orthogonal to the sitting plane.

A single hand wear and take off glove may include a center conjunction area with at least three finger sleeves connected to the center conjunction area. Each finger sleeve may have an open end and a tip, with the open end at the connection to the center conjunction area and opposite the tip. The tips of the at least three finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have an interior wall and an exterior wall, with the interior wall closer to the center conjunction area, along the transverse cross section, than the exterior wall. A top skirt may connect to the exterior wall of each finger sleeve. The top skirt may continuously encircle the at least three finger sleeves and the center conjunction area. The top skirt may extend upward away from the open end of each finger sleeve to a top edge and may include a plurality of notch wings, at least some part of the plurality of notch wings along the top edge of the top skirt.

The single hand wear and take off glove may include each finger sleeve being coupled to two of the plurality of notch wings, with one notch wing located at each side of each finger sleeve.

The single hand wear and take off glove may include a plurality of inter-arc-bridge wings along the top edge of the top skirt. Each inter-arc-bridge wing may be connected to and in between two notch wings of the adjacent finger sleeves, there being the same number of inter-arc-bridge wings as finger sleeves.

The single hand wear and take off glove may include the top skirt extending above the center conjunction area at least a distance equal to 50% of the sleeve height (SH).

The single hand wear and take off glove may include a plurality of horizontal U/V grooves across at least some part of the interior wall of at least one of the finger sleeves.

The single hand wear and take off glove may include a plurality of vertical U/V grooves across at least some part of the top skirt.

The single hand wear and take off glove may include a plurality of vertical U/V grooves across at least some part of at least one of the finger sleeves.

The single hand wear and take off glove may include a plurality of zigzag U/V grooves across at least some part of at least one of the finger sleeves.

The single hand wear and take off glove may include a plurality of zigzag U/V grooves across at least some part of the top skirt.

The single hand wear and take off glove may include a print pattern on at least one of the finger sleeves.

The single hand wear and take off glove may include the at least three finger sleeves being rotationally symmetric around a line orthogonal to the sitting plane.

A single hand wear and take off glove may include a center conjunction area and three finger sleeves connected to the center conjunction area. Each finger sleeve may have an open end and a tip, the open end at the connection to the center conjunction area and opposite the tip. The tips of the three finger sleeves may form a sitting plane. Each finger sleeve may have a sleeve height (SH) measured on a vertical axis orthogonal to the sitting plane from the tip to the center conjunction area, with 0% of the sleeve height (SH) at the tip to 100% of the sleeve height (SH) at the center conjunction area. Each finger sleeve may have a transverse cross section that is in a plane orthogonal to the vertical axis. The transverse cross section may have a width (OW) and a height (OH), a ratio of the width (OW) to the height (OH) being greater than 1.8:1 from 10% to 20% of the sleeve height (SH). Each finger sleeve may have a test rectangle with dimensions of width (OW)/2 by width (OW)/40. The width (OW) may be taken at 10% of the sleeve height (SH). The rectangle's narrow edges may be parallel to the vertical axis. The narrow edges may start at 0% of the sleeve height (SH). The rectangle's wide edges may be parallel to the width (OW) and centered along the width (OW). The bottom of each finger sleeve may intersect with both narrow edges of the rectangle and the portion of the bottom between the two intersection points fit entirely within the rectangle.

The single hand wear and take off glove may include the bottom of each finger sleeve having a flat segment in the center connected with two round corners. The flat segment may be at least 10% the width (OW) of the finger sleeve's transverse cross section at 10% of the sleeve height (SH).

The single hand wear and take off glove may include each finger sleeve having an interior wall and an exterior wall, with the interior wall closer to the center conjunction area, along the transverse cross section, than the exterior wall. The glove may include a plurality of horizontal U/V grooves across at least some part of the interior wall of at least one of the finger sleeves.

The single hand wear and take off glove may include a plurality of vertical U/V grooves across at least some part of at least one of the finger sleeves.

The single hand wear and take off glove may include a plurality of zigzag U/V grooves across at least some part of at least one of the finger sleeves.

The single hand wear and take off glove may include a print pattern on at least one of the finger sleeves.

The single hand wear and take off glove may include the three finger sleeves being rotationally symmetric around a line orthogonal to the sitting plane.

The foregoing has outlined rather broadly the gestures and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of this disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purposes of illustration and description, and not as a definition of the limits of the claims.

BRIEF DESCRIPTION OF THE DRAWINGS

So that the above-recited features of the disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects. The same reference numbers in different drawings may identify the same or similar elements.

FIG. 1A illustrates an upper side perspective view of SHWT glove 100 with three identical finger sleeves 101. Illustrate reverse U-shaped tunnel 106, inter-arc-bridge wing 216*c*1, top edge rim 107, sleeve height (SH), bottom grip radius (BRC), UC.

FIG. 1B illustrates a top perspective view of SHWT glove 100. Illustrate arc bridge section 108, center conjunction area 103, open end 102 and top edge rim 107.

FIG. 1C illustrates a bottom perspective view of SHWT glove 100. Illustrate three finger sleeves 101, three reverse U-shaped tunnels 106 and its external width 105*a* and internal width 105*b*, bottom grip radius (BRC), contact circle 002 and its contact points 003 with sleeve interior wall.

FIG. 1D illustrates a longitudinal cross-section perspective view of SHWT glove 100 with arc bridge section 108C, sleeve interior wall 109C and exterior wall 104C, and reverse U-shaped tunnel 106C's vertical length arc B.

FIG. 2A illustrates SHWT glove 100 sitting on flat surface, ready for hand 202*b* to insert. Expanded view of long striped print pattern 206 on sleeve interior wall. Also illustrates each finger's MCP joint 271, MCP joint 272, MCP joint 273, MCP joint 274 and MCP joint 275, collectively referred to as MCP joints; each finger's PIP joint 292, PIP joint 293 and PIP joint 294, collectively referred to as PIP joints and DIP joint 261, DIP joint 262, DIP joint 263 and DIP joint 264, collectively referred to as DIP joints.

FIG. 2B illustrates a view of right hand 202*b* fully inserted into SHWT glove 100 in a relaxed open posture, with SHWT glove 100 standing on a flat surface.

FIG. 2C illustrates a transverse cross section cutting plane at mid sleeve section at T-DIP joint level T-DIP-H of SHWT glove 100 with all five fingers inserted. It also illustrates a thumb 211's T-DIP average shape 207 that can be estimated by averaging several evenly sliced transverse cross sections' shapes around the height range indicated by square box.

FIG. 2D illustrates a bottom view of SHWT glove 100's upper section above the cutting plane shown in FIG. 2C with all five fingers inserted. It illustrates sleeve side gap 218*a*, inter finger gap 218*b*, each digit's transverse cross section 211C, 212C, 213C, 214C, 215C, the shape of finger sleeve transverse cross section when distorted and circumference 210 of two inserted fingers.

FIG. 6A illustrates four different top skirts SW01 without notch, SW02 with outward reclined skirt wall, SW03 with notch Nh and SW05 with notch wings 335. SW02, SW03 and SW05 allow a finger to be fully inserted by an extra distance D compared to SW01.

FIG. 6B illustrates four different top skirts on top of the SHWT glove finger protection body 100*f* to configure four SHWT gloves 121, 122, 100 (with notch Nh) and 125 (with notch wings 335).

FIG. 7A illustrates an upper perspective view of notch wing 335 and its conjunction area with inter-arc-bridge wing 216*c*1 (left section) will form an integrated part (dashed circle area) to mimic the thumb root section shape.

FIG. 7B illustrates an upper perspective view of top skirts SW05 followed by an expanded view illustrating notch wing 335 is implemented by extending notch Nh (refer FIG. 5D) outward.

FIG. 7C illustrates a top skirt SW05 on the top compared to SW02 on the bottom. It illustrates SW02 outward reclined skirt wall at notch wing location is equivalent to SW05's notch wing 335.

FIG. 10A illustrates an upper isometric view of SHWT glove 100. It illustrates a transverse cross section view of finger sleeve shape at T-DIP joint level with side vertex 100S, sleeve interior wall middle vertex 100M1, sleeve exterior wall middle vertex 100M2 and sleeve interior wall middle arc ARC IN.

FIG. 10B illustrates an upper isometric view of SHWT glove 230. It illustrates a transverse cross section view of finger sleeve shape at T-DIP joint level with side vertex 100S, sleeve interior wall middle vertex 100M1, sleeve interior wall middle arc ARC IN, width (OW), height (OH).

FIG. 10C illustrates a transverse cross section view of SHWT glove 150's finger sleeve shape at T-DIP joint level with width (OW), height (OH), sleeve exterior wall with arc shape and an example of alternative flat shape 500C on the sleeve exterior wall.

FIG. 10D illustrates a transverse cross section view of SHWT glove 130's finger sleeve shape at T-DIP joint level, adding vertical U/V grooves to SHWT glove 100's 2D sleeve shape and transverse cross section view of three finger sleeves together. Illustrate 2D transverse cross section initial circumference 006 of finger sleeve embedded with vertical U/V grooves without the vertical U/V grooves expanded. 531C illustrates cross section view of vertical U/V grooves 531.

FIG. 10E illustrates a transverse cross section view of SHWT glove 170's finger sleeve shape at T-DIP joint level, adding vertical U/V grooves to SHWT glove 230's 2D sleeve shape and transverse cross section view of three finger sleeves together. 531C illustrates cross section view of vertical U/V grooves 531. An expanded view illustrates outward line 503C based U/V grooves and inward line 501C based U/V grooves.

FIG. 11A illustrates a bottom perspective view of SHWT glove 230 with different external width 105*a* and internal width 105*b* to illustrate non-parallel reverse U-shaped tunnel. It illustrates a nonparallel reverse U-shaped tunnel's internal width 105*b* as the distance between two neighboring sleeve's grip radius (RC) end points on the sleeve interior wall shifted towards external width 105*a* by half ARC IN segment.

FIG. 11B illustrates SHWT glove 130's finger sleeve with vertical U/V grooves on the sleeve exterior wall with height (OH) and width (OW). Further adding vertical U/V grooves to the left and right side of the sleeve reduces width (OW) to Owa. 531C illustrates cross section view of vertical U/V grooves 531.

FIG. 11C illustrates a detailed 2D transverse cross section view of SHWT glove 230's finger sleeve 231C at T-DIP joint level. It illustrates a round side corner tip arc ARC 231 with side corner arm NCA1 comparing to sharp side corner tip arc ARC2 with longer side corner arm NCA2. It also illustrates width (OW), height (OH), sleeve side corner angle NTA, ARC IN, ARC EXT and inserted middle finger 213C.

FIG. 11D illustrates a detailed transverse cross section view of SHWT glove 100's finger sleeve 101C at T-DIP joint level. It illustrates an original sleeve shape deformed by fully parallel inserted index finger 212C and middle finger 213C. Illustrate round side corner tip arc ARC101 with side corner arm NCA1 comparing to sharp side corner tip arc ARC2 with longer side corner arm NCA2. Dashed lines represent original non deformed SHWT glove 100's sleeve shape to deformed shape for sleeve deformation comparison purpose.

FIG. 12A II illustrates an isometric view of sleeve bottom rest on flat surface with flat segment 117 and width (OW) length at 10% sleeve height (SH).

FIG. 12A III illustrates a sleeve bottom isometric view with 117 are identified as flat shape using rectangular overflow test with 20:1 test rectangle.

FIG. 13A illustrates a top perspective view of SHWT glove 250 with four identical finger sleeves.

FIG. 13B illustrates a lower perspective view of SHWT glove 250 with four identical finger sleeves.

FIG. 13C illustrates a transverse cross section view of SHWT glove 100 with rotational symmetry at 50% of the sleeve height (SH) and each sleeve is line symmetric along grip radius (RC). Also illustrates grip radius (RC) definition with GC, angle β, height (OH) and UC line.

FIG. 13D illustrates a transverse cross section view at 0% of the sleeve height (SH) of a rotationally symmetric SHWT glove and each sleeve is non-line symmetric along bottom grip radius (BRC). Also illustrates bottom grip radius (BRC) definition with GBC, angle β, height (OH) and UC. Illustrates height (OH) two end level lines 008 orthogonal to bottom grip radius (BRC) and clamping sleeve interior and exterior wall.

FIG. 13E illustrates a top perspective view of SHWT glove 130 with vertical U/V grooves 531 added to the SHWT glove 100's finger sleeve exterior wall.

FIG. 13F illustrates a lower perspective view of SHWT glove 130 with vertical U/V grooves 531 added to the finger sleeves exterior wall. It illustrates vertical U/V grooves with different depths from deep grooves at sleeve top to shallow grooves toward sleeve bottom and gradually transition to disappear near sleeve tip.

FIG. 14A illustrates a perspective view of SHWT glove 100 palm protection section size matching the palm size of right hand 202*b*.

FIG. 14B illustrates a perspective view of SHWT glove 100 palm protection section size matching the palm size of right hand 202*b* with all finger sleeves' tips sitting on the hand.

FIG. 14C illustrates a top isometric view of SHWT glove 100 palm protection section size matching the palm size of right hand 202*b*.

FIG. 14D illustrates a view of a human hand inter finger arcs arc TI, arc MI and arc MR. Illustrate SHWT glove 100 center conjunction area 103 approximate location on a flat hand when fully closed, 103 center's approximate virtual distance to flat hand fingertip—Arc flat hand radius and to tight grip fingertip—ARC tight grip C. It illustrates palm creases 285, thumb MCP crease 287, thenar eminence 219 and hypothenar eminence 217. It illustrates delta distance SD between ARC flat hand radius and ARC tight grip C.

FIG. 15A illustrates a view of right hand 202*b* in SHWT glove 100 in tight grip posture with center conjunction area 103 location on the hand and its distance to finger tips ARC tight grip C. SHWT glove 100 is not illustrated for better hand posture and ARC tight grip C length illustration.

FIG. 15B illustrates a top side illustrative view of right hand 202*b* with SHWT glove 100 in tight grip posture. SHWT reverse U-shaped tunnel top has been squeezed and bent upward towards the root area in between middle finger 213 and ring finger 214.

FIG. 15C illustrates an isometric view of right hand 202*b* in tight grip posture with Projected-arc-tight-grip between middle and ring finger-Projected-arc-tight-grip MR (projected-arc-MR). The dashed curve line enclosing the hatched area represents projected-arc-MR length.

FIG. 15D illustrates a 3D view of how projected-arc-MR is estimated by a center SH line light source projection along UC line. The dashed curve line enclosing the hatched area represents the projected-arc-MR length.

FIG. 15E illustrates a longitudinal cross-section perspective view of SHWT glove 100's finger protection body 100*f* along arc C plane. Compares selected palm protection section with sleeve height (SH) and bottom grip radius (BRC) and a larger palm protection section with short sleeve height SHL and its corresponding bottom grip radius BRCL, while the length of arc C and arc CL are approximately the same.

FIG. 17A illustrates a SHWT glove finger protection body 100*f* with top skirt SW05 and high top skirt SW07 in comparison.

FIG. 17B illustrates shape of four basic parts to configure SW07: Thenar and hypothenar conjunction section 338, two thenar protection sections 337 based on notch wing 335 shape, and high skirt wall 339.

FIG. 17C illustrates right hand and left hand fully inserted into a SHWT glove at two sides, then merging together to mimic the combined virtual line symmetric left/right hand shape-combined virtual left/right hand shape.

FIG. 17D illustrates using combined virtual left/right hand shape as reference to design high top skirt in a rotational and line symmetric SHWT glove. It illustrates lower section of thenar protection section 337 and its conjunction section with lower section of thenar and hypothenar conjunction section 338 in dashed circle area match hand's thumb root section shape.

FIG. 18A illustrates a transparent view of a fully inserted hand in relaxed open posture and SHWT glove 137 standing on flat surface with no deformation. SHWT glove 137's thenar protection section 337 overlaps with fully inserted right hand 202*b*'s thumb root to wrist area. Thumb root & thenar eminence push the top of the more vertically extended thenar protection section 337 wall outward during hand insertion.

FIG. 18B illustrates a side perspective view of SHWT glove 137 from upside.

FIG. 18C illustrates a top perspective view of SHWT glove 137.

FIG. 18D illustrates a side perspective view of SHWT glove 137 from low side and how high skirt wall 339 connect two sides of 337*s*.

FIG. 18E illustrates SHWT glove 137 with high skirt wall 339U implementing vertical U/V grooves extended from sleeve exterior wall to further reduce high top skirt aperture size. Expanded window illustrates the vertical tilt angle difference between non U/V groove based skirt wall and U/V groove-based skirt wall.

FIG. 20A illustrates rectangular bar test method to identify triangular shaped finger sleeve with only convex segments on the interior wall when "tp" is located in a range from >=75% L to <=100% L.

FIG. 20B illustrates rectangular bar test method to identify triangular shaped finger sleeve with only convex segments on the interior wall when "tp" is located in a range from >=50% L to <75% L.

FIG. 20C illustrates rectangular bar test method to identify triangular shaped finger sleeve with both convex and concave segments on the interior wall. Also illustrates method of using angle ruler to identify triangular shaped sleeve.

FIG. 20D illustrates SHWT glove 230's finger sleeve 231C not identified as triangular shape using rectangular bar test.

FIG. 21A illustrates SHWT glove 125 with top skirt sliced equally (120-degree-longitudinal cut from center along UC line) into three finger sleeves with skirt attached.

FIG. 21B illustrates an SHWT glove having U/V grooves in the center conjunction area within a circular area 005. 100% sleeve height (SH) is measured at ½ PV-H level.

FIG. 21C illustrates an isometric side view of half sleeve, showing sleeve height (SH) measured from glove bottom center (GBC) to center conjunction area bottom surface, excluding the height of any extra structure such as holding ring 317 (see FIG. 21A, not illustrated in FIG. 21C). Also illustrates finger protection body 100*f*'s height 100*f*-H equals sleeve height (SH) plus center conjunction area wall thickness 505.

FIG. 21D illustrates shapes of multiple sleeve outer surface transverse cross sections orthogonal to sleeve height (SH) at different SH percentage levels (from 0% to 100%).

FIG. 21E illustrates sleeve outer surface cross section shapes with height (OH) and width (OW) orthogonal to each other, in an XY coordinate system, with height (OH) parallel to Y axis and Y axis parallel to grip radius (RC).

FIG. 22A illustrates various convex and concave arc/angular segments and clockwise and counterclockwise direction against a tangent line.

FIG. 22B illustrates tangent line test method to identify a convex loop.

FIG. 22C illustrates tangent line test method to identify a mixed loop.

FIG. 22D illustrates partial inscribed circle sweep (PICS) test method in a flat convex loop.

FIG. 23A illustrates partial inscribed circle sweep (PICS) test method in another flat convex loop.

FIG. 23B I, II, III illustrates a breakdown of a partial inscribed circle sweep (PICS) test from FIG. 23A in steps and analysis.

FIG. 23C illustrates partial inscribed circle sweep (PICS) test from FIGS. 23A & 23B identifies five simple "S" segments in the hatched area.

FIG. 23D illustrates a difference between simple and complex "S" segment and its relation to partial inscribed circle sweep (PICS) test. It illustrates examples to identify flat convex loop containing less than or equal to two simple "S" segments.

FIG. 24A illustrates a method and examples to determine mixed loop height (OH).

FIG. 24B illustrates a method to determine height (OH) in a mixed loop with U/V grooves embedded in a large concave segment.

FIG. 24C illustrates a method to determine height (OH) and width (OW) in a T shaped mixed loop.

FIG. 24D illustrates a flat convex loop with OW/OH=2:1 containing two 90 degree angle simple "S" segments at the top.

FIG. 24E illustrates a flat convex loop with OW/OH=2:1 with 90 degree angle simple "S" segment on each of the four corners and why it functions equivalent to a flat mixed loop.

FIG. 24F illustrates a 3 sleeve non rotationally symmetric SHWT glove with each finger sleeve's grip radius (RC) to neighboring sleeve's grip radius (RC) angle used for angle ruler test.

DETAILED DESCRIPTION

Figures 3, 3A, 3B, 3C:
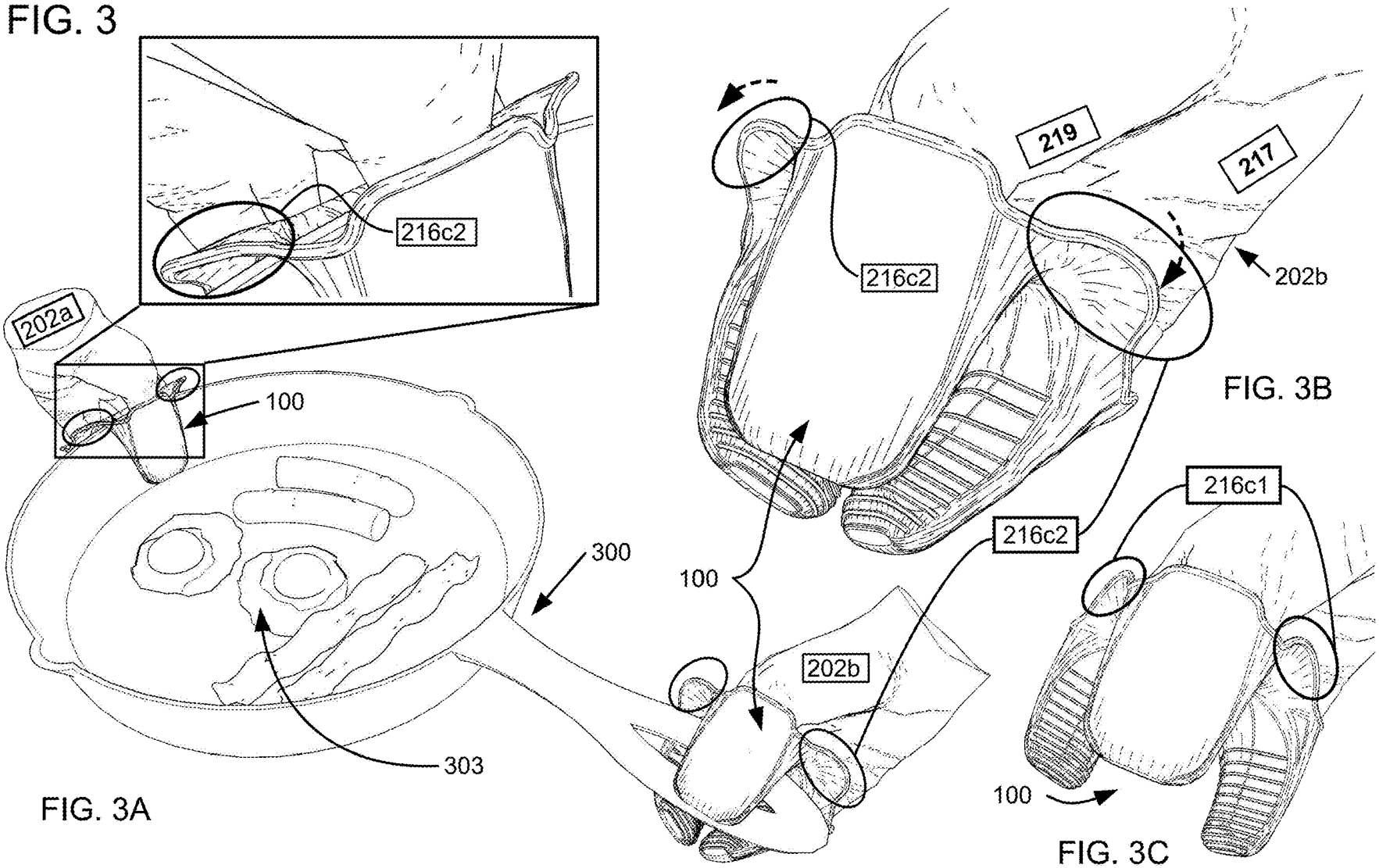
FIG. 3A illustrates an application of SHWT glove 100 holding a hot pan 300 for heat isolation with expanded view showing when SHWT glove 100 in tight grip posture with inter-arc-bridge wing 216*c*2 in flipped out status.
FIG. 3B illustrates a detailed perspective view of right hand 202*b* wearing SHWT glove 100 in grip posture expanded from FIG. 3A with all inter-arc-bridge wings 216*c*2 in flipped out status It illustrates thenar eminence 219 and hypothenar eminence 217 of a right hand.
FIG. 3C illustrates a comparative view to FIG. 3B showing SHWT glove 100 with inserted hand in relaxed open posture with inter-arc-bridge wing 216*c*1 in original stand-up position (not flipped out).

Various aspects of the disclosure are described more fully herein with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based at least in part on the teachings herein, one skilled in the art should appreciate that the scope of the disclosure is intended to cover any aspect of the disclosure disclosed herein, whether implemented independently of or combined with any other aspect of the disclosure. For example, an apparatus may be implemented, or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. Any aspect of the disclosure may be embodied by one or more elements of a claim.

Disclosed herein is a single hand wear and take off glove that may protect the hand and fingers from directly contacting undesirable objects such as those that are heated, dirty, or corrosive while preserving the nimbleness of the finger movements to effectively accomplish the task on hand. The single hand wear and take off glove is referred to below as SHWT and SHWT glove.

One problem with conventional finger gloves is that they are configured with a particular finger sleeve size combination, which if not followed, makes their use difficult or impossible. Conventional finger gloves may, for example, allow for only a single finger insertion into each finger sleeve. When a user desires to remove the conventional glove, a second hand, for example, may be required to remove it. For a conventional glove with larger finger sleeves, there may be no practical option of single finger insertion into the sleeves, or if possible, the use of such a conventional glove is compromised. One reason for these issues with conventional finger gloves is a failure to understand and apply a variety of finger sizes as well as a lack of understanding of finger movement (absolutely as well as in relation to one another), finger position, various grip geometries and attendant movement, position, configuration, and shape of a finger glove with respect to the contradictory motivations of a finger glove that is easy to put on (by inserting fingers into the finger glove), easy to take off using only the hand with the fingers in the finger glove (with a wiggling, alternating movement between fingers), while providing useful grip and protection to the fingers and hand. Conventional gloves fail to deliver on these motivations and what is needed is a single hand wear and take off glove that provides a solution to protect hand during various tasks by allowing flexibility and freedom to use different finger insertion combinations with easy on and single hand take off utility.

The following are limitations and drawbacks found in conventional finger gloves, as listed below:

1) Sleeves of a conventional finger glove are designed to accommodate a particular number of fingers, for example a finger glove with two sleeves can only insert two fingers. A finger glove with three sleeves can only insert three fingers (one finger in each sleeve) etc. Therefore, they do not provide a universal protection solution for a variety of tasks where two, three, four or five fingers are needed. This will result in needing multiple finger gloves, each with a different configuration, each of which is made to fit only one finger insertion pattern.
2) Many finger gloves have round or near round oval shaped finger sleeves, which tightly wraps around inserted fingers to avoid slipping off. This would make it difficult to put on and take off without the help of a second hand. If the round shaped sleeve is made too big, the glove will easily slip off accidentally during use.
3) Each finger sleeve of a finger glove has difficulty accommodating fingers of different sizes. If each finger sleeve is made too small, people with big fingers are not able to wear it. If each finger sleeve is made too big, it can accidentally slip off of people with small fingers.
4) Some finger gloves have a narrow bridge connecting the sleeves. A finger glove with this type of structure is not stable to stand on its own, therefore making it difficult to put on and take off without the help of a second hand. They are also difficult to stack up with one hand. They also offer little protection for the palm of the hand.
5) Some finger gloves have short finger sleeves only covering the fingertip, which leave much of the fingers exposed without protection. If the finger sleeve is made too long, it will make the glove take off difficult especially without the help of a second hand.
6) Some finger gloves (especially for those short finger glove) have a narrow bridge located far from each finger's root section. This would require more force exerted by the fingers when two neighboring fingers inside the finger glove need to open wide, therefore make it more difficult to stretch wide to grab large objects.

In one aspect, each finger sleeve of the SHWT glove may accommodate one, two or three fingers inserting together and accommodate fingers of different sizes without needing glove material elasticity. The SHWT glove may be quickly put on and taken off without the help of a second hand or some other implement to secure the finger glove.

Using human factors design methods, the SHWT glove solves many usability challenges other gloves on the market have that make them look conceptually appealing but unfit for practical use. The SHWT glove may securely hold fingers in without the glove slipping off during work, while still allowing the glove to be put on and taken off without the help of a second hand.

The SHWT glove may allow the hand to securely hold very small objects as well as large objects. The SHWT glove may allow the hand to open and close without feeling constrained. The SHWT glove may make the hand feel comfortable, closer to the feeling of a naked hand's movements while providing protection for the fingers, part or even full palm area. The SHWT glove may fit either left or right hand wear. The SHWT glove may stand on a flat surface by itself without collapsing to help with single hand wear and easy stacking for storage. The SHWT glove may also be used as a utensil rest.

The SHWT glove overcomes the limitations of a conventional finger glove with a design providing for different combinations of fingers, optionally including a thumb as one of the fingers, usable by people with different finger and hand size, donned and doffed with a single hand (for single-handed operation), improved mechanics and leverage over the previous versions. This description recites "fingers" and that may be inclusive of finger and thumb digits. For example, mention of "5 fingers" may include 4 fingers and a thumb, or "4 fingers" may include 3 fingers and a thumb, or may refer to 4 fingers exclusive of a thumb, and so on.

Human hands are of varying sizes from small to large. Reference is made to a standard medium sized human hand's dimension (size and shape) to demonstrate the design of the SHWT glove structural dimension, size and shape to fit for a standard medium sized hand. Using the described design principles, the SHWT glove can be scaled to small, medium and large sizes to fit hands of different sizes.

The SHWT glove may apply different materials and vary the material thickness at different parts of the finger glove. The material chosen and the applied thickness may change SHWT glove's elasticity, stiffness, bend ability or stretchability.

Figure 16:
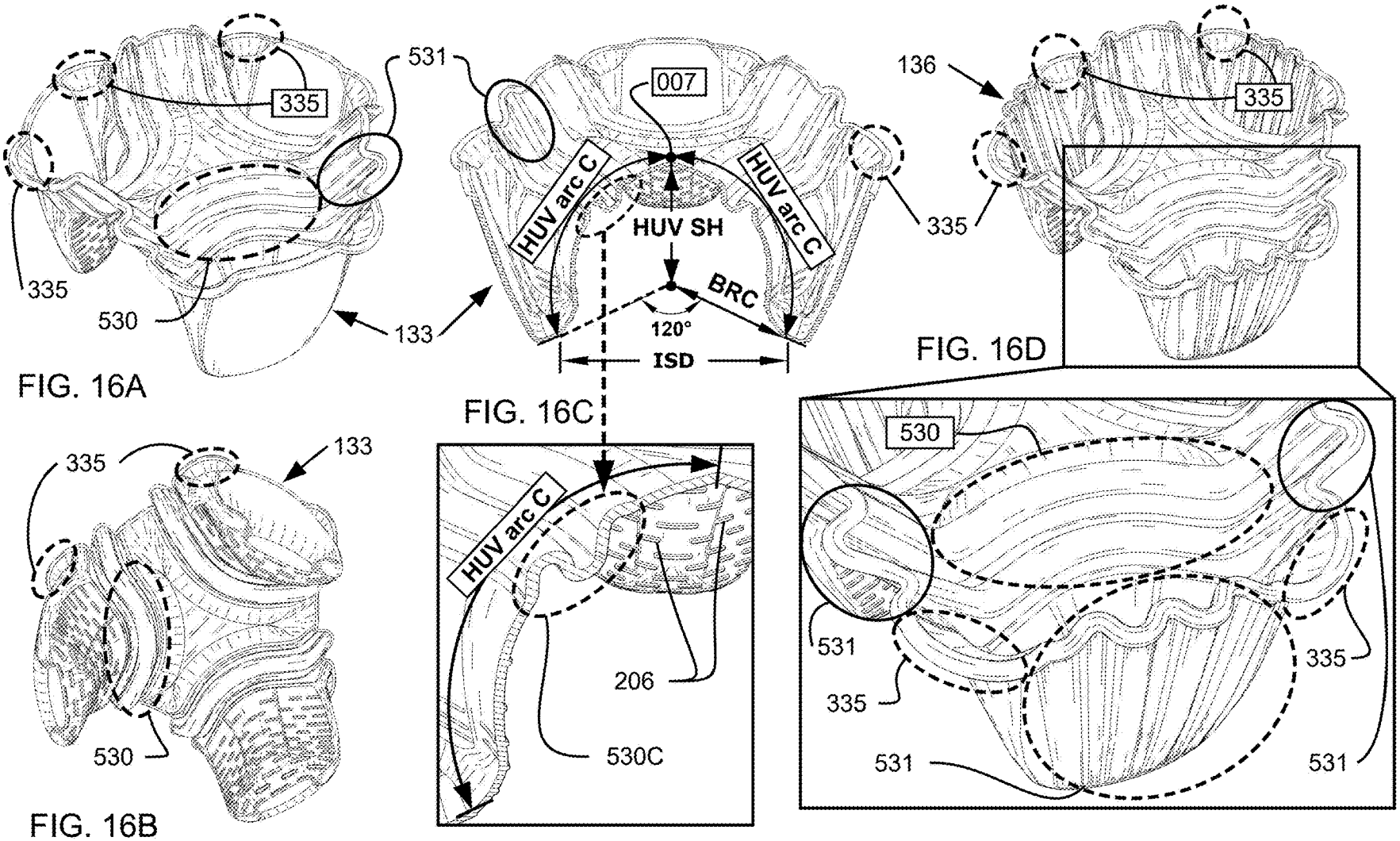
FIG. 16A illustrates a top perspective view of SHWT glove 133 with horizontal U/V grooves 530 added to the top sleeve aperture and center palm protection section running relatively orthogonal to arc B and arc C line. Horizontal U/V grooves 530 extended upward along top skirt wall to become vertical U/V grooves 531 at top skirt wall making top skirt aperture size adaptive.
FIG. 16B illustrates a bottom perspective view of SHWT glove 133 with horizontal U/V grooves 530 added to the top sleeve aperture and center palm protection section running relatively orthogonal to arc B and arc C line.
FIG. 16C illustrates a longitudinal cross-section perspective view of SHWT glove 133 along arc C plane with horizontal U/V grooves added to the top sleeve aperture and center palm protection section running relatively orthogonal to arc B and arc C line. Expanded view of horizontal U/V grooves cross-section 530C shape along arc C line. HUV arc C represents new arc C and HUV SH represents new sleeve height in the SHWT glove 133 implementing horizontal U/V grooves. Short stripped print pattern 206 shown in expanded window.
FIG. 16D illustrates a top perspective view of SHWT glove 136 with horizontal U/V grooves 530 relatively orthogonal to arc B and arc C line and vertical U/V grooves 531 shown in dashed circles on the finger sleeve. Expanded view of horizontal and vertical U/V grooves. Horizontal U/V grooves 530 upward extended along top skirt wall to become vertical U/V grooves 531 shown in solid circles at top skirt wall making top skirt aperture size adaptive.

SHWT glove material can be categorized into different types. Type I material is low or non-elastic but bendable material which has limited (or low) stretchability or not stretchable. Type I material can be hard rubber, hard silicone with low stretchability (a rough estimation may be material with shore A hardness greater than 80), or non-stretchable material such as paper or flexible bendable plastic or other similar non stretchable but bendable material. One way to make Type I material based SHWT glove stretchable is to utilize material bendable property to implement structural foldable/squeezable and expandable structure such as horizontal, vertical or zigzag U/V grooves implemented in SHWT glove in FIG. 16 and FIG. 19. Type I material, such as paper-based material, may be coated or laminated with different material for better water and oil resistance, or modify/improve the mechanical properties. Type I material, such as a paper-based SHWT glove, may be partially or fully folded to reduce storage size. Those folded SHWT gloves may be unfolded/deployed to a ready-to-wear-shape to stand on a flat surface.

Type II material is soft elastic, stretchable and bendable material. Type II material can be soft elastic rubber, silicone, a naturally occurring polymer of isoprene, and neoprene, a synthetic polymer of 2-chloro-1,3-butadiene or any stretchable organic material. Type II material typical shore A hardness may be lower than 80. Type II material typical shore A hardness may be approximately around 20 to 60 (just an illustrative and representative hardness range estimation). Under the same shore hardness, SHWT using type II material implemented with different thickness can also change SHWT glove bendability and stretchability performance. Thinner material with the same shore hardness may have better stretchability. Type II material may be coated or laminated with other material to achieve certain physical and mechanical property to improve the SHWT glove usability and performance. SHWT glove using Type II material can either use material's own stretchability or combine with structural based stretchable structure (such as U/V grooves example in FIG. 16 and FIG. 19) to achieve elasticity and stretchability.

The SHWT glove may use type I or II material and may vary in material thickness at different parts of the glove body to achieve different elasticity, bendability and flexibility performance.

In the following description, we will reference and use specific finger anatomy notations. FIG. 2A illustrates all finger joints' anatomy notation and their quotation numbers. Metacarpophalangeal (MCP) refers to all fingers' palm joint, distal interphalangeal (DIP) refers to all fingers' distal tip joint and proximal inter-phalangeal (PIP) refers to four fingers' middle joint excluding thumb. Thumb does not have PIP joint but has a unique CMC joint close to the wrist shown in FIG. 8C. To specifically differentiate each finger's joint by notation, we use the first letter of each finger's name as prefix to the finger joint's general notation. For example, we can refer to thumb's DIP joint as T-DIP and index finger's PIP joint as I-PIP. The same convention applies to all fingers' joints.

In the following description, we refer to a hand that is in a relaxed open posture such as the posture of the right hand 202*b* illustrated in FIG. 2A, 2B, FIGS. 8B & 8C. More specifically when the hand is in a relaxed open posture in FIGS. 2A, 2B, 8B & 8C, using MCP joint of thumb (T-MCP joint 271) and rest of fingers MCP joints (272, 273, 274 and 275) as angle vertex, palm and each MCP joint connected finger segment form a large blunt angle close to 180 degrees.

We refer to a hand that is in a tight grip posture when the hand is closed to grip or hold object with all finger sleeves touching together near the tip, such as right hand 202*b* gripping a small object shown in FIGS. 12B, 12C, 12D & 12E. For illustration purposes refer to FIGS. 15A, 15B, 15C & 15D for hand wearing SHWT glove in tight grip posture.

In the following description, we define finger(s) is parallel inserted into a finger sleeve as two side vertices of the inserted finger(s) are roughly on the same line as the two side vertices of the finger sleeve. FIG. 2D illustrates cross section of thumb 211C is parallel inserted into the top sleeve, cross section of index finger 212C and cross section of middle finger 213C are parallel inserted into the lower left sleeve together, and cross section of ring finger 214C and cross section of pinky finger 215C are non-parallel inserted into the lower right sleeve together.

Note in the following description any notation with number plus capital "C" means cross-section view, such as 108C or 106C.

FIG. 1A, 1B, 1C shows SHWT glove 100 has three finger sleeves 101. FIG. 1B shows each finger sleeve has an open end 102 at the top and a closed end sleeve tip at the bottom (FIG. 1C), with the open end at the top joined at the center conjunction area 103. FIG. 1B shows the center conjunction area 103 implemented as a triangular shaped area. Alternatively, the center conjunction area can be other shapes or hollowed out. The center conjunction area can also be raised in the middle to form a bulge shape for the hand to grab or pick up SHWT glove as illustrated in FIG. 21B. A holding ring 317 shown in FIG. 21A may be added to the center conjunction area to hang SHWT glove on a utility hook.

SHWT glove may be structurally self-standing on a flat surface. FIG. 2A shows one aspect of SHWT glove 100 that self stands on a flat surface such that each sleeve's tip touches the flat surface with the open end 102 facing upward, ready for finger insertion. One such flat surface may be a kitchen countertop in a household. The tips 99*a*, 99*b* and 99*c* (collectively referred to as tips 99) of all finger sleeves in a SHWT glove form a sitting plane. In one aspect, a "sitting plane" is a virtual plane formed by the tips 99 of the finger sleeves of a SHWT glove. In one aspect, a "sitting plane" is a virtual plane formed by the finger sleeves at 0% of sleeve height (SH) (details found below) of a SHWT glove. The sitting plane may be similar to the plane formed by a table, for example, when the tips 99 of the finger sleeves contact the table, for example if a SHWT glove is on a table with the tips 99 of the finger sleeves in contact with the table and positioned for finger insertion from above. The sitting plane is defined in order to better explain various geometries of the SHWT glove.

Throughout this description, transverse cross section of a SHWT glove and transverse cross section of a finger sleeve is defined as 2D cross-section parallel to the sitting plane or the flat surface on which the SHWT glove could be standing.

FIG. 1D longitudinal cross section perspective view illustrates SHWT glove's sleeve has interior wall 109C and exterior wall 104C, the interior wall 109C being closer to the center conjunction area 103 than the exterior wall 104C along each sleeve transverse cross section. In one aspect, finger sleeve side segments (such as the left and right segments shown in FIGS. 10A & 10B centered by side vertex 100S), whether they are side arc or other structure, may be used as a reference to separate interior and exterior wall. In one aspect, the sleeve interior wall may be considered as the sleeve walls facing or touching a gripping object or the sleeve walls facing one another or touching together when a user's hand wearing SHWT glove is in tight grip posture. Each finger sleeve has an inner surface, the surface inside the sleeve, and an outer surface, the surface outside the sleeve.

FIGS. 1A, 1C, 8A, 9A, 9E, 13D, 15E illustrate the SHWT glove having a glove bottom center (GBC) on the sitting plane. As illustrated in FIGS. 1C & 13D, in a three-sleeve based SHWT, glove bottom center (GBC) is the center of a contact circle 002 that creates at least one contact point 003 with each finger sleeve's interior wall at the tip. When the finger sleeve contacting the contact circle is one arc or angle as shown in FIG. 13D, the contact circle creates exactly one contact point with the finger sleeve. In some cases, a finger sleeve can create multiple contact points with the contact circle, for example when the finger sleeve has multiple arcs with the peak of each arc contacting the contact circle. The contact circle is exterior to a finger sleeve, such that in one aspect, multiple contact points between a contact circle and the outer surface of a finger sleeve may exist without the contact circle intruding upon the inner surface of the finger sleeve. In one aspect, a contact circle with only a single contact point with a finger sleeve will also remain exterior to that finger sleeve without the contact circle intruding upon the inner surface of the finger sleeve. In one aspect, the tips of the finger sleeves may be configured to contact the contact circle.

In a four sleeve based SHWT glove, the interior wall of any three finger sleeves out of the four finger sleeves at the tip may create a contact circle, therefore there are a total of four contact circles in a four sleeve based SHWT glove, each belongs to a different set of three sleeves. In one aspect with multiple contact circles, the glove bottom center (GBC) in a four sleeve based SHWT glove is the center of the smallest contact circle. In one aspect, a four sleeve based SHWT glove may have the four contact circles perfectly overlap. In this case the center of the four (overlapped) contact circles is the glove bottom center (GBC) of the four sleeve based SHWT glove. In one aspect, if two or more contact circles perfectly overlap, with the remainder being larger, then the center of the two perfectly overlapping contact circles is the glove bottom center (GBC). In one aspect, with overlapping contact circles, when there is no smallest contact circle because all the contact circles are the same size, the glove bottom center (GBC) is the center of any of the overlapping contact circles.

In one aspect, the tips of four finger sleeves may be configured to contact a plurality of contact circles. For example, labelling the finger sleeves as first finger sleeve, second finger sleeve, third finger sleeve and fourth finger sleeve, the following contact circles may be contacted. The first, second and third finger sleeves may be configured to contact the first contact circle. The second, third and fourth finger sleeves may be configured to contact the second contact circle. The first, third and fourth finger sleeves may be configured to contact the third contact circle. The first, second and fourth finger sleeves may be configured to contact the fourth contact circle.

SHWT glove has a vertical axis that is orthogonal to the sitting plane, which in one aspect may be a flat standing surface. FIGS. 1A, 8A, 9A & 15E show a vertical line along SHWT glove's vertical axis from the center conjunction area to the sitting plane passing the glove bottom center (GBC). This vertical line will be referred to as center SH line. The intersection point of each SHWT glove's transverse cross section plane with the center SH line will be referred to as the glove center (GC) of the transverse cross section. FIG. 13C illustrates the glove center (GC) of a three finger sleeve based SHWT glove's transverse cross section. The glove bottom center (GBC) in FIG. 13D is at the glove center (GC) on the sitting plane.

A SHWT glove may be rotationally symmetric around center SH line. FIGS. 1B & 1C show in perspective view SHWT glove 100 is rotationally symmetric with three identical finger sleeves 101 (101 shown in FIGS. 1A & 1C). FIGS. 13A & 13B shows SHWT glove 250 is rotationally symmetric with four identical finger sleeves. Note in a rotationally symmetric four sleeve based SHWT glove, the four contact circles created by any three finger sleeves' interior wall at the tip completely overlap as if they were a single contact circle. The center of the overlapping contact circles is the glove bottom center (GBC) for the rotationally symmetric four sleeve based SHWT glove.

A rotationally symmetric SHWT glove may have benefits compared to conventional gloves. The benefits include but are not limited to universal fit for any inserted fingers or finger combinations, and a SHWT glove that is stackable with an identical SHWT glove, where any finger sleeve may nest within a finger sleeve of the SHWT glove onto which it is stacked. In one aspect, SHWT glove may not be rotationally symmetric. One example of a non-rotationally symmetric SHWT glove may be finger sleeves having different shapes from one another. Other examples of non-rotationally symmetric SHWT gloves include print pattern on each finger sleeve may be different or a holding hole for hanging convenience may be added to a location at the SHWT glove top edge below top edge rim 107 (Refer FIGS. 1A & 1B).

SHWT glove's finger sleeve has a sleeve height (SH) along SHWT glove's vertical axis. FIG. 21A illustrates a rotationally symmetric SHWT glove 125 sliced equally (120-degree vertical cut from center along UC line) into three separate finger sleeves. UC line will be discussed later. FIG. 21C is a longitudinal cross section isometric side view of a single finger sleeve sliced from FIG. 21A further cut in half to illustrate sleeve height (SH), which is the distance along the vertical axis from finger sleeve tip outer surface on the sitting plane to the center conjunction area bottom surface. Sleeve height (SH) is not a direct distance measurement from center conjunction area to sleeve tip. Sleeve height (SH) measuring point at center conjunction area is located at the intersection of center SH line (vertical line from glove bottom center (GBC)) and the center conjunction area bottom surface when the center conjunction area is a generally flat or convex spherical (dome) structure. See below on how to determine sleeve height (SH) measuring point at center conjunction area when the center conjunction area has concave spherical (reverse dome) structure or U/V grooves. As illustrated in FIGS. 21C, and 21D, a finger sleeve may be measured along a vertical scale as a percentage of the sleeve height (SH) from the outer surface of the sleeve tip at the bottom, up to the bottom surface of the center conjunction area, with 0% of the sleeve height (SH) at the sleeve tip outer surface or the sitting plane to 100% of the sleeve height (SH) at the center conjunction area bottom surface. When the center conjunction area contains convex spherical (dome) structure with its highest point located in the center on the center SH line, the center conjunction area may be considered as a point.

FIG. 13C illustrates finger sleeves in a SHWT glove with grip radius (RC) on the SHWT glove transverse cross section plane. Each finger sleeve's grip radius (RC) starts at the glove center (GC) and bisects a clamp angle β. Clamp angle β has its angle vertex located at the glove center (GC) and each side of the clamp angle β clamps to one side of the finger sleeve with at least one contact point.

FIG. 13D illustrates bottom grip radius (BRC) s in a three sleeve based SHWT's transverse cross section plane at 0% of the sleeve height (SH). Each finger sleeve's bottom grip radius (BRC) starts at the glove bottom center (GBC) and bisects a clamp angle β. Clamp angle β has its angle vertex located at the glove bottom center (GBC) and each side of the clamp angle β clamps to one side of the finger sleeve with at least one contact point. FIG. 13D shows one side of the finger sleeve contacts clamp angle β with an arc and the other side contacts clamp angle β with an angle. When a finger sleeve's side is a straight line that overlaps with the side of angle β, they create more than one contact points. Bottom grip radius (BRC) is the grip radius (RC) at 0% of the sleeve height (SH).

A finger sleeve's transverse cross section has a width (OW) and a height (OH), such as those illustrated in FIGS. 10B, 10C, 11C 13C, 13D, 21E & 23C. As illustrated in FIGS. 21E and 23C, placing a finger sleeve's transverse cross section in an XY coordinate system where y axis is parallel to the finger sleeve's grip radius (RC), the height (OH) is parallel to the grip radius (RC) and is the distance on the Y axis between the highest and lowest point on the finger sleeve. The width (OW) is orthogonal to the height (OH) and is the distance on the X axis between the leftmost and rightmost point on the finger sleeve. Note: each finger sleeve's transverse cross section has its own XY coordinate system where the Y axis is always parallel to the finger sleeve's grip radius (RC). When measuring finger sleeve transverse cross section width (OW) and height (OH), finger sleeve outer surface is used, excluding any extra structure on the outer surface, for example print pattern 206 in FIG. 2A.

Referring to FIG. 13D, the height (OH) of a finger sleeve has two OH end level lines 008 that are perpendicular to the finger sleeve's bottom grip radius (BRC) and are determined as follows. One OH end level line 008 contacts the finger sleeve interior wall with at least one contact point and the other OH end level line 008 contacts the finger sleeve exterior wall with at least one contact point. When a segment of the finger sleeve wall overlaps with an OH end level line, it creates more than one contact points with the OH end level line. The length of bottom grip radius (BRC) at 0% of sleeve height (SH) is measured from the glove bottom center (GBC) to the OH end level line 008 contacting the finger sleeve interior wall. The bottom grip radius (BRC) is measured from the glove bottom center (GBC), also illustrated in FIG. 9A.

As illustrated in FIG. 13C, grip radius (RC) above 0% of the sleeve height (SH) are measured from the glove center (GC) of the respective transverse cross section. For example, grip radius (RC) of SHWT transverse cross section plane at 50% of the sleeve height (SH) is measured from the glove center (GC) at 50% of the sleeve height (SH). Grip radius (RC) of a finger sleeve may vary at different % of the sleeve height (SH). In a SHWT glove, when grip radius (RC) s of the finger sleeves on the same transverse cross section plane are different from one another, the SHWT glove is non-rotationally symmetric. Grip radius (RC) and bottom grip radius (BRC) in a four sleeve based SHWT glove are defined using the same method.

Using bottom grip radius (BRC) as a reference, we can determine sleeve height (SH) measuring point at center conjunction area along the center SH line when the center conjunction area has concave spherical (reverse dome) structure or U/V grooves.

FIG. 21B illustrates a case of U/V grooves added to the center conjunction area. Sleeve height (SH) at the center conjunction area should end at ½ PV-H level, the half distance between the center peak point "P" bottom surface and its neighboring valley point "V" bottom surface on the U/V grooves within a circular area (005) centered on center SH line with a radius of 25% of the bottom grip radius (BRC). As a conclusion, when the center conjunction area within a circular area centered on center SH line with a radius of 25% of bottom grip radius (BRC) is neither flat nor convex spherical (dome) structure, but either a concave spherical (reverse dome) structure or U/V grooves, the sleeve height (SH) at the center conjunction area is measured up to the ½ height between the highest and the lowest point bottom surface (such as ½ PV-H in FIG. 21B) within the circular area.

When measuring sleeve height (SH), extra structure added to the center conjunction area 103 either above or below 103, for example a holding ring 317 in FIG. 21A, is not accounted for in the measurement of sleeve height (SH).

FIG. 10A, 10B, 10C, 10D, 10E show SHWT glove 100, 230, 150, 130, 170 with all their finger sleeve transverse cross sections being line symmetric along grip radius (RC). In one aspect, SHWT glove finger sleeve's transverse cross section may not be line symmetric. FIG. 13D illustrates transverse cross sections of finger sleeves that are not line symmetric while the three finger sleeves are rotationally symmetric around center SH line. A rotationally symmetric SHWT glove with each finger sleeve being line symmetric will have benefits including but not limited to universal fit for either left or right hand, universal fit for any finger or combination of fingers inserted in a single sleeve and stackable SHWT glove bodies.

Referring FIG. 13C, SHWT glove transverse cross section plane has UC lines, each UC line starts at the glove center (GC) and bisect the angle between two neighboring grip radius (RC) s. In a rotationally symmetric SHWT glove with three sleeves such as SHWT glove 100 shown in FIG. 13C, there are three grip radius (RC) s on each transverse cross section and they are 120 degrees apart from each other. UC line is 60 degrees apart from its neighboring grip radius (RC), half of the angle between two neighboring grip radius (RC) s. FIG. 13D illustrates a rotationally symmetric SHWT glove with three UC lines at 0% of the sleeve height (SH) and their relative positions to bottom grip radius (BRC).

Each finger sleeve's longitudinal axis running from top to bottom of the finger sleeve may not be orthogonal to the sitting plane or flat standing surface. One design can have the finger sleeve's longitudinal axis tilted at a non-orthogonal angle, but an orthogonal or close to orthogonal sleeve longitudinal axis may help SHWT glove to achieve various purposes such as easy for direct finger insertion for self-wearing and making the SHWT glove stackable.

In one aspect, a SHWT glove may be configured to accommodate a single finger in each finger sleeve, with sufficient friction between the finger sleeves and a user's fingers such that the user may insert their fingers into the SHWT glove and the SHWT glove may remain on the user's fingers due to the friction from the finger sleeves. In one aspect, the SHWT glove that is configured to accommodate a single finger in each finger sleeve is also configured to accommodate multiple fingers in a single finger sleeve with accompanying friction to keep the SHWT glove on the user's fingers, while still allowing user to easily take off the SHWT glove without the help of a second hand.

FIGS. 2A, 2B, 2C & 2D illustrate both 3D and 2D view of a way to wear the SHWT glove 100 is to parallel insert index and middle fingers into the first sleeve, non-parallel insert ring and pinky fingers into the second sleeve and parallel insert the thumb into the last sleeve. Another way to wear the SHWT glove 100 is to insert thumb and index finger into one finger sleeve each, and insert middle, ring and pinky fingers together into the remaining finger sleeve. Note the pinky finger may not fully insert into sleeve body as it is shorter than ring and middle fingers. The pinky finger can also be retracted outside of the finger sleeve during work and can push against the edge of glove body after work to help take off the glove without the help of a second hand.

FIGS. 13A & 13B shows an alternative design with SHWT glove 250 that may comprise four identical finger sleeves. With four finger sleeves, three fingers can be inserted into one finger sleeve each and the remaining two fingers can be inserted into the last finger sleeve. For example, thumb, index and middle finger can each occupy one finger sleeve and ring and pinky fingers can occupy the last finger sleeve together.

Figures 5, 5A, 5B, 5C, 5D:
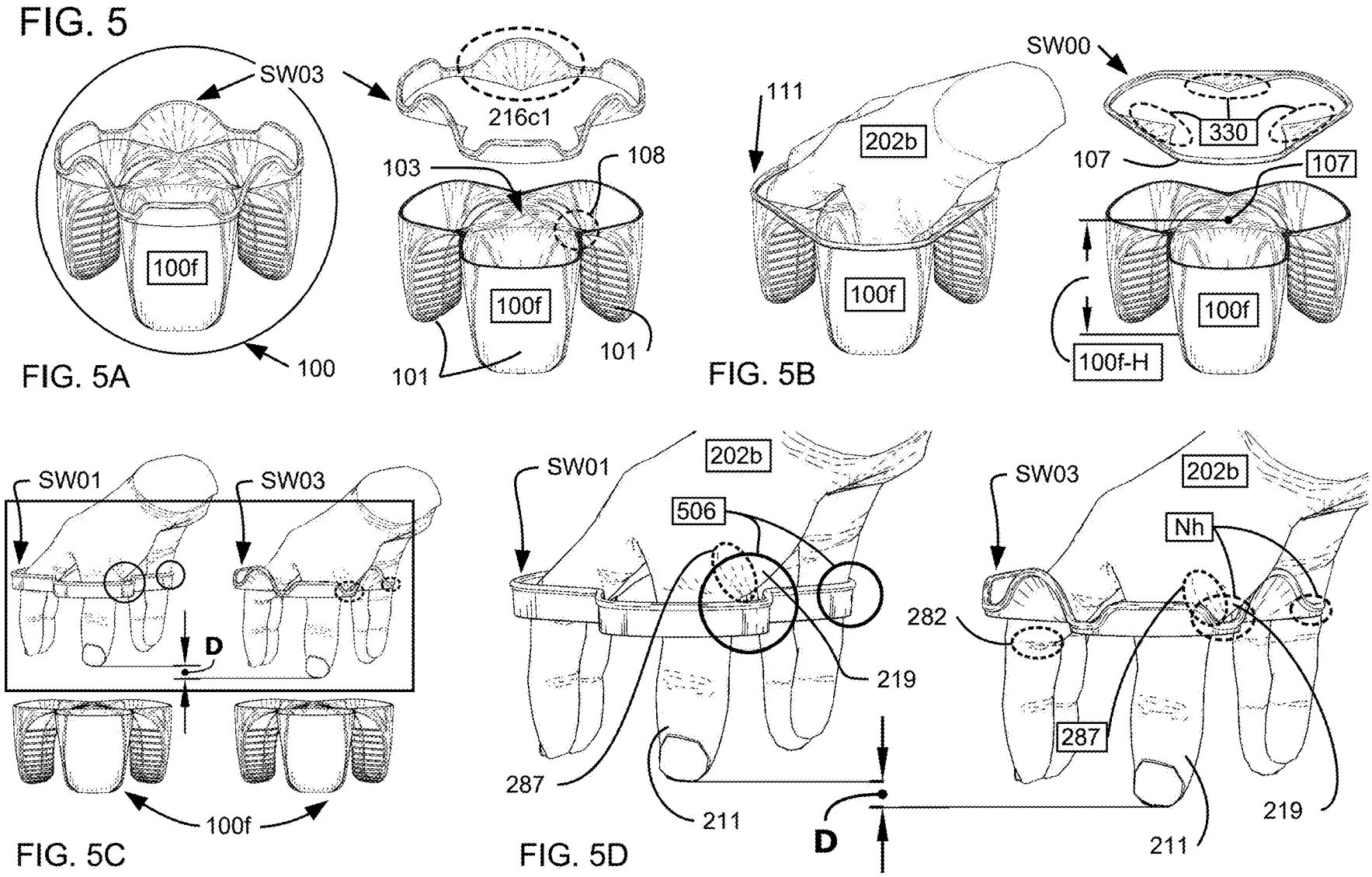
FIG. 5A illustrates an isometric view of SHWT glove 100 divided in two parts: finger protection body 100*f* and top skirt SW03 with inter-arc-bridge wing 216*c*1 and notch.
FIG. 5B illustrates an isometric view of SHWT glove 111 with no upwardly extended skirt or zero skirt SW00. It illustrates finger protection body 100*f* with its height 100*f*-H and top flat sleeve connection 330 with top edge rim 107.
FIG. 5C illustrates an isometric view comparing two SHWT glove top skirts: SW01 and SW03. It illustrates thumb and pinky finger root section touching the top edge of top skirt SW01, while top skirt SW03 with notch allowing finger to be inserted an extra distance D compared to top skirt SW01.
FIG. 5D illustrates a detailed view expanded from FIG. 5C comparing two top skirts SW01 and SW03. It illustrates thumb and pinky finger root section touching the top edge of SW01 at location 506. SW03 adding notch Nh allowing finger to be fully inserted by extra distance D compared to SW01.

SHWT glove 100 has a palm protection section formed by three arc bridge sections 108 (shown in FIG. 1B), center conjunction area 103 (shown in FIG. 1B) and a top skirt such as SW03 in FIG. 5A with three inter-arc-bridge wings 216*c*1. For top skirt that includes inter-arc-bridge wings 216*c*1, horizontal part of 216*c*1 is also part of arc bridge section 108. The three arc bridge sections 108 with its connected inter-arc-bridge wing 216*c*1's horizontal section and the center conjunction area 103 protect the center palm area and inner finger root sections, while the top skirt SW03 in FIG. 5A with inter-arc-bridge wings' upward extended edge further protects the palm edge area and the inter finger root sections. FIG. 5D's SW03 diagram illustrates those extra areas of the fully inserted hand in SHWT glove are protected by the top skirt.

FIGS. 1B and 1D show the arc bridge section 108 (and 108C) connects two neighboring finger sleeves and extends from the top of the finger sleeves as one integral piece. The integral design together with the top skirt SW03 provides increased protection for the palm.

The high top skirt SW07 (FIG. 17A) and SW08 (FIG. 19A) further extend palm protection up to wrist level.

To better describe the top skirt, we divide the SHWT glove 100 into a lower part and a top part illustrated in FIGS. 5 & 6. In one aspect and as illustrated in FIGS. 5 & 6, the top skirt encircles the finger sleeves, for example finger sleeves 101 in a three sleeve based SHWT glove, or the finger sleeves in a four sleeve based SHWT glove (not illustrated in FIGS. 5 & 6).

FIG. 5A illustrates in SHWT glove 100, the lower part is a finger protection body 100*f* comprising three finger sleeves 101 and part of the arc bridge sections 108 joined at the center conjunction area 103. As illustrated in FIGS. 5B & 21C, the finger protection body 100*f*'s height 100*f*-H equals to sleeve height (SH) plus the center conjunction area wall thickness 505. The top part is an upwardly extended top skirt SW03.

It should be noted that SHWT glove without an upwardly extended top skirt can still provide some finger protection and application functions, but it does not provide as much protection for the palm and SHWT body structural stiffness enhancement. FIG. 5B illustrates SHWT glove 111 without upwardly extended top skirt. For better illustration, the right side of FIG. 5B shows SHWT glove 111 can be split into a lower part finger protection body 100*f* and an upper part SW00. SW00 is a non (or zero) upwardly extended top skirt, as it has no upward extended skirt wall above the finger protection body 100*f*. In SW00, top edge rim 107 and the top flat sleeve connection 330 which extends arc bridge section 108 horizontally provide partial palm protection above finger protection body 100*f*. They also provide limited structural reinforcement to increase the stiffness of SHWT glove 111.

One function of an upwardly extended top skirt is to provide extra protection at palm edge and inter finger root section which is illustrated in FIG. 5D's SW03 and FIG. 6A's SW02 and SW05.

One function of an upwardly extended top skirt is to offer further structural connection reinforcement towards the lower sleeve bodies and increase the stiffness of SHWT glove body. This reinforcement may help SHWT glove self stand on a flat surface and prevent glove from collapsing during one-handed finger insertion process as illustrated in FIGS. 2A & 2B. This reinforcement may help finger(s) to easily reinsert into a finger sleeve after the finger(s) temporarily go outside of one sleeve with other sleeves still inserted with fingers (or SHWT glove is partially worn with two sleeves). For example, in SHWT glove 100 illustrated in FIGS. 2D and 2C, in case when both ring finger 214 and pinky finger 215 move outside its finger sleeve with rest of the fingers still inserted in the other two sleeves, due to increased palm protection section stiffness provided by the top skirt, the empty sleeve may still closely keep its relatively original position without top sleeve aperture falling down. This may allow the extracted fingers to reinsert into the sleeve easily. This may also help avoid still inserted finger(s) from slipping out of sleeve, especially for sleeves with only one finger inserted therein.

One implementation of an upwardly extended top skirt such as SW01 shown in FIGS. 5C & 6A can be described as an upward extension from the top of the sleeve exterior wall above finger protection body 100*f*. FIGS. 6A & 6B illustrates SHWT glove 121 with SW01 as its top skirt.

However due to the human hand anatomy, when fingers are trying to fully insert into SHWT glove 121 (in FIG. 6B) at one or more particular sleeve heights (SH) (sleeve height (SH) is discussed below in greater detail) as illustrated in FIGS. 5C & 5D, the abrupt bump of thenar eminence 219 at thumb root section near thumb MCP crease 287 will push and then deform/bend the upward top edge wall of SW01 outward at location 506 in FIG. 5D. When a fully inserted hand in SHWT glove 121 (in FIG. 6B) is performing tight grip action, the abrupt outward tilted surface of thenar eminence 219's bump at thumb root section further pushes the corresponding SW01 top edge downward at location 506 in FIG. 5D. This may cause thumb to shift and slip inside the sleeve.

When a hand wearing SHWT glove 121 (in FIG. 6B) with selected sleeve height (SH) repeatedly opens and closes, bump from thenar eminence 219 (refer FIGS. 3B & 7A) may cumulatively push and shift SW01 top edge lower and shift thumb up from its fully inserted position by distance D shown in FIG. 5D. The maximum shift distance D occurs when SW01's upward top edge finally reaches the level close to thumb MCP crease 287 and no longer touches the abruptly bumped thenar eminence 219.

Since the thumb usually occupies one finger sleeve by itself in practical use, if the hand is repeatedly performing tight gripping action, the push effect described above may cause thumb tip to shift up and away from the sleeve tip and never reach the sleeve tip. This may impact the SHWT glove gripping performance.

SW01 top edge wall being pushed by abrupt bump from thenar eminence 219 during hand grip action may be caused by its top edge wall shape not matching thenar eminence 219's side bump shape therefore obstructing hand movement.

The improved top skirt SW02, SW03 and SW05 described below all have skirt wall shape matching thenar eminence 219 bump shape, therefore avoiding the thumb shift and slip issue.

To avoid the push effect from thenar eminence 219's bump during hand gripping action, a top skirt such as SW02 illustrated in FIGS. 6A and 7C may be implemented by making the skirt wall in SW01 recline outward to follow thenar eminence 219's bump shape all around the skirt transverse circumference.

SHWT glove 122 in FIG. 6B implements top skirt SW02 in FIG. 6A with outward reclined wall to make room for the bump from thenar eminence 219 at thumb root section around location 506 shown in FIG. 5D. This allows thumb to more fully insert into sleeve tip by distance D without bending or distorting skirt top edge and avoid hand griping action causing thumb tip slip up.

However, the outward reclined top skirt design may create a large skirt top aperture causing rest of the skirt area (excluding those around the thumb and pinky root section) providing less fitted protection for other fingers inserted in other sleeves.

Another top skirt such as SW03 shown in FIGS. 5A & 5D may be implemented by adding inter-arc-bridge wings 216*c*1 (shown in FIG. 5A) and notch Nh (shown in FIG. 5D) below thenar eminence 219's bump to SW01's design.

Top skirt SW03 rotational symmetrically embeds three inter-arc-bridge wings 216*c*1 shown in FIGS. 1A, 1D, 3C and 5A. Each inter-arc-bridge wing starts from part of the arc bridge section 108 top relatively flat then transitioning into upwardly erected wall beginning at skirt transverse edge and becomes part of the skirt wall. It may be higher than the rest of the skirt wall.

Figures 4, 4A, 4B, 4C:
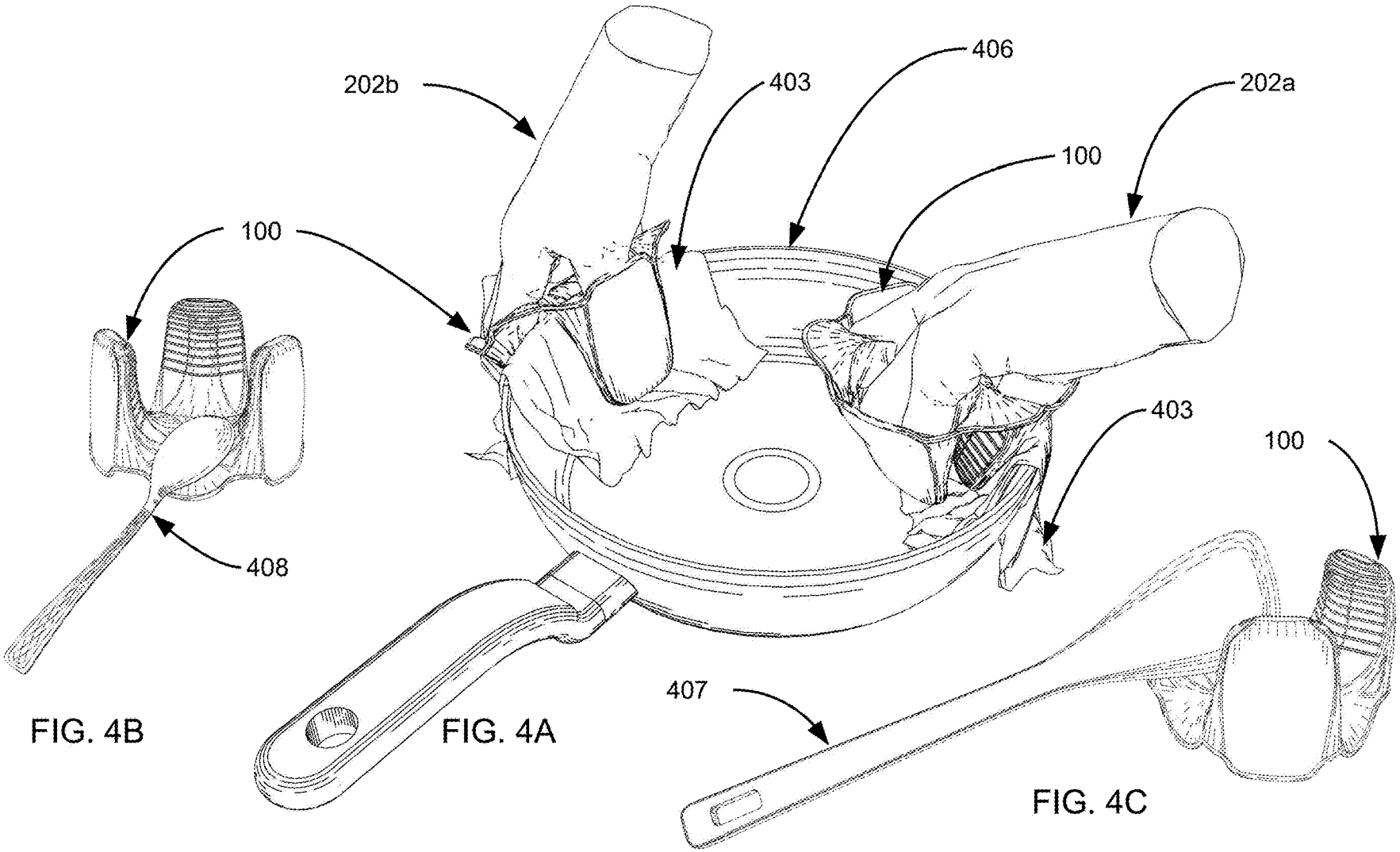
FIG. 4A illustrates an application of SHWT glove 100 for heat isolation when cleaning a hot pan.
FIG. 4B illustrates an application of SHWT glove 100 as a spoon holder.
FIG. 4C illustrates an application of SHWT glove 100 as a spatula holder.

For one SHWT glove 100 wear combination illustrated in FIGS. 2A, 2B, 2C & 2D, where thumb is inserted into one sleeve, index and middle fingers are inserted into one sleeve and ring and pinky fingers are inserted into the last sleeve, FIGS. 2A 2B, 2C and 2D show the three inter-arc-bridge wings 216*c*1 are roughly located at inter finger root section of middle and ring finger, inter finger root section of thumb and index finger and between hypothenar eminence 217 & thenar eminence 219 area (refer FIGS. 3B & 3C). The slope of the inter-arc-bridge wing 216*c*1 transitioning from horizontal arc bridge section to upwardly erected skirt wall may approximate the slope of the above mentioned inter finger root sections and hypothenar & thenar eminence area, considering the deformed shape of these areas in tight grip posture. SHWT glove inter-arc-bridge wings' shapes when a user's hand is in grip posture are illustrated in FIGS. 3A, 3B & 4A for sections between hypothenar eminence 217 & thenar eminence 219 and inter finger root section of thumb and index finger and FIGS. 4A & 15B for inter finger root section of middle and ring finger. SW03's design may allow a better fit of the SHWT glove for either left or right hand and better protects the above-mentioned hand sections while reducing finger sleeve slip and shifting issue.

Parts of inter-arc-bridge wing 216*c*1, for example its upwardly extended section, may add reinforcement to the arc bridge sections 108 to increase stiffness of the palm protection section and create extra stiffness between two neighboring sleeve body connection sections. The increased palm protection section stiffness may further help prevent SHWT glove 100 from collapsing on a flat surface during finger insertion (refer FIG. 2A).

Added stiffness from inter-arc-bridge wing 216*c*1 in SW03 may allow temporarily extracted finger(s) to insert back into an empty sleeve easily while the rest of the fingers still hold other two sleeves and keep the empty sleeve close to its original position.

In addition, the inter-arc-bridge wing 216*c*1 has a flip-able design. FIG. 3C illustrates that when hand wearing SHWT glove in a relaxed open posture, the inter-arc-bridge wing 216*c*1 is upwardly erected at the top skirt transverse edge.

Compared to FIG. 3C's relaxed open posture, FIGS. 3A & 3B show inter-arc-bridge wing 216*c*2 which is the inter-arc-bridge wing in flipped out state when the hand wearing SHWT glove is in grip posture. When the hand is closed to grip objects, if a large sized inter-arc-bridge wing 216*c*1 is not flip-able, the top edge of inter-arc-bridge wing 216*c*1 may move up and push against the palm area close to and between the thenar eminence 219 and hypothenar eminence 217 (refer to FIG. 3B).

FIG. 3B illustrates the inter-arc-bridge wing 216*c*1 gradually flips out to inter-arc-bridge wing 216*c*2 in the arrowed circles. A structurally flip-able inter-arc-bridge wing (due to its horizontal section directly integrated with arc bridge section) may smooth the gripping action of a hand wearing SHWT glove and may extend the protection area for the palm area towards the wrist when the inter-arc-bridge wings are flipped out.

Top skirt SW03 further adds notch Nh (shown in FIGS. 5D and 6A) at the two sides of each inter-arc-bridge wing 216*c*1. They may be line symmetric along SHWT glove transverse cross section UC line (refer to FIG. 13C for UC line). The two added notches Nh (shown in FIGS. 5D and 6A) located below the thenar eminence 219's bump help either left or right thumb fully insert into sleeve tip in a finger sleeve with selected sleeve height (SH). This may prevent thenar eminence bump from touching the skirt top edge and prevent thumb retraction during hand gripping action. The notch in SW03 serves the same purpose as the outward reclined skirt wall design in SW02 but leaves the thenar eminence 219 bump outside of the top skirt.

Illustrated in FIGS. 5C &5D is the comparison between SW01 without notch Nh and SW03 with notch Nh. SW03 allows the thumb to go deeper towards the sleeve tip in a SHWT glove with selected sleeve height (SH) during tight grip action and helps prevent thumb from being pushed out by distance D compared to SW01.

Inter-arc-bridge wing 216*c*1 and two notches Nh on the sides are part of an integrated design for the top skirt SW03. This design may increase usability with respect to an issue of bump from thenar eminence 219 at thumb root section blocking/distorting skirt top edge at location 506 shown in FIG. 5D. This design may also help inter-arc-bridge wing flip down, as illustrated with inter-arc-bridge wing 216*c*2 in FIGS. 3A and 3B.

FIGS. 6A, 7A, 7B and 7C shows another top skirt SW05 having notch wings 335. FIG. 7B in perspective view illustrates notch wings 335 in SW05 are implemented by extending the notches Nh in SW03 outward to further follow the shape of the thenar eminence bump at thumb root section.

FIG. 6B shows SHWT glove 100's top skirt SW03 contains notches Nh and SHWT glove 125's top skirt SW05 contains notch wings 335.

FIG. 7A illustrates that notch wing 335 and inter-arc-bridge wing 216*c*1 with their conjunction area (shown in dashed circle) form an integrated part to mimic and match the thumb root section shape which includes thumb MCP crease 287 (in FIG. 5D) and the thenar eminence bump.

FIG. 7A expanded window shows that the conjunction area in dashed circle mimics and matches the thumb root section shape while the middle section of inter-arc-bridge wing 216*c*1 keeps headroom with the hand palm when the inserted hand is in relaxed open posture.

Figures 8, 8A, 8B, 8C, 8D, 8E:
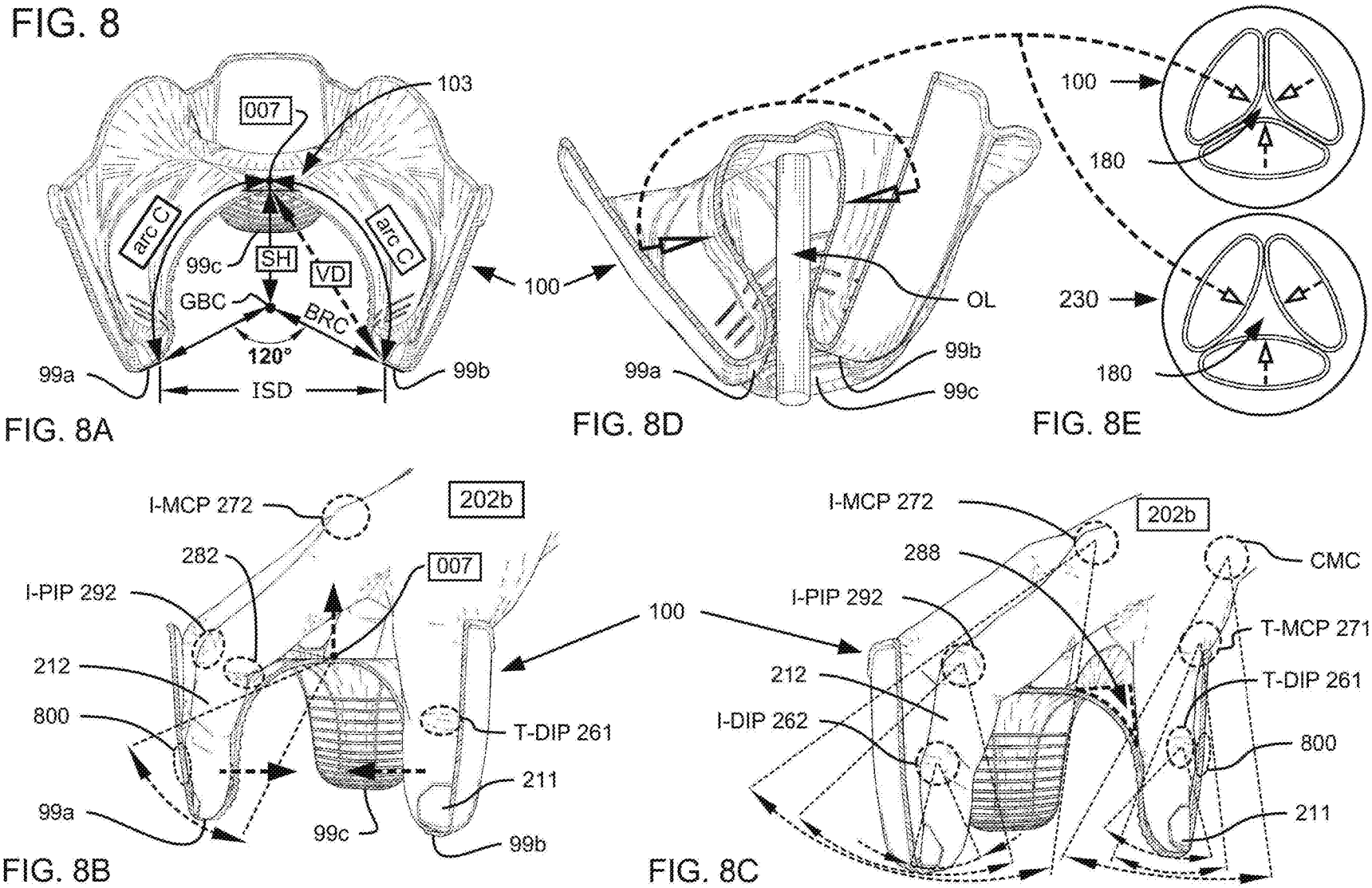
FIG. 8A illustrates an upper side perspective view of SHWT glove 100 with longitudinal cross-section cutting plane along arc C plane, dome top center 007, sleeve height (SH), bottom grip radius (BRC), VD and bottom inter sleeve distance (ISD).
FIG. 8B illustrates a longitudinal cross-section view of SHWT glove 100 along arc C plane, with right hand 202*b* fully inserted in relaxed open posture. It illustrates how a finger sleeve's longitudinal cross section shape matches that of thumb and index finger especially at bottom sleeve section and top sleeve aperture.
FIG. 8C illustrates a longitudinal cross section view of SHWT glove 100 along arc C plane, with right hand 202*b* fully inserted in relaxed open posture. It illustrates relative position of thumb and index finger joints and their pivot movement range. It illustrates gap space 288 created by relative vertically inserted thumb to sleeve.
FIG. 8D illustrates a longitudinal cross-section view of SHWT glove 100 along arc C plane, showing SHWT glove 100 gripping an object with finger sleeve deformation. Two arrows illustrate an extra clamp (squeeze) force in the middle of the finger sleeve is needed to grab a small stick-like object OL.
FIG. 8E illustrates a transverse cross section view of SHWT glove 100's and SHWT glove 230's finger sleeves at T-DIP joint level with different shape design and leaving different sized center gap 180 when squeezed together.

When hand wearing SHWT glove is in tight grip posture, inter-arc-bridge wing 216*c*1 may flip down and its inner horizontal section may shift up toward palm as illustrated by the upward arrow located at dome top center 007 in FIG. 8B. Its connected notch wing 335 may partially flip out and lightly wrap the thenar eminence bump to avoid pushing and shifting the thumb root section. The integrated design of notch wing and inter-arc-bridge wing may match the dynamic shape of thenar eminence and its bump in tight grip posture (refer FIG. 15A thenar eminence 219 when hand in tight grip posture).

Inter-arc-bridge wing 216*c*1 is not limited to a round shape as illustrated in SHWT glove 100 in FIG. 1A. It can be of any shape and appropriate height as long as it does not impact SHWT glove usability and still offer protection to the particular palm area shown in FIG. 3B, FIG. 12C or 12E. Specifically the shape of inter-arc-bridge wing 216*c*1's section connected to notch wing 335 may match the shape of thenar eminence and its bump which is illustrated in dashed circle area in FIG. 7A.

Adding notch wing 335 (in FIGS. 7A & 7B) at two sides of the inter-arc-bridge wing 216*c*1 may have partial structural buffer connection effects which may allow inter-arc-bridge wing 216*c*1 to flip down more easily during tight grip action.

The integrated structure design of notch wing 335 in SW05 illustrated in FIGS. 7B & 7C is similar in structure and function to implementing outward reclined skirt wall from SW02 but only at location 506 shown in FIG. 5D close to thumb (or pinky) root section, while leaving the rest of the skirt wall relatively upright.

FIG. 7C illustrates the comparison between SW05's notch wing 335 and a sliced-out segment of SW02's outward reclined skirt wall located at 506 shown in FIG. 5D close to thumb (or pinky finger) root section. Notice if we vertically slice this outward reclined wall segment from SW02, it decomposes into a notch and a wing shown in FIG. 7C, which is similar in design to SW05's notch wing 335.

SW05 adds notch wing 335 at two sides of each inter-arc-bridge wing 216*c*1 to follow the shape at left or right thenar eminence bump at thumb root section (close to thumb MCP crease 287), while leaving the rest of skirt edge more upright to reduce the total top skirt aperture size and create a better fit for hand's palm shape compared to SW02.

Notch or notch wing implemented at location 506 close to thumb (or pinky finger) root section (shown in FIG. 5D) may allow rest of skirt wall extend upwardly higher which may protect more finger root section and palm section without causing thumb or pinky finger shift up from sleeve tip by distance D when hand wearing SHWT glove is performing repeated open/close action.

Location 506's height in FIG. 5D roughly corresponds to the height of thumb root section including thumb MCP crease 287 and nearby thenar eminence 219's bump when a user's hand is inserted into a SHWT glove, hence the height of 506 may be relatively constant. Referring FIGS. 5 & 6, a SHWT glove may be split into lower finger protection body 100*f* and upper top skirt SW03 or SW05. In one aspect and as illustrated in FIG. 6A, the top skirt (SW03 or SW05) is above finger protection body 100*f* and extends upward. Refer to FIG. 21C, assuming center conjunction area is flat or convex spherical (dome) structure and ignoring center conjunction area wall thickness 505, 100*f*'s height 100*f*-H is equal to sleeve height (SH). When sleeve height (SH) is implemented to be similar to or lower than the height of 506, notch or notch wing implemented at the height of 506 may be completely located at the top skirt as illustrated in all examples in FIGS. 5, 6, 17 & 18. When sleeve height (SH) is implemented higher than the height of 506, notch or notch wing may have their lower section located at finger protection body 100*f* and their top section located at the top skirt (SW03 or SW05).

The top edge of the top skirt SW03 which is also the top edge of the SHWT glove may be reinforced with a top edge rim 107 (shown in FIGS. 1A & 1B). The thickness of the top edge rim 107 may vary along the different sections of the top skirt. By varying the thickness of the top edge rim 107, we can vary the stiffness at the top part of the SHWT glove, so that the SHWT glove can stand on its own without collapsing.

The top edge rim 107 and notch wings 335 also serve another purpose. When a person needs to take off the SHWT glove without the help of a second hand, fingers (typically ring or pinky finger) outside of the finger sleeves may push against the top edge rim 107 or notch wing 335 to help eject the finger glove. Another way to take off the finger glove is to lean the top edge rim 107 against any edge of a fixed object such as the edge of a kitchen countertop to help eject the finger glove.

One aspect of SHWT glove's top skirt provides a usability improvement over other gloves on the market due to notch, notch wing and flip-able inter-arc-bridge wings added to the top skirt. Such top skirt provides increased protection for the palm area and finger root sections. Additionally, it prevents the skirt top edge from pushing against the thenar eminence bump at thumb root section, helping the SHWT glove remain affixed.

FIGS. 1A & 1C show SHWT glove 100 has three reverse U-shaped tunnels 106, which may be identical, formed by half of the interior walls of the two neighboring sleeves and their connecting arc bridge section 108 (FIGS. 1B & 1D). When a hand wears SHWT glove, the reverse U-shaped tunnel 106 sits just underneath the root section between the inserted fingers such as that between thumb and index shown in FIGS. 8B, 8C, 12B & 12D. Therefore the design of the reverse U-shaped tunnel may affect the SHWT glove performance at the inter finger root area. SHWT glove has a general vertical size limit applied to the reverse U-shaped tunnel.

To explain the vertical size of the reverse U-shaped tunnel, we define a curve called arc B. FIG. 1D shows one aspect of SHWT glove 100 longitudinal cross section 106C of the reverse U-shaped tunnel. The longitudinal cross section 106C is line symmetric along the longitudinal axis and SHWT glove transverse cross section UC line shown in FIG. 1A and FIG. 13C 2D view. The top roof of reverse U-shaped tunnel is the arc bridge section 108 shown as cross section view 108C in FIG. 1D.

FIG. 1C shows that at the bottom of SHWT glove 100's reverse U-shaped tunnel 106, the external width 105*a* between the two exterior corners of the neighboring sleeves is the same as the internal width 105*b* which is the parallel line to external width 105*a* between two neighboring sleeves' interior walls.

As illustrated in FIG. 1D, to measure external width 105*a* and internal width 105*b*, we may assume the parallel sections of interior wall 109C are extended to sleeve tip and omit sleeve bottom curvature. We refer to this type of reverse U-shaped tunnel as parallel reverse U-shaped tunnel which may be formed by sleeve transverse cross sections shown in FIGS. 10A, 10C, 10D, 11B and 13C. As shown in FIG. 1D, we define arc B as the curve line starting from the bottom of one finger sleeve, tracing the curve of the longitudinal cross section 106C and ending at the neighboring finger sleeve's bottom. Since reverse U-shaped tunnel 106 in FIG. 1D is parallel, arc B for each longitudinal cross section 106C along the transverse axis is of the same length. Here inter-arc-bridge wing's upward erected section is excluded from longitudinal cross section 106C.

FIG. 11A shows SHWT glove 230 has three reverse U-shaped tunnels 106*n* where its external width 105*a* is of different length than that of internal width 105*b*. We refer to this type of reverse U-shaped tunnel as non-parallel reverse U-shaped tunnel which may be formed by finger sleeves with transverse cross section shown in FIGS. 10B & 10E. In this case, each longitudinal cross section of the reverse U-shaped tunnel 106C along the transverse axis has arc B of different length.

Figures 10, 10A, 10B, 10C, 10D, 10E:
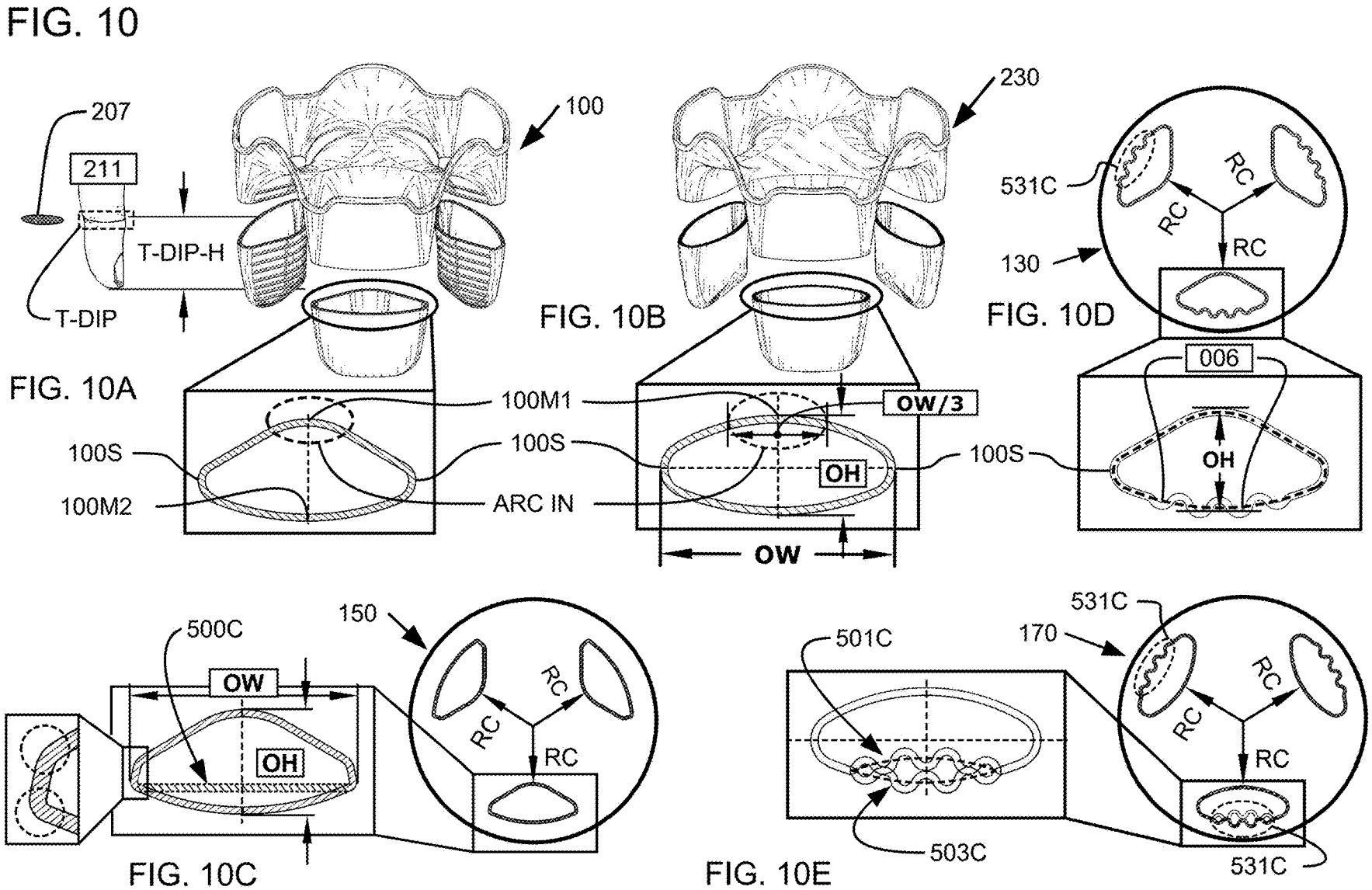

As shown in FIG. 11A right diagram, non-parallel reverse U-shaped tunnel's internal width 105*b* such as those in SHWT glove 230 is defined as the distance between two neighboring sleeve's grip radius (RC) end points (opposite to the glove center (GC)) on the interior sleeve wall shifted towards external width 105*a* by half of ARC IN segment. Parallel reverse U-shaped tunnel's internal width 105*b* such as those in SHWT glove 100 shown in FIG. 1C may follow the same principle to define internal width 105*b* by shifting half ARC IN segment from grip radius (RC) end point on the finger sleeve interior wall. As illustrated in FIG. 1D, internal width 105*b* measurement is taken from the glove transverse cross section plane toward the bottom of the finger sleeve right before the curvature of the sleeve bottom starts. Note grip radius (RC) end points (opposite to the glove center (GC)) may not be on the finger sleeve interior wall in some SHWT glove configurations. For sleeves shown in FIG. 10A, 10C, 10D, ARC IN segment can be easily separated and measured when sleeve transverse cross section shape has ARC IN directly connected to two straight sides. In other cases such as those shown in FIGS. 10B & 10E where ARC IN is part of a long arc segment, it may be defined by estimation. ARC IN length in this case may be estimated as ⅓ of the sleeve transverse cross section width (OW) as shown in FIG. 10B.

For either parallel or non-parallel reverse U-shaped tunnel, arc B for the longitudinal cross section 106C located at internal width 105*b* may be used as a design reference, because 105*b* based arc B top area is the spot that may touch or push inter finger root section such as the root section shown in FIG. 15B between middle and ring fingers. We may simply refer to 105*b* based arc B as arc B in the following description.

As human hand opens and closes, the length of the inter finger arcs arc MI, arc MR and arc TI (shown in FIG. 14D) changes. When the hand closes and fingers are bent, the finger creases 281, 282 and 283 (shown in FIG. 14C) and palm creases 285 and thumb MCP crease 287 (shown in FIG. 14D) are partially or fully folded and skins shrink such that the length of arc MI, arc MR and arc TI will be reduced. Here arc MI denotes arc between middle and index finger, arc MR denotes arc between middle and ring finger and arc TI denotes arc between thumb and index.

Figure 12:
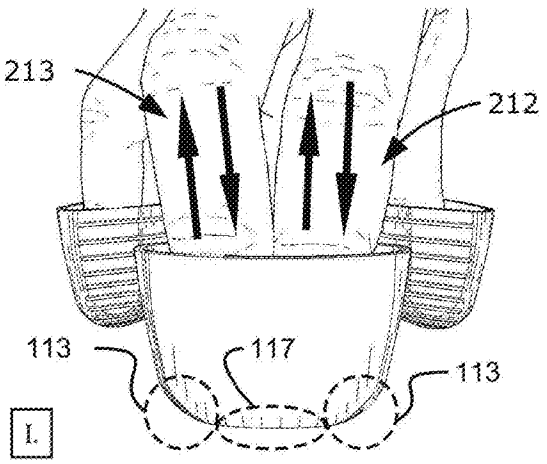
FIG. 12A I illustrates a lower front perspective view of SHWT glove 100. It illustrates a finger sleeve front view shape with sleeve bottom having flat segment 117 in the center connected with two round corners 113 on the side. It illustrates index finger 212 and middle finger 213 performing up and down reciprocal movement to help pull out from finger sleeve to achieve self takeoff.
FIG. 12B illustrates a lower side perspective view of right hand 202*b* in SHWT glove 100 in tight grip posture with center gap 180.
FIG. 12C illustrates a bottom perspective view of right hand 202*b* in SHWT glove 100 in tight grip posture. It illustrates a center gap 180 created in the middle when all finger sleeves converged near the tip.
FIG. 12D illustrates a lower side perspective view of right hand 202*b* in SHWT glove 100 grabbing a slim object (e.g. French Fries 301) by rotating each finger sleeve near the tip to close and reduce the center gap 180.
FIG. 12E illustrates a bottom perspective view of right hand 202*b* in SHWT glove 100 grabbing a slim object (e.g. French Fries 301) by rotating each finger sleeve near the tip to close and reduce the center gap 180.
Figure 12A:
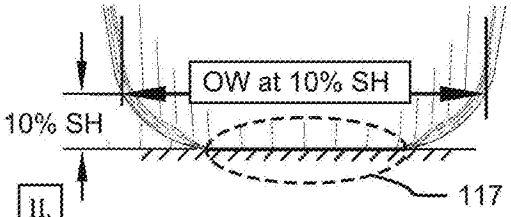
Figure 12A:
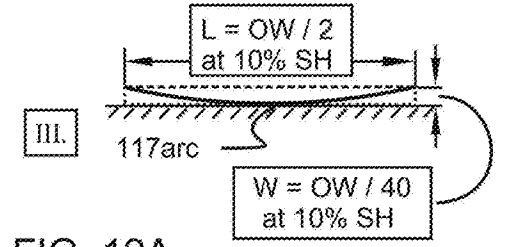
Figure 12B:
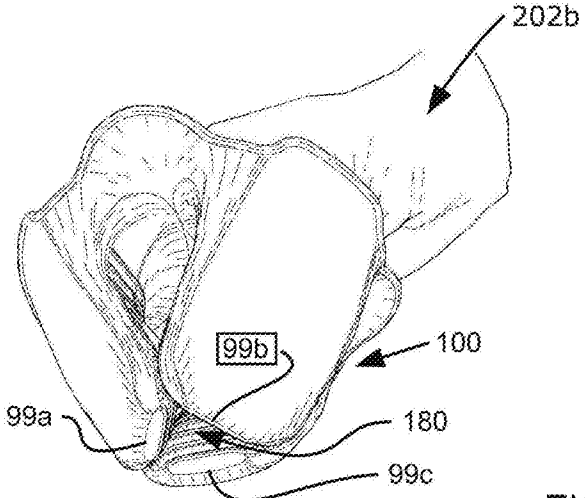

FIGS. 12B, C, D, E illustrate the hand wearing SHWT glove 100 in a tight grip posture. FIG. 8D illustrates a detailed 3D perspective view of the hand wearing SHWT glove 100 in a tight grip posture with finger sleeves squeezed together near the tips 99. Hand is not illustrated in FIG. 8D to better illustrate the finger sleeve deformation.

FIG. 15B is perspective view of right hand 202*b* in SHWT glove 100 in tight grip posture and SHWT reverse U-shaped tunnel top or arc bridge section 108 has been squeezed and bent upward towards the root area in between middle and ring finger. FIG. 15B shows the root section between middle and ring finger almost touching 105*b* based arc B top area (refer to FIGS. 1C, 1D & 11A for internal width 105*b*). Similar situations may occur at root section between middle and index finger when each of them is inserted into two neighboring sleeves.

FIG. 15A shows a hand wearing SHWT glove 100 in tight grip posture using a typical finger insertion combination shown in FIG. 2D but without showing SHWT glove 100 in the figure for better illustration of the hand posture. The minimum length of arc MI, arc MR and arc TI occurs when fingers are squeezed together at the fingertip to form a tight grip shown in FIGS. 15A, 15B, 15C & 15D.

Here we introduce Projected-arc-tight-grip as a projected arc for each inter finger arc when SHWT glove is in tight grip posture. FIGS. 15C & 15D illustrate Projected-arc-tight-grip-MR or simply projected-arc-MR to denote Projected-arc-tight-grip for arc MR in FIG. 14D. Following the same denotation principle, projected-arc-MI denotes Projected-arc-tight-grip for arc MI and projected-arc-TI denotes Projected-arc-tight-grip for arc TI.

As shown in FIGS. 15C and 15D, projected-arc-MR is defined as a projected shape's vertical arc length created by light source from SHWT glove 100's center SH line shown in FIG. 15E when hand performs tight grip action causing all finger sleeves touching together near the tip (refer FIGS. 12B, 12C, 12D, 12E, 15B & 15D) and causing reverse U-shaped tunnel squeezed by middle and ring fingers. FIGS. 15C and 15D illustrates projected-arc-MR enclosing a hatched area when a parallel light source is positioned at SHWT glove 100's center SH line (shown in FIG. 15E) and beaming direction is along SHWT glove transverse cross section UC line (shown in FIG. 15D). The length of projected-arc-MR may be determined with the above-described light source with its beam direction. The same definition and method to estimate length may apply to projected-arc-MI and projected-arc-TI.

The reverse U-shaped tunnel may have an upper limit for its vertical size which is the length of 105*b* (refer FIGS. 1C, 1D & 11A) based arc B. When arc B length exceeds this upper limit, the reverse U-shaped tunnel top section may push inter figure root and cause inserted fingers slipping out of the sleeve.

Figure 12C:
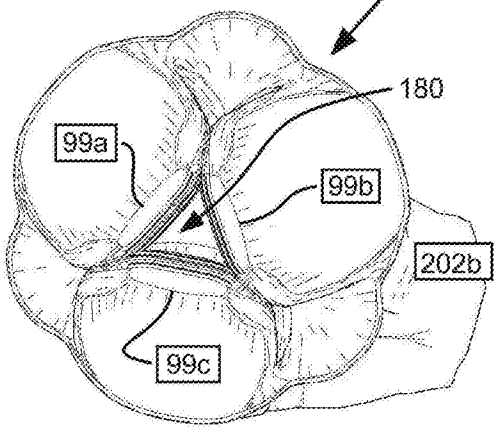
Figure 12D:
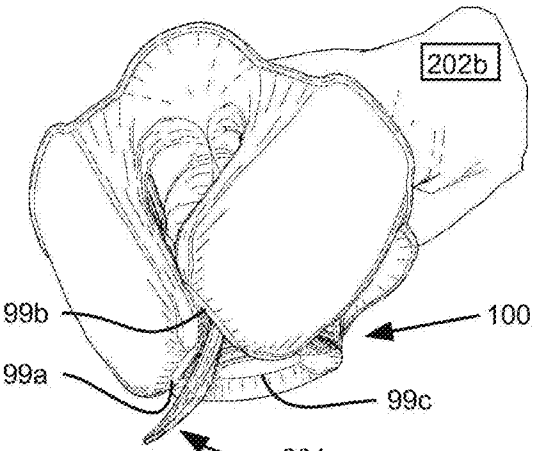
Figure 12E:
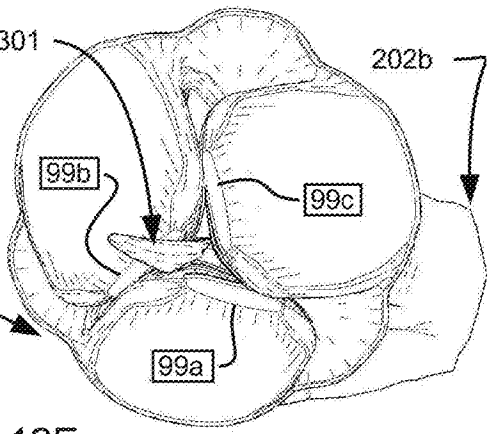

When a hand wearing SHWT glove 100 is in tight grip posture with fingers fully inserted into the sleeves, all three finger sleeves are squeezed together (shown in FIGS. 12C, 12D & 12E). Inter finger arcs such as arc TI, arc MI or arc MR shown in FIG. 14D are projected to create projected-arc-tight grip. The reverse U-shaped tunnel 106, such as the one between middle and ring fingers shown in FIG. 15B, is deformed and 105*b* based arc B top area squeezed upward towards the root area in between fingers. In one aspect, the length of 105*b* based arc B may not exceed the projected-arc-tight-grip length, otherwise arc B top area may touch and push against the root area in between fingers and cause fingers to slip out of the finger sleeve.

Projected-arc-tight grip such as projected-arc-MI, projected-arc-MR or projected-arc-TI may be of different lengths, with projected-arc-MI and projected-arc-MR usually at similar length but may be shorter than projected-arc-TI. Projected-arc-TI length may be shorter than the Projected-arc-tight grip length between pinky via palm to thumb when pinky and thumb each occupy two neighboring sleeves in a SHWT glove. In addition, some people may have longer projected-arc-MR than projected-arc-MI, and other people may have longer projected-arc-MI than projected-arc-MR.

In one aspect all reverse U-shaped tunnels 106 may be identical. In this case the average length of projected-arc-MI and projected-arc-MR may be used as the 105*b* based arc B upper limit.

Finding the upper limit for 105*b* based arc B by averaging projected-arc-MI and projected-arc-MR length may help determine the reverse U-shaped tunnel vertical size that can maximize the object size a hand wearing SHWT glove can securely grab between two neighboring finger sleeves. Here we refer to SWHT glove gripping or grabbing object between two neighboring finger sleeves or under SHWT glove reverse U-shaped tunnel as inter-sleeve-grip/grab.

We use spherical object as reference for arc B length design to describe inter-sleeve-grip/grab object size, as spherical object provides a representation of standard dimensional measurement for inter-sleeve-grip/grab object size.

There is no lower limit for arc B length. However, the length of arc B may determine one maximum spherical object SHWT glove can securely hold with inter-sleeve-grip/grab. In one aspect, when SHWT glove inter-sleeve-grip/grab securely holds a spherical object, the tips of its two neighboring finger sleeves may reach beyond the spherical object equator line. This decreases the likelihood of the object slipping. Therefore, if arc B is too short, it may reduce the object size SHWT glove inter-sleeve-grip/grab can securely hold. Here we omit the thickness of the sleeve wall for simplification. The thickness of the sleeve wall may further reduce one maximum SHWT glove inter-sleeve-grip/grab object size.

Arc B length may be no longer than (or not exceed) but close to the average length of projected-arc-MI and projected-arc-MR so that the SHWT glove will remain affixed during inter sleeve grip/grab, and the size of an object that a user's hand can securely hold with inter sleeve grip/grab can be increased. This arc B length limit rule is developed based on the fact that a naked hand's inter finger gripping maximum object size is limited by its projected-arc-MI or projected-arc-MR. In other words, a user with a large hand can grip a larger object than a user with a small hand.

Figures 9, 9A, 9B, 9C, 9D, 9E, 9F:
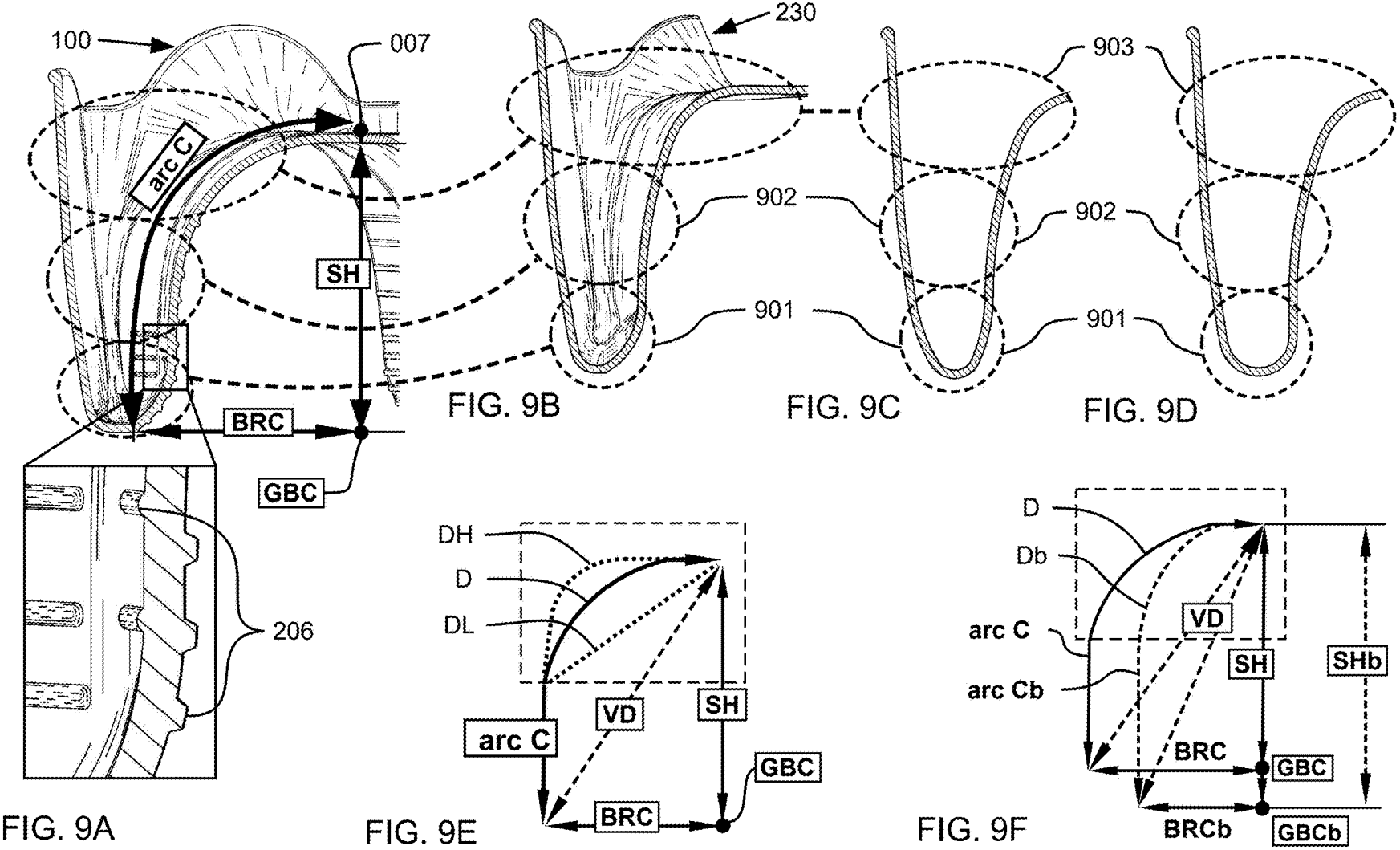
FIG. 9A illustrates a longitudinal cross section view of SHWT glove 100 along arc C plane, showing SHWT glove 100's finger sleeve shape matching human finger shape. Expanded view of print patterns 206 on the inner and outer surface of the finger sleeve wall. It illustrates a relative position of arc C, bottom grip radius (BRC), sleeve height (SH) and dome top center 007 in this 2D cross-section view.
FIG. 9B illustrates a longitudinal cross section view of SHWT glove 230 along arc C plane. SHWT glove 230's finger sleeve shape matching human finger shape. It illustrates the relative position of top sleeve aperture 903, mid sleeve section 902 and bottom sleeve section 901.
FIG. 9C illustrates a longitudinal cross-section view of alternative finger sleeve shape along arc C plane, with relatively sharp half oval shape at the bottom. It illustrates a relative position of top sleeve aperture 903, mid sleeve section 902 and bottom sleeve section 901.
FIG. 9D illustrates a longitudinal cross-section view of alternative finger sleeve shape along arc C plane, with round (or blunt) shape at the bottom. It illustrates a relative position of top sleeve aperture 903, mid sleeve section 902 and bottom sleeve section 901.
FIG. 9E illustrates a 2D geometrical illustrative view of VD, sleeve height (SH) and bottom grip radius (BRC) forming a right triangle from FIG. 8A's 3D view. The upper dashed window illustrates arc C upper segment curve shape D compared to curve shapes DH and DL to match inserted fingers in relaxed open posture. In one aspect, VD is the distance between sleeve height (SH) (in some aspects, center SH line, see below) top end and bottom grip radius (BRC) exterior end point.
FIG. 9F illustrates a 2D geometrical illustrative view with relative constant VD determined by either arc C with its upper segment curve shape D or arc Cb with similar curve shape Db, when bottom grip radius (BRC) is reduced to BRCb, the inversely proportional SHb is increased from SH.

To understand the design for SHWT glove center gripping space sitting directly underneath the palm of a hand, we define each finger sleeve having an approximate curve called arc C. As shown in both 3D prospective and 2D view in FIG. 8A and FIG. 9A, we define arc C as the approximate line starting from dome top center 007, going down the finger sleeve's interior wall and end at the bottom of the finger sleeve. Dome top center 007 is the end point of center SH line at center conjunction area bottom surface plus center conjunction area wall thickness 505 (shown in FIG. 21C). Each sleeve's arc C line is in the 2D plane formed by center SH line and bottom grip radius (BRC) of the finger sleeve. There are three arc Cs in SHWT glove 100. FIG. 8A shows the SHWT glove 100's three arc Cs are 120 degrees apart and form a virtual dome space due to rotational symmetric property. The virtual dome space has dome top center 007 shown in FIGS. 8A, 8B & 9A. Dome bottom is the sitting plane or flat surface the SHWT glove may stand on, and the dome longitudinal arc line is arc C. Dome height is the height of center SH line plus center conjunction area wall thickness 505 (shown in FIG. 21C). If arc C line were rotated by 360 degrees, a virtual dome space may be formed with bottom grip radius (BRC) shown in FIG. 8A being the dome radius at the bottom. As illustrated in FIGS. 9E & 9F, arc C is defined as approximate line as each sleeve's bottom curvature is ignored and arc C bottom segment is approximated as vertical line. FIG. 8B and FIG. 8C show that this virtual dome space sits underneath the palm of the hand and mimics the palm shape when the hand inserts into the SHWT glove in a relaxed open posture. In one aspect, "virtual dome space" may be reflected in a SHWT glove as an actual, physical dome when considering the center conjunction area and portions of the finger sleeve.

When the hand is in tight grip posture as shown in FIGS. 8D, 12B, 12C, 12D, & 12E, all three finger sleeves are squeezed together. As illustrated in FIG. 8B by the upward arrow located at dome top center 007, the top of the virtual dome space or virtual dome roof will be squeezed upward at the center conjunction area along with the top of the reverse U-shaped tunnel 106 pushing upward towards the palm.

The length of arc C may have an upper limit, otherwise the virtual dome roof at center conjunction area 103 and its connected reverse U-shaped tunnel may push against the palm during tight gripping action and cause fingers to slip out of the SHWT glove. 3D view in FIGS. 12B, 12D and 12E or 2D view in FIG. 8E illustrate hand is in tight grip posture with finger sleeves squeezed together. Also refer to FIG. 15B SHWT glove 100 tight grip deformation shape as arc B together with arc C affect SHWT glove usability during tight gripping.

To better describe the upper limit for arc C, we use one way to wear SHWT glove 100 shown in FIGS. 2A & 2B as an example. In FIGS. 2A and 2B, thumb is inserted into the first sleeve, index and middle fingers are inserted into the second sleeve and ring and pinky fingers are inserted into the third sleeve.

FIG. 15A illustrates the same finger insertion combination as shown in FIGS. 2A & 2B (without showing SHWT glove 100 in the figure) when the hand is in a tight grip posture shown in FIG. 15B, or 12B, 12D and 12E. FIG. 15A omits the SHWT glove from the drawing to better illustrate the finger and palm posture. We define ARC tight grip C shown in FIG. 15A as the curve line starting from the tip of a folded finger to the center of arched palm conjunction area (hatched area) just below and close to the root of the middle finger. This hatched area overlaps with the center conjunction area 103 of the SHWT glove 100 when the hand is in tight grip posture.

3D simulation and measurement of prototypes of SHWT glove 100 verify that when a hand wearing SHWT glove 100 is either in a relaxed open posture or in tight grip posture, SHWT glove's center conjunction area 103 (hatched area in FIG. 15A) is roughly located at the palm area just below the root of the middle finger shown in the flat hand position in FIG. 14D.

In FIG. 14D when the hand is flattened, imagine the index and middle finger closed together in a straight position, while turning the thumb clockwise maximally towards 120 degree, and ring and pinky fingers turning counterclockwise to maximum degree (towards 120 degree). This mimics the same finger insertion combination example as FIGS. 2A & 2B. When fingers are stretched in an imaginary virtual posture as described above, the tip of thumb, middle and ring finger may be approximately the same distance away from the center of the hatched area, which overlaps with the center conjunction area 103. We refer to this distance as "arc flat hand radius" shown in FIG. 14D. This is the radius of the larger circles shown in FIG. 14D with the circle center being the center of the hatched area.

When the hand wearing SHWT glove is in tight grip posture with all finger sleeves squeezed together, all finger creases 281, 282, 283, 287 and palm creases 285 in FIGS. 14C and 14D will be folded and nearby skins shrink.

Arc flat hand radius in the flat hand will be reduced to ARC tight grip C in a tight grip hand as shown in FIG. 15A. FIG. 14D shows the approximate difference between arc flat hand radius and ARC tight grip C as shrink distance SD.

FIG. 14D shows ARC tight grip C for the middle finger is straight, and ARC tight grip C for the thumb and pinky fingers are curved, but they are of roughly the same length.

Hence back to FIG. 15A, it shows 3D illustration of ARC tight grip C length based on how it is derived and reduced from FIG. 14D's "arc flat hand radius" due to finger and palm creases folding and skin shrink when hand is in tight grip posture.

In one aspect, the length of Arc C may not exceed the length of ARC tight grip C, otherwise SHWT glove's center conjunction area 103 and top of the reverse U-shaped tunnel 106 may bend upward (as illustrated by the upward arrow located at dome top center 007 in FIG. 8B) and push against the palm when the hand wearing SHWT glove is in tight grip posture and this may result in the SHWT glove slipping off.

Finding ARC tight grip C as the upper limit for arc C not only helps to avoid finger from slipping out of SHWT glove during tight grip, but also determine the arc C that can maximize the object size a hand wearing SHWT glove can grab securely in the center with all finger sleeves. Here we refer to SHWT glove gripping or grabbing object in the center among all finger sleeves as SHWT glove center grip/grab.

In one aspect we use a spherical object as reference for arc C length design to describe center grip/grab object size, as a spherical object provides a representation of standard dimensional measurement for SHWT glove center grip/grab object size.

FIGS. 8A 8B & 8C shows the virtual dome space in SHWT glove underneath the palm of the inserted hand. The size of this virtual dome space (or volume) changes when hand open/close action changes the bottom grip radius (BRC) length, but the fixed arc C length may determine one maximum spherical object size that SHWT glove can securely hold with center grip/grab. To securely hold a spherical object with center grip/grab, the tips 99 of all finger sleeves may pass the equator line of the spherical object. Otherwise the object may slip. Hence the longer the arc C length the larger the spherical object SHWT can securely hold with center grip/grab.

Here we omit the thickness of the sleeve wall for simplification. The thickness of the sleeve wall may further reduce one maximum SHWT glove center grip/grab object size.

In one aspect, arc C length may not exceed ARC tight grip C but may be very close to it so that the SHWT glove will remain affixed during center grip/grab while the size of an object that a user's hand can securely hold with center grip/grab may be increased.

In one aspect, arc C and arc B may follow the guidelines described herein to provide a secure fit of the SHWT glove to the hand during use without the glove slipping off, but also maximize the object size that SHWT glove can securely hold with both inter-sleeve-grip/grab and center grip/grab.

In one aspect, SHWT inter sleeve reverse U-shaped tunnel space (including inter-arc-bridge wing lower part) and center dome space which may be determined by selected arc B and arc C can increase the protection area for hand's finger root and palm section as well as improve fit for external inter finger root area.

SHWT gloves like SHWT glove 100 in FIGS. 1A and 1B has palm protection section that comprises a center palm protection section and a top skirt. The center palm protection section comprises arc bridge sections 108 (FIG. 1B), part of inter-arc-bridge wings 216*c*1's horizontal section (shown within dashed circle in FIG. 1B) and the center conjunction area 103 in FIGS. 1B & 1D. The center palm protection section may protect the palm center and inner finger root sections as illustrated from different view angles in FIG. 1B, 2A, 2D, 5B, 8A, 8B or 8C.

Top skirt such as SW03 or SW05 in FIG. 5, FIG. 6 and FIG. 7 with inter-arc-bridge wings 216*c*1's upward section illustrated in FIG. 5A or 3C may further protect inter finger root sections of the hand and the rest of palm center plus edge area (FIGS. 3B, 5D & 7A). The flipped out inter-arc-bridge wings 216*c*2 may protect palm area between thenar eminence 219 & hypothenar eminence 217 in FIGS. 3B & 12C, 12E.

To simplify, the complete palm protection section which comprises the center palm protection section and the top skirt will be referred to as palm protection section.

The palm protection section is an integral extension of the finger sleeve's top sleeve apertures. FIG. 2D, 3C, 3B, 4A and FIG. 12C, 12E all illustrate how the palm protection section protects the human hand in different postures at different view angles.

FIGS. 8A, 9A & 9E illustrate SHWT glove 100's 3D and 2D dimension diagram. The longitudinal axis of each finger sleeve connecting to the palm protection section is orthogonal or near orthogonal to SHWT glove's transverse cross section plane. Hence refer FIG. 8A, palm protection section size may be determined by SHWT glove bottom grip radius (BRC) and two neighboring sleeves' bottom inter sleeve distance ISD or reverse U-shaped tunnel width. Throughout the description, when discussing grip radius (RC) in relation to SHWT palm protection size, the bottom grip radius (BRC) (shown in FIGS. 8A, 9E and 9F) is used.

As shown in FIG. 8A, bottom inter sleeve distance ISD is the distance between two neighboring bottom grip radius (BRC)'s end points (opposite to glove bottom center (GBC)). In a rotationally symmetric SHWT glove, two neighboring bottom grip radius (BRC) s and ISD form an isosceles triangle shape.

Refer to FIGS. 8A & 16C, in three finger sleeve based SHWT glove, two neighboring bottom grip radius (BRC) s have 120 degree angle hence bottom grip radius (BRC) and ISD length can be calculated and converted reciprocally. The same applies to four sleeve based SHWT glove with two neighboring bottom grip radius (BRC) s having 90 degree angle to convert bottom grip radius (BRC) and ISD. Bottom grip radius (BRC) length may affect SHWT glove center gripping performance as bottom grip radius (BRC) is a threshold to determine if the SHWT glove needs open or close action to center grip spherical objects of different radius.

When a spherical object's radius is larger than bottom grip radius (BRC), a user needs to open the SHWT glove before grabbing onto the object. If a spherical object's radius is smaller than bottom grip radius (BRC), a user wearing the SHWT glove may close their grip on the smaller object in order to hold the object without opening the SHWT glove.

As a reasonable approximation and ignoring sleeve wall thickness, ISD minus two half sleeve widths roughly equals to reverse U-shaped tunnel 106's external width 105*a* or internal width 105*b* in SHWT glove 100 shown in FIG. 1C, since ISD ends at two bottom grip radius (BRC)'s end points on the interior wall. ISD may be used instead of reverse U-shaped tunnel width to explain palm protection section dimension as a non-parallel reverse U-shaped tunnel may have different widths (see external width 105*a* and internal width 105*b* in FIG. 11A).

Once SHWT glove's sleeve transverse cross sections' widths at sleeve bottom section are determined, ISD works as a threshold to determine if there should be open or close action to grip spherical objects of different diameter between two neighboring sleeves, similar to bottom grip radius (BRC) serving as a threshold for center gripping object.

When a spherical object's diameter is larger than ISD minus two half sleeve widths (approximately equal to reverse U-shaped tunnel width), a user wearing the SHWT glove may open the SHWT glove to grab onto the object. If the object's diameter is smaller than ISD minus two half sleeve widths, a user wearing the SHWT glove may close the SHWT glove over the object to hold the object without opening the SHWT glove.

Geometrically either bottom grip radius (BRC) or ISD can represent inter sleeve distance and may affect both SHWT glove inter-sleeve-grip/grab and center grip/grab performance as ISD and bottom grip radius (BRC) value are convertible (refer to FIGS. 8A & 16C).

In the case of four sleeves based SHWT glove 250 shown in FIGS. 13A & 13B, there may be cross sleeve distance (between two non-neighboring sleeves) which may be 2 times the bottom grip radius (BRC) length, hence original bottom grip radius (BRC) or ISD can still determine the palm protection section size.

FIGS. 8B and 9E illustrate that with selected palm protection section and the fully inserted right hand 202*b* in a relaxed open posture, the upper segment of arc C shown as solid line curve D in upper dashed square window of FIG. 9E and arc bridge section 108 (refer FIG. 1D) shape the virtual dome roof underneath the palm.

FIGS. 8B, 9A & 9E illustrate the finger sleeve top aperture interior wall curving towards the virtual dome roof centered by arc C upper segment follows the curvature of the parallel inserted index and/or middle finger shape (FIG. 8B) when the above fingers are inserted in a relaxed open posture.

Note: The shape of the virtual dome roof centered by arc C upper segment follows inserted index and/or middle finger but it may also follow all four inserted fingers (except thumb) average open relax shape in SHWT glove.

FIG. 8C illustrates a gap space 288 that may exist between arc C upper segment and relatively vertical inserted thumb. This gap is not avoidable in a rotationally symmetric SHWT glove. If we reduce gap space 288 by making arc C upper segment a more 90-degree corner curve such as curve shape DH in FIG. 9E, it may conflict with the curvature of the rest four inserted fingers in relaxed open posture. We also don't want to make arc C upper segment more straight line like curve shape DL in FIG. 9E which may create more gap space 288 (refer FIGS. 8C & 9E). A desired range of arc C upper segment curve may roughly follow the average curvature of four inserted fingers (except thumb) bent in relaxed open posture with some deviation, but not as much as curve shape DH or DL shown in FIG. 9E.

Hence, a selected arc C length with its relatively constant arc C upper segment curve shape (solid line curve in upper dashed square window in FIG. 9E) plus its relatively vertical lower segment may determine the relatively constant distance VD shown in FIGS. 8A and 9E. When analyzing the geometric relationships among arc C, VD, SH and BRC such as those illustrated in FIGS. 9E and 9F, we may consider the height of arc C start point at the top-dome top center 007 (shown in FIG. 9A) is the center SH line height or sleeve height (SH) by ignoring the center conjunction area wall thickness 505 (shown in FIG. 21C), as the wall thickness 505 is negligible compared to the SH length.

FIGS. 8A & 9E illustrates that VD, bottom grip radius (BRC) and center SH line forming a right triangle. Since VD length will stay relatively constant, VD length will limit center SH line and bottom grip radius (BRC) length and make them inversely proportional, which means the longer the center SH line, the shorter the bottom grip radius (BRC) and vice versa. In one aspect, sleeve height (SH) is a length along center SH line from the glove bottom center (GBC) to the bottom surface of the center conjunction area. In one aspect, the length of center SH line may be equal to sleeve height (SH).

FIG. 9F illustrates with relatively constant VD length determined by either arc C with its upper segment curve shape D or similar length arc Cb with similar upper segment curve shape Db, when bottom grip radius (BRC) is reduced to BRCb, the inversely proportional length SHb will be greater than original sleeve height (SH). The abbreviation "arc Cb" represents the arc C line for one example of a SHWT glove that has an arc C line having a similar length and similar upper segment curve shape (or dome shape) as a SHWT glove to which it is being compared. The abbreviation "BRCb" represents the bottom grip radius (BRC) for one example of a SHWT glove that has a smaller bottom grip radius (BRC) than a SHWT glove to which it is being compared. The abbreviation "SHb" represents the sleeve height (SH) for one example of a SHWT glove that has a longer sleeve height (SH) than a SHWT glove to which it is being compared.

Based on above 2D and 3D dimensional parameter analysis of SHWT glove 100 shown in FIGS. 8A, 8B, 8C, 9E and 9F, under the limit of a relatively constant VD length, palm protection section size can be determined by inversely proportional bottom grip radius (BRC) and sleeve height (SH) and their relative ratio. The dimension of the palm protection section may affect SHWT glove grip/grab performance.

To determine bottom grip radius (BRC) and sleeve height (SH) for a palm protection section, we need to understand how hand wearing a glove moves and uses force to perform grip/grab action. When a hand wears a conventional glove, the hand, especially the muscle driving the finger joints, may use extra force to open and close due to the force needed to bend and stretch a regular glove or SHWT glove body to follow hand (finger) movement. Those extra forces used to deform a conventional glove are one of the main factors causing usability issues and hand discomfort with a conventional glove.

Hand muscles, especially those close to finger joints are much stronger at doing close action than open action. A hand wearing SHWT glove may easily feel muscle weakness or fatigue when it is opening wide than when it is closing to form a tight grip. When a hand in SHWT glove closes to grip a small object in the center as shown in FIG. 8D, hand uses extra force mainly to bend and squeeze SHWT glove body or clamp finger sleeves together in order to reach and grip a small object (Refer FIG. 8D). The extra force used during close action will be referred to as extra-close-force and it is dominated by forces used to bend and squeeze SHWT glove to pick small object which will be referred to as extra-bend-force.

When a hand in SHWT glove needs to open wide to grip/grab a large object, hand uses extra force to first bend sleeves outward followed by stretching/expanding palm protection section and whole SHWT body structure until SHWT glove reaches arc C and arc B based structural stretch/expansion limit. We will cover arc C and arc B based structural stretch/expansion limit in detail later. The extra force used during open wide action will be referred to as extra-open-force.

Hand extra-open-force involves different types of forces. One is the extra-bend-force to bend finger sleeve and palm protection section outward. One is the extra stretching/expanding force to further stretch/expand whole SHWT body structure, which will be referred to as extra-stretch-force. Extra-stretch-force will be larger than extra-bend-force occurred during either hand close or open action. Human hand physiology properties such as weak muscle strength during hand open wide action in a glove and small extra-bend-force vs. large extra-stretch-force are some of the factors to guide SHWT glove design. Structural and dimensional palm protection section design creates a palm protection section size that may fit a greater variety of hands geometries and physiologies.

In one aspect, the palm protection section structural dimension is sized to maximize inter sleeve distance under the limit constrained by sleeve height (SH). Increasing bottom inter sleeve distance ISD or bottom grip radius (BRC) may increase the (supposedly spherical) object size SHWT can grab that only requires SHWT close action. In one aspect it may reduce the chance SHWT requires open wide action to grab large object. Since bottom grip radius (BRC) and sleeve height (SH) are inversely proportional, a long bottom grip radius (BRC) may be reflected by a short sleeve height (SH). A short sleeve height (SH) may cause other usability issues to be discussed below. In one aspect, sleeve height (SH) may be determined first, which may lead to bottom RC (BRC) length.

In one aspect, palm protection section structural dimension is sized to avoid, delay and reduce large extra-stretch-force during SHWT open wide action. To determine palm protection section structural dimension size for aiding in the reduction of force applied by a user's hand during SHWT open/close action, finger joint movements may be analyzed when SHWT performs open/close action.

To analyze finger joint movements during hand open/close action, we will use one way to wear SHWT glove as an example, which is illustrated in FIGS. 2A, 2B and 2D with SHWT glove 100: thumb is single inserted into the first sleeve, index and middle finger are parallel inserted into the second sleeve and ring and pinky fingers are non-parallel inserted into the third sleeve.

FIG. 8C illustrates one example of how thumb and index finger joints move during hand open/close action. Thumb and index finger joints are used for illustrative purposes to demonstrate finger movements since thumb, index and middle finger play dominant role in hand open/close action.

We omit middle finger movement because parallel inserted middle finger may have similar PIP and DIP movements as those of the index finger. Non-parallel inserted ring and pinky fingers may have similar joint movements as index finger.

For aiding in the reduction of force applied by a user's hand during hand open wide action in SHWT glove, we analyze the stages in the open process and related extra-open-force along with SHWT glove structural deformation characteristics.

During hand open wide action in a selected SHWT glove, hand starts from its beginning position till it reaches the maximum open limit of SHWT glove, which is the arc C and arc B based structural stretch/expansion limit. We can divide the hand open wide action into two stages.

In first stage (refer to FIGS. 2A & 8C), all five fingers straighten out by pivoting PIP, T-MCP and T-DIP joints outward to the maximum. Accordingly, SHWT glove's palm protection section is bent outward to drive apart the tips 99 of all finger sleeves. There is no major pivot movement at the rest of four MCP joints (excluding T-MCP) and CMC joint. Hence palm protection section may not expand and no major stretching force may be needed at this stage. We call this stage first PIPs, T-MCP & T-DIP open stage. This stage may be dominated by the relatively small extra-bend-force to bend finger sleeves and palm protection section outward to move apart all sleeves especially near the tip in a SHWT glove with selected sleeve height (SH).

The end of the first hand opening stage in SHWT glove 100 is characterized by all five fingers straightening out by pivoting PIP, T-MCP and T-DIP joints outward to the maximum and hand open posture already close to arc C and arc B based structural stretch/expansion initial stage or it might start to stretch/expand SHWT glove while four MCPs (exclude T-MCP) and CMC joints still keep their relaxed open angle.

In the following $2^{nd}$ stage, MCP and CMC joints make further small pivot movement outward to help hand further opening wide to stretch SHWT glove including palm protection section and finally reach arc C and arc B based structural stretch/expansion limit. This stage may be referred to as second MCPs & CMC open stage. The second MCPs & CMC open stage may be dominated by the larger extra stretch-force.

We will refer to hand posture when reaching arc C and arc B based structural stretch/expansion limit as SHWT glove hand maximum open posture. The SHWT glove hand maximum open posture is characterized by all five fingers being straight at PIPs, T-MCP & T-DIP joints plus MCP & CMC at maximum open angle and inter sleeve distance reaching maximum especially at the tip of the finger sleeves.

As previously discussed, ARC tight grip C may not exceed ARC flat hand radius (Refer FIG. 14D, 15A). Since arc C may not exceed ARC tight grip C, arc C may not exceed ARC flat hand radius. This results in SHWT glove hand maximum open posture in selected SHWT glove never exceeding ARC flat hand radius and is limited by arc C and arc B based structural stretch/expansion limit. Therefore, after all PIPs T-MCP & T-DIP joints are fully open and straight, four MCPs (exclude T-MCP) and CMC further open angle will be limited by arc C and arc B based structural stretch/expansion limit. In other words, in SHWT glove hand maximum open posture, four MCPs (exclude T-MCP) and CMC maximum open angle will be smaller than their open angle in flat hands. This is why MCP and CMC joints only need a minor angular change from relaxed open angle to maximum open angle in selected SHWT glove during second open stage.

In one aspect there may be overlap between first PIPs, T-MCP & T-DIP open stage and second MCPs & CMC open stage. The two stages may overlap but first stage is dominated by PIP & T-MCP joints movement and second stage is dominated by MCP & CMC joints movement.

To perform open/close action in a SHWT glove, finger joints may move in different combinations and sequences. Here we enumerate three cases of typical finger joint movement combinations and sequences with SHWT glove starting from hand relaxed open posture as shown in FIGS. 8C & 8B, with the focus more on hand open action.

FIG. 8C illustrates with SHWT glove 100 each finger joint pivot motion and range in dashed line using thumb and index finger as representatives. Understanding the three cases may help design a SHWT glove that reduces the force required by a user's hand to open SHWT glove during use.

Case A is a commonly used finger joint movement combination in SHWT glove especially for hand open action. All PIPs, T-MCP and T-DIP joints pivot move to perform open/close action with little or no move of CMC and the rest of the MCPs, except when performing second MCPs & CMC open stage in open wide action. Referring FIG. 8C, T-DIP 261 may have more pivot movement than T-MCP joint 271. For the rest of the four fingers, PIP joint pivot movement may also be accompanied with small DIP joint pivot movement.

Case A is characterized by hand open/close action mostly relying on four PIP joints accompanied with T-MCP and T-DIP joint pivot movement with little to no CMC and MCP joint pivot movement except when performing second MCPs & CMC open stage to reach arc C and arc B based structural stretch/expansion limit.

Case A's open wide action will follow the two-stage open process described above: first PIPs & T-MCP open stage and the CMC and MCPS involved second MCPs & CMC open stage. It should be noted that case A open sequence from PIPs, T-MCP & T-DIP group to MCPs & CMC group can be different and there is no clear line, but the final posture of the fingers and incurred extra open force may be similar. For example, PIPs, T-MCP & T-DIP open stage can also be accompanied with small MCPs & CMC open stage. Then MCPs & CMC joint may first reach close to palm protection structural stretch/expansion limit before all PIPs, T-MCP & T-DIP joints straighten out all five fingers.

MCPs & CMC open stage may first reach close to palm protection structural stretch/expansion limit, which may cause all PIPs, T-MCP & T-DIP joints to finish fully straighten out all five fingers accompanied by MCPs & CMC joints final opening to reach arc C and arc B based structural stretch/expansion limit.

Case B is mostly used in close action. Referring to FIGS. 2A & 8C, during close action, pivot movements may occur at four MCPs (except T-MCP), CMC and possibly T-DIP 261. All four PIP joints (292, 293, 294, and 295) and T-MCP joints have little or almost no pivot movements and keep their bent angle in relaxed open posture.

Hand open wide action by four MCPs (exclude T-MCP) and CMC while keeping all PIP and T-MCP in relaxed open posture with their bent angle in case B may be used despite that a hand may be constrained by palm protection section structural stretch/expansion limit and may not reach arc C and arc B based structural stretch/expansion limit. A hand may not achieve SHWT glove hand maximum open posture unless first PIPs & T-MCP open stage is involved and until all four fingers straighten.

Different from arc C and arc B based structural stretch/expansion limit, palm protection section structural stretch/expansion limit may include both center palm protection area and top skirt external skirt wall circumference maximum stretching limit (including inter-arc-bridge wings).

To further open and before four MCPs, CMC opening reach palm protection section structural stretch/expansion limit, all PIPs, T-MCP joint 271 and T-DIP 261 make a pivot movement to straighten outward to move apart the tips of all finger sleeves until they reach arc C and arc B based structural stretch/expansion limit.

Case B is characterized by hand close action mainly relying on four MCPs (exclude T-MCP) and CMC with a small T-DIP pivot move while keeping all PIPs and T-MCP joint 271 in relaxed open angle. Case B's open wide action to reach SHWT glove hand maximum open posture is the same as case A with same finger joints movement combination and sequence.

Case C is similar to Case B with four MCPs (exclude T-MCP) and CMC pivot move to achieve open/close action but it will start with four PIP joints moving to straighten fingers out. T-DIP may engage in a pivot movement during close action.

Case C finger joint movements mainly happen with naked hand or with hand in regular five finger gloves. Case C may not frequently occur in SHWT glove, but some people straighten their PIP joints before hand's open/close action with four MCPs (exclude T-MCP) and CMC pivot movement in SHWT glove. Case C is characterized by hand open/close action starting with PIP, T-MCP joints straighten out from relaxed open posture and then performing a movement similar to Case B's four MCP (exclude T-MCP) and CMC pivot movement with a small T-DIP pivot movement only for close action. Case C open wide action is similar to Case A, with first PIPs & T-MCP open stage and the CMC and MCPS involved second MCPs & CMC open stage.

As described, case A, B & C with a close action end with finger sleeves near the tips 99 squeezed together as illustrated in FIGS. 12B, 12C, 12D, 12E and 15B. For hand final close shape and posture inside SHWT glove refer to FIGS. 15A, 15C and 15D (SHWT glove 100 is not illustrated in the figures to better illustrate the hand posture).

In case A, B & C, a hand in a SHWT glove 100 opens/closes with corresponding SWHT glove body structural deformation characteristics and can be summarized as follow:

1) Four MCPs (exclude T-MCP) and CMC joints open action may mostly expand palm protection section first and later expand arc C and arc B based whole SHWT glove, which may lead to large extra-stretch-force. The pivot movement of four MCPs and CMC joints close action may mostly bend palm protection section which may lead to the hand only needing small extra-bend-force. In case B's close action, four MCPs (exclude T-MCP) and CMC joints may bend/squeeze virtual dome roof shown in FIG. 8B up towards the palm. Case A, B, C's open wide action by four MCPs (exclude T-MCP) and CMC joints may shift virtual dome roof downward and stretch palm protection section, top edge of finger protection body 100*f* and skirt wall.
2) All PIPs and T-MCP joints open wide or close action may mainly bend or squeeze SHWT glove at selected palm protection section with selected sleeve height (SH). If sleeve height (SH) is not kept in a selected range for example when sleeve height (SH) is lower than PIPs and T-MCP joint height, their open wide action may contain extra-stretch-force to stretch the palm protection section which will be covered more detail later. Through palm protection size selection, we can reduce extra-stretch-force during PIPs & T-MCP open stage.

3) Any DIP joint pivot movements during close action may help DIP bump 800 (in FIGS. 8B & 8C) further deform a relatively straight sleeve wall in order to increase sleeve clamping force, which may help prevent sleeve from slipping off inserted fingers.

Based on above analysis of finger joint movements during hand open/close action and their incurred small extra-bend-force and large extra-stretch-force to deform a SHWT glove, we may find a sleeve height (SH) that may allow PIP and T-MCP joints open wide action to mainly bend or squeeze but not stretch/expand SHWT glove body to reduce the large extra-stretch-force.

After sleeve height (SH) is determined, palm protection size may be determined based on the right triangle relationship among sleeve height (SH), bottom grip radius (BRC) and constant VD shown in FIG. 9E.

It will be discussed how a selected palm protection size can extend first PIPs & T-MCP open stage and delay second MCPs & CMC open stage by keeping MCPs & CMC relaxed open angle close to their open angle limit in SHWT glove. MCPs & CMC's open angle limit in SHWT glove is limited by arc C and arc B based structural stretch/expansion limit.

Keeping MCPs & CMC relaxed open angle close to their open angle limit in SHWT glove is one factor to delay or reduce large extra-stretch-force that may be needed during second MCPs & CMC open stage.

To reduce hand using extra-stretch-force toward palm protection section during PIPs & T-MCP open stage, selected sleeve height (SH) may be close to the height range between average PIP joints' height and thumb's T-MCP joint height when hand is fully inserted in a SHWT glove with relaxed open posture as shown in FIGS. 8B & 8C. Selected sleeve height (SH) may deviate within this range. Height 100*f*-H (in FIGS. 5B, 15E & 21C) equals to this selected sleeve height (SH) plus center conjunction area wall thickness 505 (shown in FIG. 21C). The height of dome top center 007 (in FIG. 8A) is equal to this selected sleeve height (SH) plus center conjunction area wall thickness 505 (shown in FIG. 21C).

FIGS. 2B, 5D, 6A, 8B & 8C show the relative position of finger joints to the sleeve height (SH) of a SHWT glove when the sleeve height (SH) is in the range between average PIP joints' height and thumb's T-MCP joint height. FIGS. 5D & 8B show the index finger crease 282 below the sleeve height (SH) (sleeve height (SH) not illustrated in FIGS. 5D and 8B, see FIG. 8A for one example of sleeve height (SH)) and I-PIP joint 292 at (or around) the sleeve height (SH) (refer FIGS. 8B & 8C). FIGS. 2B, 5D, 6A, 8B & 8C shows that the same situation may apply to PIP joints 293 & 294 with their height close to the sleeve height (SH) (refer FIG. 2A for joint numbers). FIG. 8C shows the height of inserted T-MCP joint 271 is higher than average PIPs but not far from the sleeve height (SH).

Referring to FIGS. 5D, 6A, 8B & 8C, SHWT glove's top skirt wall (including SW03 notch or SW05 notch wing) may wrap around all PIPs (refer FIG. 2A, 2B, but P-PIP 295 not show in diagram). Part of the top skirt wall and notch or notch wing in SW03 or SW05 may create extra space for T-MCP joint 271 and its upper thenar eminence bump. (Refer to FIGS. 5D, 6A & 7A).

During the first PIPs & T-MCP open stage, each finger sleeve may be driven outward by the pivot movement of inserted fingers' PIPs and T-MCP joints. In a SHWT glove with sleeve height (SH) in the range between average PIP joints' height and thumb's T-MCP joint height, the location of sleeve's pivot point during PIPs and T-MCP joints' movement may be close to that of the PIP joints pivot point (refer FIGS. 8B and 8C). When sleeve height (SH) closely matches average PIPs and T-MCP joints' pivot point, a user's hand may only incur extra-bend-force to bend palm protection section and open sleeves outward.

Even though T-MCP joint sits higher than all PIP joints (Refer FIG. 8C), it is still close to the above-mentioned sleeve height (SH) and its outward move is still dominated by extra-bend-force without too much extra-stretch-force. This is because thumb's outward move involves both T-MCP and T-DIP joints, hence T-MCP outward move range is smaller than all PIPs illustrated in FIG. 8C. In addition, T-MCP is located near top skirt's notch or notch wing area which may provide extra space to avoid stretching skirt wall even though it is close to thenar eminence area.

A SHWT glove with sleeve height (SH) in the range between average PIP joints' height and thumb's T-MCP joint height may allow these joints to use small extra-bend-force during open wide action and avoid the large extra-stretch-force that may otherwise be needed in order to deform the palm protection section. Dome top center 007 shown in FIG. 8A may move up and down during open/close action, but the force applied to the center conjunction area may be mostly bending force.

If sleeve height (SH) is lower than all inserted fingers' average PIP joint height, for example sleeve height (SH) is around the middle point between I-PIP and I-DIP (refer FIGS. 8C & 15E's SHL), PIP joint open wide pivot move may stretch/expand the palm protection section, therefore causing hand to use extra-stretch-force.

FIG. 15E illustrates that using finger protection body 100*f*'s dimensions as a reference, when bottom grip radius (BRC) is increased to BRCL, sleeve heigh (SH) will be decreased to SHL. The abbreviation "BRCL" represents the bottom grip radius (BRC) for one example of a SHWT glove that has a larger bottom grip radius (BRC) than a SHWT glove to which it is being compared. The abbreviation "SHL" represents the sleeve height (SH) for one example of a SHWT glove that has a shorter sleeve height (SH) than a SHWT glove to which it is being compared. A reduced SHL may force arc C upper segment to become flatter (illustrated as arc CL with flatter upper segment in 2D section view in FIG. 15E) and create a shorter (or lower) finger protection body compared to finger protection body 100*f*. With arc C length stay relatively constant, arc C length is approximately the same as arc CL. The abbreviation "arc CL" represents the arc C line for one example of a SHWT glove that has a similar length arc C line as a SHWT glove to which it is being compared. A short sleeve body (illustrated in FIG. 15E's 2D extended sleeve shape) with reduced SHL may cause all PIP and T-MCP joints (refer to FIGS. 2A, 8B and 8C) to sit higher than SHL level. In this case top skirt wall may need to extend higher to protect the above exposed PIP and/or T-MCP joints.

Finger sleeve with height SHL has its pivot point during PIPs and T-MCP joints' pivot movement still close to these joints' pivot point located at these joints' height level.

With short sleeve height SHL (FIG. 15E), SHWT glove palm protection section will sit lower than PIP and T-MCP joints. During the first PIPs & T-MCP open stage, when PIPs and T-MCP joints pivot outward to straighten fingers and move sleeves outward, they may not only bend sleeves and palm protection section outward but also stretch/expand palm protection section including virtual dome roof and lightly wrapped top skirt wall (refer FIGS. 8B, 8C and 15E).

The distance between short sleeve height SHL and original sleeve height (SH) will be proportional to its corresponding palm protection stretch/expanding distance. Hence the short height SHL based sleeve body may introduce extra-stretch-force to expand the lower sitting palm protection section.

A short sleeve height SHL based SHWT glove may need to extend its top skirt wall higher to protect the exposed PIP and/or T-MCP joints which may add extra stretch force.

A finger sleeve with short sleeve height SHL may reduce sleeve clamping force towards inserted fingers. The gap space 288 shown in FIG. 8C in a sleeve with short sleeve height SHL in FIG. 15E may shift towards the lower part of the inserted thumb. The same situation applies to other fingers. The shifted down gap space may reduce contact surface between finger sleeve wall and inserted fingers leading to reduced finger sleeve clamping force and reduced (or lack of) fit around middle part of the fingers. As described before, this may be problematic for a vertically single inserted thumb as illustrated in FIG. 8C which may cause finger slipping and affect SHWT glove gripping/grabbing performance.

In addition, short sleeve height SHL forming a low and flatter virtual dome space underneath the palm may force hand to use more extra-bend-force to center grip/grab an object taller than dome height SHL such as a long object OL in FIG. 8D. The extra-bend-force may result in un-natural hand gripping experience due to extra SHWT glove structural deformation.

If we increase sleeve height (SH) further above T-MCP joint 271 level, it may reduce bottom grip radius (BRC) and ISD length and create a small palm protection section as sleeve height (SH) and bottom grip radius (BRC) length are inversely proportional. Reduced bottom grip radius (BRC) and ISD may increase the chances that SHWT glove needs to open wide to grip/grab an object and therefore increase the chance that a hand may need to use extra open-force.

A small palm protection section may cause second MCPs & CMC open stage to occur earlier in the hand open wide process as the initial MCPs & CMC open angle is smaller than that in a SHWT glove with sleeve height (SH) in the range between average PIP joints' height and thumb's T-MCP joint height. This may lead to muscle fatigue due to the four MCPs (except T-MCP) and CMC joints using the large extra-stretch-force to expand small palm protection section earlier.

In a SHWT glove with sleeve height (SH) in the range between average PIP joints' height and thumb's T-MCP joint height, the ability to pick up certain spherical object sizes may be limited by arc C and arc B length for center and inter sleeve grip/grab. However, with a too-small palm protection section, second MCPs & CMC open stage may occur earlier and a hand in the SHWT glove might also reach palm protection section structural stretch/expansion limit before the arc C and arc B based structural stretch/expansion limit.

A small palm protection created by high sleeve height (SH) with its palm protection section structural stretch/expansion limit reached earlier and limiting all finger sleeves to further open wide may not allow all finger sleeves (suppose all inserted fingers are straightened out) to reach the equator of targeted (spherical) object limited by arc C length.

Once we determine a sleeve height (SH), bottom inter sleeve distance ISD and bottom grip radius (BRC) length and therefore palm protection section size can be determined. In one aspect, the ratio of average length of all bottom grip radius (BRC) s to sleeve height (SH) may be in a range between 1:0.9 and 1:1.65. When defining bottom grip radius (BRC) to sleeve height (SH) ratio, bottom grip radius and sleeve height (SH) may be measured when a SHWT glove is in a neutral position, for example on a flat, level surface with the tips of the finger sleeves on the surface, with no user's hand inside (which also means sleeve body has no distortion by inserted fingers).

A palm protection section with selected sleeve height (SH) and selected bottom grip radius (BRC) length may allow inserted hand in SHWT glove to stay in relaxed open posture before any open/close action. Hand in relaxed open posture in SHWT glove may help reduce hand extra-open-force during open wide action by presetting the initial angle of PIPs, MCPs, T-DIP, and CMC joints.

In one aspect, PIPs, T-MCPs and T-DIP joints relaxed open angle may be in the middle, between maximum open and minimum close angle, but generally closer to maximum open angle, which may mean less open pivot movement than close pivot movement. This angle may match the finger muscle's weaker ability to open as compared to the finger muscle's stronger ability to close.

In FIGS. 8B & 8C, all MCPs and CMC joints (Refer to FIGS. 2A, 8B and 8C) are at their relaxed open angle which is already close to their maximum open angle to reach SHWT glove 100 arc C and arc B based structural stretch/expansion limit. Bottom grip radius (BRC) length determined by sleeve height (SH) in the range between average PIP joints' height and thumb's T-MCP joint height may allow inserted MCPs and CMC joint's to be in relaxed open angle close to their maximum open angle leading to reduced extra-stretch-force during open action.

At the end of first PIPs & T-MCP open stage, all PIPs, T-MCP and T-DIP pivot movement outward to straighten all five fingers may stretch SHWT glove 100 close to arc C and arc B based structural stretch/expansion limit. Therefore, during second MCPs & CMC open stage, MCPs and CMC joints further move outward a relatively small amount from relaxed open angle to their maximum open angle to reach arc C and arc B based structural stretch/expansion limit.

MCPs and CMC's relatively small further pivot movement with five straight fingers may reduce hand extra-stretch-force which is one factor leading to hand fatigue.

In addition, this second MCPs & CMC open stage has already been delayed by all PIPs, T-MCP and T-DIP pivot movement outward action with straightened five fingers.

Most large objects requiring open wide action may only need one or more PIPs, T-MCP and T-DIP pivot movement outward which may only incur extra-bend-force in order to bend the finger sleeves, palm protection section and skirt wall outward, with little or no extra-stretch-force involved. This may avoid or delay extra-stretch-force dominated second MCPs & CMC open stage that contributes to hand fatigue.

Second MCPs & CMC open stage may only occur when attempting to grab an object that is close to the maximum size of a spherical object that may be gripped, which is determined by arc C and arc B.

A selected palm protection size determined by both sleeve height (SH) and bottom grip radius (BRC) length and their ratio is one factor to keep MCPs and CMC joints in a relaxed open angle close to a maximum open angle, which may delay and reduce extra-stretch-force during open wide action and reduce hand fatigue while opening.

Selected palm protection size may help second MCPs & CMC open stage reach arc C and arc B based structural stretch/expansion limit but avoid reaching palm protection section structural stretch/expansion limit earlier. The purpose of avoiding hand reaching palm protection section structural stretch/expansion limit before arc C and arc B based structural stretch/expansion limit is to reduce hands extra opening force during wide open action in SHWT glove. An appropriately selected palm protection size may also delay extra-stretch-force experienced by a user and help in grabbing a maximum size spherical object, such that SHWT glove reaches palm protection section structural stretch/expansion limit later than it otherwise would have.

A selected palm protection section based on sleeve height (SH) in the range between average PIP joints' height and thumb's T-MCP joint height may match the palm size of a human hand as illustrated in FIG. 14C top isometric view and its related two perspective views in FIGS. 14A and 14B. Such palm protection section in SHWT glove is similar to a fitted palm protection section of a conventional five finger glove, which allows the hand to perform open/close action more naturally.

The palm protection section's external transverse cross section circumference is defined as finger protection body 100*f*'s circumference at the top edge, which is also the top skirt's circumference at the base connected to the finger protection body 100*f*. For the top skirt SW03 in SHWT glove 100, since the skirt wall is near vertical and top skirt transverse size is close to finger protection body 100*f*'s top edge circumference, FIGS. 14A, 14B & 14C show either top or bottom dimension of SHWT glove 100 may illustrate a close match between a user's palm and SHWT glove's palm protection section.

With relative constant VD length, we can increase or decrease the above-mentioned palm protection section size by varying sleeve height (SH) in the range between average PIP joints' height and thumb's T-MCP joint height and/or varying bottom grip radius (BRC) to sleeve height (SH)'s ratio between 1:0.9 and 1:1.65. The resulting palm protection section size may still be close to a user's palm size such as SHWT glove 100 shown in FIGS. 14A, B & C.

As stated above, when SHWT glove's palm protection section size matches a user's palm size, arc B and arc C length under their respective upper limit rule become a constraining factor to how wide a hand can open. This relates to the maximum spherical object SHWT glove can grab with both center grip/grab constrained by arc C and inter-sleeve grip/grab constrained by arc B.

FIGS. 16A & B illustrate SHWT glove 133 has horizontal U/V grooves 530 added to center palm protection area and extending down sleeve interior wall to around PIPs crease level (around where the finger of a typical user would crease-refer to finger crease 282 in FIGS. 5D & 8B). FIG. 16C shows the horizontal U/V grooves cross section view 530C. HUV arc C shown in FIG. 16C and similarly HUV arc B (not shown in FIG. 16C) embed horizontal U/V grooves 530 to replace the original arc C and arc B respectively.

FIGS. 16A, 16B, 16C and 16D show horizontal U/V grooves 530 in SHWT glove 133 and SHWT glove 136 are running relatively orthogonal to HUV arc B and HUV arc C (or original arc B & arc C) curve line. FIG. 16C shows the horizontal U/V grooves cross section view 530C. Refer to FIGS. 16A, 16C & 16D, the horizontal U/V grooves 530 turn upward along the top skirt wall and extend to the top skirt edge to become vertical U/V grooves 531 shown in solid circle. Vertical U/V grooves 531 may be located between inter-arc-bridge wing and notch wing and may be fused together with inter-arc-bridge wing and notch wing.

Adding horizontal U/V grooves 530 orthogonal to arc C and arc B curve line may create adaptive HUV arc B and HUV arc C such that their lengths can increase or decrease during hand open/close action.

FIG. 16C shows cross-section of the horizontal U/V grooves 530C. When hand opens wide to the SHWT glove hand maximum open posture, the horizontal U/V grooves 530 can be expanded, which will increase HUV arc B and HUV arc C length. When hand closes to form a tight grip, the horizontal U/V grooves 530 can be folded which will reduce HUV arc B and HUV arc C length.

As horizontal U/V grooves 530 can be folded tighter which reduces the HUV arc B and HUV arc C length to the minimum when hand is in tight grip posture, this reduced minimum HUV arc B and HUV arc C length may follow projected-arc-MR and projected-arc-MI average length and ARC tight grip C length limit rule illustrated in FIG. 15 respectively.

We use HUV arc C as an example to explain how reduced minimum HUV arc C length when folded tight may not exceed ARC tight grip C length. The same reason applies to HUV arc B length upper limit rule.

Suppose HUV arc C can either extend or reduce arc C length by X. In a selected SHWT glove such as SHWT glove 100 with original arc C length, when hand wearing SHWT glove is in tight grip posture and reaches ARC tight grip C length, arc C length will almost reach ARC tight grip C length limit and not push against the palm protection section, while arc C length with horizontal U/V grooves can further reduce arc C to its minimum length equal to "arc C−X".

This extra reduced X length due to horizontal U/V grooves' tight folding effect can be added back to arc C and still not exceed ARC tight grip C length limit. This new "arc C+X" length becomes the HUV arc C length for a selected SHWT glove such as SHWT glove 133 or 136 shown in FIGS. 16C & 16D.

In SHWT glove 133 shown in FIG. 16C with HUV arc C=arc C+X, as hand reaches ARC tight grip C length in tight grip posture, horizontal U/V grooves 530 folded tight will lead to HUV arc C length reduced by X, which is "arc C+X"−"X" equal to the original arc C length.

The above discussion explains why HUV arc C may be longer than original arc C by X. When horizontal U/V grooves fold tight, HUV arc C may reduce to original arc C length and still meet ARC tight grip C length limit rule.

HUV arc C and HUV arc B may be longer than arc C and arc B by their extra folded length and still meet the arc C and arc B upper limit rule.

As SHWT glove 133's HUV arc C shown in FIG. 16C is longer than SHWT glove 100's arc C by length X, VD length will also increase proportionally to HUV VD (not shown in FIG.).

When we keep the palm protection section in SHWT glove 133 the same size as that in SHWT glove 100, bottom grip radius (BRC) may remain the same length and sleeve height (SH) may proportionally increase to HUV SH shown in FIG. 16C.

HUV SH may be higher than original sleeve height (SH) with horizontal U/V grooves added around PIPs or T-MCP joints level which may reduce extra-stretch-force incurred by four MCPs and CMC joint pivot open movement. Higher HUV SH compared to sleeve height (SH) in a SHWT glove without horizontal U/V grooves may be more above average PIP joints height.

As discussed earlier (example shown in FIG. 15E), the distance between a lower sleeve height SHL and a sleeve height (SH) at average PIP joints height will be proportional to its corresponding palm protection stretch/expanding distance by PIPs and T-MCP joint open pivot move.

A similar rationale applies to MCPs and CMC joints. As HUV SH is higher than sleeve height (SH) in a SHWT glove without horizontal U/V grooves and makes the sleeve height closer towards the higher MCPs and CMC joints level, it may decrease extra-stretch-force incurred by MCPs and CMC joints open pivot movement.

HUV SH higher than sleeve height (SH) in a SHWT glove without horizontal U/V grooves may reduce extra-open force incurred by one or more PIPs, T-CMP and T-DIP joints especially when bottom grip radius (BRC) determined palm protection section size is kept the same size.

HUV arc *C maximum* expanding length will be HUV arc C+X or equal to "arc C+2X" and HUV arc B maximum expanding length will be HUV arc B+X or equal to "arc B+2X" when hand reaches SHWT glove hand maximum open posture.

Expanded HUV arc B and HUV arc C length will proportionally increase both palm protection section structural stretch/expansion limit and arc C and arc B based structural stretch/expansion limit (the maximum SHWT glove structural stretch/expansion limit may be equal to arc C+2X and arc B+2X).

This may reduce both extra-bend-force and extra-stretch-force during hand open/close action and especially the extra-stretch-force during MCPs & CMC open stage.

Increased HUV arc B and HUV arc C length during hand open wide process may allow hand wearing SHWT glove to open wider and therefore increase the maximum object size constrained by original arc C and arc B for both center and inter sleeve gripping.

The reduced length of HUV arc C and HUV arc B from their initial length to their minimum length and increased length to their maximum length do not have be the same like in the above illustrative example that both have the same reduced and increased length by X. The reduced length and increased length may be different based on different horizontal U/V groove structure design.

The horizontal U/V grooves' shape, size and their numbers can be adjusted, such that the width, height, thickness or number of U/V grooves can change based on wall material thickness of the SHWT glove and how much structural expansion is to be achieved.

Horizontal U/V grooves may be implemented at different parts of the SHWT glove body. In one aspect, horizontal U/V grooves may be implemented at center palm protection section which comprises arc bridge sections 108 and the center conjunction area 103 (see FIGS. 1B & 1D). In one aspect, horizontal U/V grooves may be implemented along finger sleeve interior wall. Horizontal U/V grooves may be included in three or four finger sleeve SHWT gloves and may be included with other aspects not explicitly illustrated herein.

Horizontal U/V grooves may be added along finger sleeve interior wall at different % of the sleeve height (SH). In one aspect, horizontal U/V grooves may be added at the sleeve height (SH) close to each finger joints pivot move average height (such as PIPs and T-MCP) to reduce extra-bend-force during hand open/close action. Horizontal U/V grooves 530 in SHWT glove 133 shown in FIG. 16A is implemented close to and above the average crease height of PIP joints to demonstrate that it may reduce PIP joints extra-bend-force toward sleeve body during hand open/close action.

We may also add a couple of extra small (or narrow) horizontal U/V grooves at average level of DIP joints along sleeve interior wall 109C (FIG. 1D) to reduce DIP joints extra-bend-force toward sleeve body during hand open/close action.

Horizontal U/V grooves added at DIP joints level may extend arc B and arc C by some range via sleeve body deformation as the vertical height of sleeve exterior wall 104C in FIG. 1D is constant.

Adding horizontal U/V grooves may reduce the stiffness of the SHWT glove body. Therefore, we may increase the material thickness of the horizontal U/V grooves or add structural strength to prevent SHWT glove body from collapsing in a standing position.

For the purpose of SHWT glove sleeve design, we may divide each finger sleeve into three parts along its longitudinal axis: the top sleeve aperture 903, the mid sleeve section 902 and the bottom sleeve section 901 illustrated in FIGS. 9A, 9B, 9C & 9D cross section views.

In FIGS. 9A, 9B, 9C & 9D (also refer to FIG. 1), the top sleeve aperture 903 may be integrated with the palm protection section which may be formed by arc bridge section 108, center conjunction area 103 and top skirt. There is not a clear line to separate the top sleeve aperture 903 from the mid sleeve section 902. We may consider the top sleeve aperture 903 to include the part of the sleeve at the top where the sleeve interior wall curving towards the arc bridge section 108 before the interior wall transitions into a more straight and vertical shape towards the bottom.

In FIGS. 9A, 9B, 9C & 9D, the bottom sleeve section 901 is the bottom part of the finger sleeve including the tip. Bottom sleeve section 901 accommodates the inserted finger from the fingertip to at least the base of the nail (Refer position of thumb 211 in FIGS. 8B & 8C). The mid sleeve section 902 is the part of the sleeve between the top sleeve aperture 903 and the bottom sleeve section 901, which may cover the thumb DIP joint section if thumb is fully inserted into the sleeve.

The division of the three sleeve sections need not be precise as the finger sleeve is one integral piece from top to bottom. Furthermore, different variations of SHWT glove's sleeve design may result in the division of the three finger sleeve sections deviating in a certain longitudinal height range.

We will describe aspects of the SHWT glove's 3D finger sleeve design. They include:

1) Finger sleeve transverse cross section shape and size design from mid sleeve section centered by T-DIP joint down to sleeve tip; Finger sleeves from SHWT 100 and SHWT glove 230 are used as reference for sleeve clamping force analysis and structural shape design. Later section covers general design of SHWT sleeve 3D shape categorized into convex loop and mixed loop shapes with their respective width (OW) to height (OH) ratio defined at different percentage (%) of sleeve height (SH).
2) Finger sleeve longitudinal cross section shape design from mid sleeve section down to sleeve tip (refer to FIGS. 8A, 8B & 8C and FIGS. 9A, 9B, 9C & 9D);
3) Finger sleeve front view shape design focusing on the bottom sleeve section (refer to FIG. 2A, FIG. 5A & FIG. 12A SHWT glove 100 front sleeve). The front view shape is isometric view along grip radius (RC) direction as shown in FIGS. 12A II & III.

The top sleeve aperture may be integrated with the palm protection section which forms the virtual dome roof and its arc C upper segment curve following the curvature of parallel inserted index and/or middle finger (refer FIGS. 8B & 8C). Refer to top sleeve aperture shape 2D view in FIGS. 9E and 9F. The design of the top sleeve aperture is covered in the palm protection section.

We will use the transverse cross section at the cross section cutting plane shown in FIG. 2C to illustrate the design of the finger sleeve's transverse cross section. The finger sleeve section around this plane is the mid sleeve section which at least encloses the T-DIP joint section of single inserted thumb.

Refer to FIGS. 8B & 8C, thumb's T-DIP joint may be higher than the rest of fully inserted fingers DIP joints, hence we choose T-DIP joint segment middle level T-DIP-H shown in FIG. 2C or 10A as transverse cross section cutting plane as a reference for better representation of the sleeve dimension, shape, sleeve deformation and sleeve clamping force toward inserted fingers.

Above this T-DIP joint segment middle level cutting plane, the finger sleeve's transverse cross section may deviate and transition toward the top sleeve aperture shape, which may increase the sleeve size. Below this cutting plane, the finger sleeve's transverse cross section may deviate and transition toward the bottom sleeve section which has different shapes listed in FIGS. 9A, 9B, 9C, 9D, 21D and 21E.

We will use the longitudinal cross section at the cutting plane along the arc C plane shown in FIG. 8A to illustrate the design of the finger sleeve's longitudinal cross section. FIG. 8A shows sleeve center cutting planes along arc C has inter plane angle of 120 degree due to SHWT glove 100's rotational symmetric property. The 120 angle is also the angle between neighboring bottom grip radius (BRC) on the SHWT glove transverse cross section. FIG. 8B illustrates side view of the longitudinal cross section cutting shapes relative to inserted index finger and FIG. 8C illustrates them relative to the inserted thumb.

Previous gloves on the market have each finger sleeve designed for one finger insertion only. The finger sleeve transverse cross section shape is close to circular when finger is inserted. When a human finger is inserted into said finger sleeve made of elastic/soft material with matched finger circumference, there will be little or no gap space between the finger and the finger sleeve. The sleeve size tightly matches the finger size and creates a tight wrapping effect, and possibly with no air flow in and out assuming one end of the finger sleeve is closed.

Such finger sleeve will make finger insertion and removal not smooth and even difficult. That's why a second hand is needed to help put on and take off the glove from the wearing hand. This is especially problematic when a large sized finger or multiple fingers need to insert into a relatively tight fitted finger sleeve. Fingers may be trapped inside a round finger sleeve due to both wrapping effect (due to maximum finger sleeve contact friction) and air tightening effect (due to no air flow). In this case, a second helping hand is needed to put on and take off the glove from the wearing hand.

The finger sleeves of the SHWT glove provide for single or multiple finger insertion per sleeve, and at the same time each finger sleeve can also generate enough clamping force to securely hold a single inserted finger such as parallel inserted thumb, index, middle or non-parallel inserted ring finger inside and prevent them from slipping out.

Three finger insertion into a single sleeve in a three sleeve based SHWT is also possible with non-parallel inserted middle, ring and part of pinky finger in a single sleeve. Note: pinky finger may not fully insert into sleeve in this case as it is shorter than ring finger.)

The SHWT glove may employ finger sleeves of large transverse cross section circumference to accommodate one, two, or more fingers in a given finger sleeve. Finger sleeves appropriately shaped and sized help prevent fingers from being trapped inside the sleeve due to tight wrapping and air tightening effect.

The circumference of each sleeve's transverse cross section from mid sleeve section toward sleeve tip may be greater than circumference 210 (in FIG. 2D) of the inserted fingers' transverse cross section at the same % of the sleeve height (SH).

As illustrated in FIG. 2D, circumference 210 of the inserted fingers excludes the finger circumference segments enclosing the inter finger gap 218*b* (FIG. 2D) and is replaced by sleeve wall length at inter finger gap 218*b* (cross-section), plus cross-section circumference segment at finger to sleeve contact areas and finger side length at two sleeve side gaps 218*a* (FIG. 2D).

The minimum circumference of the sleeve's transverse cross section from mid sleeve section to sleeve tip may be larger than circumference 210 of either the index & middle fingers combined or the middle & ring fingers combined in a three sleeve based SHWT glove. The reason to choose circumference 210 of either index & middle or middle & ring finger combined as design reference is because they represent the majority of the two finger insertion combinations in a three sleeves based SHWT glove. In addition, circumference 210 of either index & middle or middle & ring finger combined are larger than circumference 210 of other 2 fingers combined in a hand, such as ring & pinky. Depending on different hand anatomies, some hand may have circumference 210 of index & middle larger than that of middle & ring. Some hand may have circumference 210 of middle & ring larger than that of index & middle. The average of the circumference 210 of index & middle and middle & ring may be used as design reference. For four sleeve based SHWT glove, circumference 210 of ring & pinky finger combined may be used as design reference as this finger combination may be the most common in a four sleeve based SHWT glove.

When three fingers need to insert into one finger sleeve in a three sleeve based SHWT glove, one way to wear SHWT glove is to have the middle, ring and pinky finger in one sleeve. The pinky finger is shorter than the other two fingers therefore may not fully insert into the bottom of the finger sleeve. The gradually larger sleeve circumference from the mid sleeve section to the top sleeve aperture due to sleeve interior wall curving towards arc bridge section 108 (and center conjunction area 103) creates more room for three finger insertion in above case. The elastic stretchable sleeve material may allow extra room to accommodate insertion of three fingers.

In the case when there are some sleeve wrapping effects for the three finger insertion, there are a few ways for the fingers to move out of the sleeve without the help of a second hand as discussed below.

When we use large circumference finger sleeves relative to the inserted fingers, fingers may not be securely nested and may accidentally slip out of the finger sleeve. Therefore, we may use selected finger sleeve shape design to complement the large sleeve size. A large sleeve size with selected shape design can improve the sleeve's clamping force towards the inserted fingers so that fingers are less likely to accidentally slip out of the sleeve while they can also pull out of the sleeve easily when desired without the help of a second hand.

The sleeve shape design may also help prevent SHWT glove from collapsing during finger insertion.

As mentioned earlier, sleeve's transverse cross section at the transverse cross-cutting plane T-DIP-H height in FIG.

2C will be used to illustrate the design. FIG. 2D is the bottom isometric view of the sleeve's transverse cross section at the transverse cross-cutting plane looking from the bottom of the glove with a finger insertion combination.

For the purpose of finger sleeve design, we approximate the shape of a human finger's transverse cross section as an oval close to a circle as it is close enough especially with some deformation of the finger skin. As an illustration, FIG. 11C shows an oval cross section of middle finger 213C and its oval height 213C OH.

To estimate a finger's transverse cross section shape, using thumb's T-DIP joint transverse cross section as an example, one method is to sample a single transverse cross section cutting shape. However, as T-DIP joint is not straight with its uneven surface containing crest or DIP bump 800 (refer FIGS. 8B & 8C), we can sample a couple of transverse cutting shapes evenly along T-DIP section altitude shown in square segment in FIGS. 2C & 10A and calculate the T-DIP average shape 207. The rest of fingers' transverse cross section shape may use the above method to get a more effective shape and dimension reference.

FIG. 10 illustrates some examples of finger sleeve transverse cross section shape. All finger sleeves in FIG. 10 have transverse cross section width OW to height OH ratio>2:1. Sleeve transverse cross sections from T-DIP-H cutting level down to sleeve tip as shown in FIGS. 2C & 10A may have OW to OH ratio>2:1 and the ratio increasing towards 0% of the sleeve height (SH) (refer FIGS. 21D & 21E). Sleeve transverse cross section can be designed as line symmetric along grip radius (RC). All variations shown in FIG. 10 are line symmetric. Finger sleeve's transverse cross section line symmetry is not required however line symmetry improves the universal fit for either the left hand or the righthand wear. An SHWT glove with non-line symmetric finger sleeve may create a different feel for the left hand vs. the right-hand wear, but with soft or elastic glove material, it may still provide a near universal fit. The comparison is shown in FIG. 13C of SHWT glove 100 with line symmetric finger sleeve and FIG. 13D with non-line symmetric finger sleeve.

Considering a finger sleeve that handles single finger insertion, the sleeve's transverse cross section height (OH) (show in FIGS. 10B & C) may be smaller than a single parallel inserted thumb's transverse cross section oval height shown in the top sleeve case in FIG. 2D or use the T-DIP average shape 207 in FIG. 2C as reference. Thumb's oval height is a design reference because the thumb usually occupies one finger sleeve in a three sleeves based SHWT glove.

For three sleeves based SHWT glove, index finger is usually parallel inserted together with middle finger in one sleeve. However, thumb and index finger may each occupy a single sleeve. If we need to design for single index finger insertion into single sleeve, the finger sleeve transverse cross section height (OH) can be reduced to be the same or smaller than parallel inserted index finger's oval height.

For four sleeves based SHWT such as SHWT glove 250 in FIGS. 13A & 13B, considering the case of single index finger insertion in single sleeve, finger sleeve's transverse cross section height (OH) may be the same as or smaller than single parallel inserted index finger's oval height.

As illustrated in FIG. 2D top sleeve of SHWT glove 100, finger sleeve's transverse cross section height (OH) may be limited to be no longer than the thumb's oval height so that the inserted thumb can deform and expand both sides of the sleeve wall along the height (OH) direction. The deformed sleeve wall increases the static friction at the contact surface with the thumb to create a clamping force to hold the thumb inside the finger sleeve. The clamping force may mostly occur in the middle of the finger sleeve (transverse cross section) along the height (OH) direction since a single inserted finger is mostly positioned around the middle of the finger sleeve such as thumb 211C shown in FIG. 2D.

For single finger insertion, the sleeve size is larger compared to that of the single finger and most of the clamping force occurs in the middle of the finger sleeve's interior and exterior walls, therefore tight wrapping effect causing finger to be trapped inside the sleeve is not a concern. The finger sleeve's transverse cross section height (OH) may be further reduced if more clamping force is desired. When single finger is parallel inserted into the finger sleeve and stays in a relaxed open posture, the T-DIP or I-DIP joint bump 800 (shown in FIGS. 8B & C) on each finger is slightly curved. The front and back side of the curved finger may bump against and deform the relatively straight finger sleeve interior and exterior walls (interior wall 109C and exterior wall 104C shown in FIG. 1D) at mid and bottom sleeve sections. This creates additional clamping force to hold a single finger inside the sleeve.

Other fingers' slightly bent DIP joint shape compared to relatively straight mid to lower sleeve body may create extra clamping force, similar to T-DIP or I-DIP joint case.

When multiple fingers are inserted into a single finger sleeve, more clamping force may be generated compared to a single finger insertion, since circumference 210 of the multiple fingers (in FIG. 2D) are larger than that of a single finger. They can easily deform both the sleeve interior wall 109C and the exterior wall 104C (shown in FIG. 1D) to create enough clamping force. FIG. 2D illustrate multiple finger insertion at the lower left and lower right sleeves and how the sleeves' transverse cross section is deformed.

FIG. 11C shows middle finger 213C inside SHWT glove 230's finger sleeve 231C as an example. Finger sleeve 231C (the same sleeve from SHWT glove 230 shown in FIG. 10B) can be considered as divided into two symmetric halves in the middle along the height (OH) direction. Each half of the sleeve has a single corner on the side. When multiple fingers are parallel inserted into the sleeve, the finger occupying each side of the sleeve may deform the corresponding side corner.

FIG. 11D illustrates finger sleeve deformation in more detail with SHWT glove 100's finger sleeve 101C as an example. When both index finger 212C and middle finger 213C are parallel inserted into one finger sleeve, the middle finger 213C in FIG. 11D deforms the right half of the sleeve wall and is clamped by the right-side corner. Similarly, the index finger 212C deforms the left half of the sleeve wall and is clamped by the left side single corner (also refer to FIG. 2D).

When the side corners of the finger sleeve are deformed, additional deformation may occur in the middle of the sleeve. To better illustrate this, we define ARC IN shown in FIG. 11C as the arc in the middle (2D view) of the sleeve interior wall and ARC EXT as the arc in the middle of the sleeve exterior wall. These two arcs connect the two side corners. FIG. 11D illustrates the deformation at ARC IN and ARC EXT in finger sleeve 101C of SHWT glove 100. When index finger 212C and middle finger 213C are parallel inserted, ARC IN and ARC EXT will be stretched to a flatter shape and inter finger gap 218*b* may be reduced. The delta space between the two dashed lines is the extent of deformation at ARC IN and ARC EXT from the original sleeve shape.

The sleeve deformation at two side corners and the side corners' connection arcs in the middle may provide a better fit for the inserted fingers so that fingers in SHWT feel natural when it is grabbing or holding objects, closer to how it feels when a naked hand is grabbing objects.

In contrast to the single finger insertion where the main concern is how to clamp and hold the finger securely inside the sleeve, the main concern of the multiple finger insertion is how to mitigate too much clamping force that makes it difficult for fingers to pull out of the finger sleeve during self takeoff. The side corner shape design of the finger sleeve shown in FIG. 11C or 11D plays a role in improving the sleeve clamping force.

Two aspects of the side corner shape can be adjusted to improve the clamping force of the finger sleeve. They are side corner approximated angle NTA shown in FIG. 11C and side corner sharpness determined by side corner clamp arm length NCA1 (or NCA 2) in FIGS. 11C & 11D and side corner tip effective arc size which we will explain below.

Note here why we use effective arc size is because the side corner tip does not have to be a perfect arc shape but being an approximate arc shape such as those convex segments "b", "c", "d" listed in FIG. 22A.

As Illustrated in FIG. 11C, NTA indicates the approximated angle of the side corner of the finger sleeve. Since the side corner has a round arc rather than formed by all straight lines, NTA is only an approximation of the angle. Adjusting NTA will change width (OW) to height (OH) ratio of the finger sleeve transverse cross section. Generally, a small NTA will create a narrow side corner with high width (OW) to height (OH) ratio which may help to increase the clamping force towards the inserted fingers and a large NTA will create a wide side corner with low width (OW) to height (OH) ratio which may reduce the clamping force, especially for single inserted finger.

As shown in FIG. 11C, ARC 231 of the finger sleeve transverse cross section 231C in SHWT glove 230 is arc shaped and is the tip of the side corner. The effective arc of the side corner tip may have a radius smaller than the arc radius of an inserted finger next to it especially from finger's middle section toward fingertip. Limiting the radius of the side corner tip arc will leave a sleeve side gap 218*a* shown in FIGS. 2D & 11C between the inserted finger and the side corner tip. FIG. 11C illustrates this case that on the right side of the finger sleeve, there is a sleeve side gap 218*a* between inserted middle finger 213C and side corner tip arc ARC231. This gap helps reduce sleeve's tight wrapping and air tightening effect that might trap the fingers inside. It also works as extra buffer space allowing thicker finger insertion.

FIG. 11C shows SHWT glove 230's finger sleeve 231C has side corners with side corner angle NTA, side corner arm length NCA1 and side corner tip arc ARC 231 following the side corner tip arc radius limit rule, FIG. 11D shows SHWT glove 100's finger sleeve 101C has side corners with side corner clamping arm length NCA1 and side corner tip arc ARC101 following the side corner tip arc radius limit rule.

If the side corners in SHWT glove 230 with ARC 231 and NCA1 shown in FIG. 11C and the side corners in SHWT glove 100 with ARC 101 and NCA1 shown in FIG. 11D has excessive clamping force for thicker or multiple finger insertion, we can make the side corners sharper or extend the side corners. FIG. 11C and FIG. 11D show the original arc ARC 231 and ARC 101 is extended to be an arc ARC2 with smaller radius and longer clamping arm NCA2. This sharper side corner creates less clamping force towards inserted fingers than the original blunt side corner. This is because the sharper side corner with ARC2 as illustrated in FIG. 11C has a larger circumference and extends the sleeve side gap 218*a* by an extra 218*ext* (shown in FIG. 11C).

Compared to blunt side corner with shorter side corner clamp arm (NCA1 in FIGS. 11C & 11D), sharp side corner with longer side corner clamp arm (NCA2 in FIGS. 11C & 11D) allows the sharp side corner to have a smaller variation of deformation and resulting clamping force with smaller variation when different sized (or thickness) fingers are inserted into the finger sleeve. Therefore, sharp side corner has better tolerance for fingers of different sizes than blunt side corner and keeps a relatively constant clamping force.

When multiple fingers are inserted into a single sleeve, the inter finger gaps 218*b* shown in FIGS. 2D & 11D allow air flow and help reduce contact surface and friction between the finger and sleeve wall. In addition, multiple fingers can trigger up and down reciprocal movement against each other to more easily move the fingers out of the sleeve. This is illustrated with index finger 212 and middle finger 213 in FIG. 12A. This reciprocal movement with multiple finger insertion allows the fingers to break free from the finger sleeve, a unique feature not found in conventional gloves where the focus is single-finger-insertion-based sleeve design.

For three finger insertion usually in three sleeves based SHWT glove, such as middle, ring and pinky finger inserted in one sleeve, and thumb and index finger each occupies the other two sleeves, the reciprocal movement between middle, ring and pinky fingers helps to break free from the finger sleeve. In addition, thumb and index finger can easily pull out of their respective finger sleeve. The pulled-out thumb and index finger can then help push against the palm protection section to further help the other three fingers to pull out of their finger sleeve. Therefore, even for three finger insertion into one finger sleeve, there may be no problem taking off the SHWT glove without the help of a second hand or other implement. Single hand removal may be beneficial when the other hand is engaged in a task, dirty or otherwise not available.

As illustrated in FIG. 2D, cross section of thumb 211C (top sleeve), cross section of index finger 212C and cross section of middle finger 213C (lower left sleeve) can parallel insert into SHWT glove 100's finger sleeve, but cross section of ring finger 214C and cross section of pinky finger 215C (lower right sleeve) cannot. FIG. 2A shows the same case in a perspective view. Due to the anatomy of the hand, in a rotationally symmetric SHWT glove, when ring finger and pinky finger are inserted into one finger sleeve, they cannot parallel insert, rather they are inserted with a tilted angle around 30 to 90 degrees and the angle may dynamically change during hand movement.

Since the ring and pinky finger have smaller circumference than thumb, index and middle finger, there might be concern that the finger sleeve will not have enough clamping force to hold ring and pinky fingers inside. However, since ring and pinky fingers are normally nonparallel inserted into the sleeve as shown in FIG. 2D lower right sleeve, the angular inserted fingers may deform the sleeve wall more than parallel inserted fingers do. The extra deformation may create more clamping force in order to compensate for the less clamping force due to the finger's smaller circumference.

In some cases, the pinky finger may stay outside the finger sleeve and leave the ring finger nonparallel inserted inside the finger sleeve. Even though ring finger has a smaller circumference than parallel inserted thumb, the angular insertion of the ring finger can create similar sleeve clamping force.

The sleeve expansion/distortion distance from a non-parallel inserted ring finger may be larger than ring finger's oval height and closer to ring's oval width. This is one reason why sleeve may have enough clamping force toward ring finger insertion. In addition, when ring finger inserts into a finger sleeve by itself, it may naturally curve with its R-DIP and R-PIP joint bent to create a tilted insertion. This tilted insertion of the ring finger may generate some clamping force from sleeve.

FIG. 10 lists some variations of the SHWT glove transverse cross section shape design when the design needs to adjust for different material property, material thickness and some applications.

FIG. 10B shows SHWT glove 230's finger sleeve's transverse cross section. FIG. 11D shows the same finger sleeve in more detail. With this type of sleeve design, when finger sleeves are squeezed together to center grip a small object, a large center gap 180 as shown in the bottom drawing of FIG. 8E may be formed. With a large center gap 180, hand may use extra force (illustrated by arrows in FIG. 8D) to bend/squeeze sleeve wall in the area around center gap 180 in order to reach a small object in the center, especially when sleeve interior wall uses thick material.

The extra sleeve bending force used to deform the sleeve wall to close the center gap 180 in order to reach small object in the center adds to the original extra-bend-force needed to grip object and increase the total extra-close-force required from the hand.

Therefore, the finger sleeve shape of SHWT glove 230 may be a better fit for thin and more flexible materials that can be more easily deformed along the fingers, such that it won't cause fingers to use too much extra sleeve bending/squeeze force when gripping small object at the center as illustrated in FIG. 8E. When hand is gripping small object at the center as illustrated in FIG. 8E, parallel inserted thumb in single finger sleeve may use extra squeeze force toward sleeve interior wall to reach object smaller than the center gap 180.

Referring to FIGS. 10A & 10B, we define 100M1 to be the middle vertex on the sleeve interior wall, and 100M2 to be the middle vertex on the sleeve exterior wall. In this example, 100M1 is the end point of the sleeve transverse cross section height (OH) on the sleeve interior wall and 100M2 is the end point of the sleeve transverse cross section height (OH) on the exterior wall.

FIG. 10A shows SHWT glove 100's transverse cross section is triangular shaped with a small arc radius ARC IN shown in dashed oval circle in FIG. 10A centered by middle vertex 100M1 on the sleeve interior wall in order to reduce the center gap 180 shown in FIG. 8E and improve the performance of gripping small objects. Its ARC IN radius may be the same as or similar to the front arc of the thumb (refer to thumb 211C in FIG. 2D) or that of index finger. Either thumb or index finger may be a design reference because thumb or index finger may occupy one finger sleeve by itself in common uses of the SHWT glove. ARC IN length in non-triangular shaped sleeve transverse cross section may be defined as equal to OW/3 length which may be close to oval shaped thumb or index finger width.

In addition, the SHWT glove 100's finger sleeve's small radius ARC IN is formed by two straight sides that are 120 degrees apart. As illustrated in FIG. 1C or FIG. 8E, the straight sides of the neighboring sleeves facing each other are parallel. The parallel pair of straight sides is also part of the reverse U-shaped tunnel 106. In the case of SHWT glove 100, the external width 105*a* of reverse U-shaped tunnel 106 is the same as the internal width 105*b* of reverse U-shaped tunnel 106 illustrated in FIG. 1C.

Refer to FIG. 8E for comparison. SHWT glove 100's transverse cross section shape resulting in parallel reverse U-shaped tunnel 106 may improve inter sleeve grip/grab performance compared to SHWT glove 230's sleeve transverse cross section shape. In addition. when finger sleeves of SHWT glove 100 are squeezed together, there is less center gap 180 shown in the top drawing in FIG. 8E as compared to the center gap 180 in the bottom drawing for SHWT glove 230. Therefore, SHWT glove 100 finger sleeve design may improve center grip/grab performance, especially for small objects.

Triangular shaped finger sleeve transverse cross section may strengthen the vertical support of the SHWT glove 100, similar to a right angle metal bar (or angle bar with L shaped transverse cross section) used to strengthen construction structure. This helps reduce the likelihood of finger sleeve collapsing when multiple fingers are inserting into a standing SHWT glove.

With both SHWT glove 100 and SHWT glove 230, the finger sleeve's transverse cross section may transition to an oval like shape with high width (OW) to height (OH) ratio larger than 2:1 at bottom sleeve section. Therefore, as illustrated in FIGS. 12B and 12C, there is a center gap 180 near the tips 99 when the finger sleeves are squeezed together to pick up a small object. When the hand uses finger tips to pick up a small object, the fingers naturally rotate and shift at the fingertip to reduce gap between finger tips. As illustrated in FIGS. 12D and 12E, SHWT glove finger sleeve follows the natural rotation and shift of the fingers and reduces the center gap 180 near tips 99, which allows the hand in SHWT glove to pick up small objects such as tiny French fry 301.

Conventional gloves on the market are designed to mainly fit for single finger insertion in one finger sleeve. To optimize the performance of picking up small objects, the fingertip of their sleeve design may closely trace the shape of the inserted finger, which can cause tight wrapping effect.

FIG. 10C shows an alternate transverse cross section shape based on SHWT glove 100's sleeve design in FIG. 10A. The transverse cross section in FIG. 10C has two side corners (shown in left expanded window) on each side of the sleeve with sharper angles than that of SHWT glove 100 to tweak the clamping force at the sides of the finger sleeve. In addition, the sharper side corners may increase the vertical support for the finger sleeve on the sides. It mimics a right-angle bar structure to strengthen the vertical stiffness of the sleeve body to prevent sleeve from collapsing during finger insertion.

In addition, the finger sleeve transverse cross section in FIG. 10C may be modified to have a flat shape 500C on the sleeve exterior wall to replace the original outward arc shaped section of the finger sleeve in FIG. 10A. This is an alternative design that may increase clamping force for single parallel inserted fingers. The sleeve exterior wall may be inward arc shaped which may provide better clamping force for single inserted finger.

Another method to improve finger sleeve clamping performance is to embed vertical U/V grooves along the finger sleeve's exterior wall. FIGS. 10D & 10E show vertical U/V grooves (531C in a transverse cross section view) added to finger sleeve exterior wall to make the sleeve more adaptive to various finger insertions with different number of fingers and fingers of different sizes. When vertical U/V grooves have sharp corners, it is more of a V shape than a U shape. Both "U" and "V" shaped vertical U/V grooves are acceptable.

FIG. 10D shows SHWT glove 130's finger sleeve is embedded with vertical U/V grooves (531C in a transverse cross section view). FIG. 13E and FIG. 13F show SHWT glove 130 based on SHWT glove 100 design having all three finger sleeves embedded with vertical U/V grooves 531 running vertically along the sleeve exterior wall and may disappear near the sleeve tip as shown in FIG. 13F expanded window.

Finger sleeve with vertical U/V grooves has an adaptive transverse cross section circumference that may adapt to different circumference 210 of inserted fingers (FIG. 2D). The adaptive sleeve circumference may be useful for three finger insertion such as middle, ring and pinky finger into one finger sleeve or two unusually large/thick fingers inserted into one finger sleeve.

When vertical U/V grooves are implemented in four sleeves based SHWT glove, it may assist the sleeve clamping force for both single and two fingers insertion.

In one aspect, a finger sleeve without the vertical U/V grooves is available for the insertion of two fingers of slim size with small circumference 210 (in FIG. 2D). Finger sleeve with fixed transverse cross section circumference such as those illustrated in FIGS. 10A and 10B may mostly use the side corners' design and a ratio of width (OW) to height (OH) greater than 2:1, for example, in three sleeve based SHWT glove, to control the clamping force.

When two large/thick fingers or three fingers are inserted into the same sleeve, since the sleeve's transverse cross section circumference increases a limited amount due to material elasticity, the two large/thick fingers (or three fingers) may fill up more of the sleeve side gaps 218*a* and inter finger gaps 218*b* shown in FIG. 2D and dramatically reduce the gap spaces. In this case the contact surface between the inserted fingers and sleeve wall increases. Large clamping force and tight wrapping effect may dominate and make it difficult for the hand to self take off from the SHWT glove.

When large/thick fingers are inserted in a finger sleeve embedded with vertical U/V grooves as shown in FIGS. 10D and 10E, the vertical U/V grooves stretch wider and increase the total sleeve circumference. This in turn reduces the sleeve side gaps 218*a* and inter finger gaps 218*b* shown in FIG. 2D but less so than the finger sleeve with no vertical U/V grooves. The vertical U/V grooves itself also create extra gap spaces between inserted fingers and the sleeve exterior wall due to the wave structure having multiple peaks and valleys. The vertical U/V grooves may help to reduce the sleeve clamping force to appropriate ranges. This may reduce sleeve tight wrapping effect and help with hand self takeoff from the SHWT glove. When a single finger or fingers of slim size are inserted, the peaks on the vertical U/V grooves leaning towards the finger may also help to generate extra clamping force to hold the finger(s) securely.

In summary, finger sleeve with vertical U/V grooves such as those in SHWT glove 130 (FIGS. 10D, 13E & 13F) may have better tolerance when the number of inserted fingers or the size of the inserted fingers varies due to adaptive transverse cross section circumference expands and contracts along with the inserted fingers and the resulting clamping force has a smaller deviation range.

Finger sleeve embedded with vertical U/V grooves such as those in SHWT glove 130 may have a total expanded circumference larger than the finger sleeve without the vertical U/V grooves in SHWT glove 100. With deep vertical U/V grooves, the total expanded circumference may become too big which can result in reduced sleeve clamping force especially for single inserted thumb. We may compensate the reduced clamping force by reducing the transverse cross section length of the sleeve segments that are not part of the vertical U/V grooves. Sleeve transverse cross section containing vertical U/V grooves may have its initial circumference 006 (before U/V expanding) calculated by using U/V initial cord length as shown in FIG. 10D.

SHWT sleeve transverse cross section with expandable structure such as vertical U/V grooves embedded at sleeve exterior wall may have width (OW) to height (OH) ratio smaller than that of SHWT sleeve transverse cross section without expandable structure and still achieve similar clamping performance.

To explain this, if we make the expanded circumference of a sleeve transverse cross section with vertical U/V grooves when the vertical U/V grooves are expanded to be the same as that of a sleeve transverse cross section without vertical U/V grooves, the initial circumference 006 (dashed line shown in FIG. 10D) of the sleeve transverse cross section with vertical U/V grooves before vertical U/V groove expansion will be smaller than the circumference of the sleeve transverse cross section without vertical U/V grooves.

If we keep vertical U/V grooves embedded sleeve transverse cross section's height (OH) unchanged, sleeve transverse cross section width (OW) can be reduced by reducing NCA1 or NCA2 arm in FIG. 11C or 11D and leave smaller sleeve side gaps 218*a*. The resulting width (OW) to height (OH) ratio will be smaller than SHWT sleeve without vertical U/V grooves.

Even though FIGS. 10D and 10E illustrate a finger sleeve with vertical U/V grooves having width (OW) to height (OH) ratio>2:1 as they are a result of adding vertical U/V grooves to SHWT glove 100 (FIG. 10A) and SHWT glove 230 (FIG. 10B) respectively, the ratio of width (OW) to height (OH) in FIGS. 10D and 10E may be reduced to less than 2:1 from T-DIP joint level or mid sleeve section to sleeve tip wherever vertical U/V grooves are implemented.

Vertical U/V grooves may create extra gap space between inserted fingers and the sleeve wall with the vertical U/V grooves applied which may help compensate for the two smaller sleeve side gaps 218*a* and avoid sleeve tight wrapping effect.

In addition, finger sleeve with vertical U/V grooves may reduce the sleeve width (OW). The reduced sleeve width (OW) may also improve the finger sleeve fit for inserted fingers.

Vertical U/V grooves 531 on the finger sleeve exterior wall shown in FIGS. 13E & 13F do not have to be uniformly implemented with its middle chord line following outward line as shown in 2D view in FIG. 10D, but can follow flat, inward or outward line at different vertical heights of the finger sleeve wall. For example, vertical U/V grooves' middle chord line can follow flat shape 500C in FIG. 10C or inward line 501C in FIG. 10E at mid sleeve section to help generate more clamping force than outward line 503C in FIG. 10E. Vertical U/V grooves' middle chord line may transition to outward line toward top sleeve aperture. An inward line vertical U/V grooves implemented on the finger sleeve can help generate more clamping force especially for single inserted finger (such as thumb or index finger).

Vertical U/V grooves 531 on the sleeve exterior wall shown in FIGS. 13E & F do not have to be implemented in uniform depth along the sleeve wall. For example, vertical U/V grooved may be deep at upper middle section of the finger sleeve wall, becoming shallower towards the lower section of the sleeve wall (refer FIG. 13F expand window view) and disappearing near the sleeve tip.

Embedding vertical U/V grooves along each finger sleeve's exterior wall may help strengthen SHWT glove's overall vertical stiffness to reduce the likelihood of SHWT glove collapsing during finger insertion, especially when horizontal U/V grooves are also implemented in SHWT glove reducing vertical stiffness.

Embedding vertical U/V grooves on finger sleeve exterior wall makes the top skirt transverse cross section circumference adaptive and extendable. Refer FIG. 21C, top skirt starts above 100*f*-H. Even though there is wall thickness 505 between sleeve top edge and top skirt, wall thickness is negligible and may be ignored when considering the expandability of vertical U/V grooves from sleeve top edge extending to top skirt. An expandable top skirt may allow the hand to use less force to open wide because the hand is less restrained by the expandable top skirt.

Under this situation, the palm protection section structural stretch/expansion limit may be extended and the hand may be mainly limited by arc C and arc B based structural stretch/expansion limit.

SHWT glove 100 from FIG. 1A may be illustrated, in one aspect, as SHWT glove 136 in FIG. 16D with the addition of both vertical U/V grooves 531 and horizontal U/V grooves 530. The vertical U/V grooves 531 shown in solid circles extended from the horizontal U/V grooves 530 plus the vertical U/V grooves 531 shown in dashed circles on the sleeve wall further extend the top skirt circumference and extend the top skirt size adaptive range. Therefore, SHWT glove 136 has a more extendable top skirt than that of SHWT glove 130 in FIG. 13E.

SHWT glove 136 has adaptive finger sleeve, adaptive top skirt and adaptive HUV arc C and HUV arc B length. With adaptive extendable arc C and arc B length, SHWT glove 136 may be used to grab large spherical objects with inter sleeve grip/grab and center grip/grab.

Another benefit of implementing both vertical and horizontal U/V grooves in SHWT glove is that when SHWT glove uses non elastic but bendable type I material such as paper-based material, the vertical and horizontal U/V grooves can add elastic property to non-elastic material to meet SHWT glove design standards.

FIG. 11B shows a transverse cross section view of SHWT glove 130's finger sleeve with vertical U/V grooves (531C in transverse cross section view) on the exterior wall and further adding vertical U/V grooves (531C in transverse cross section view) on each side of the finger sleeve. As illustrated in the left dashed window, adding vertical U/V grooves may be considered as mirror flipping an extended sharp corner (dashed line single "V" shape) along center dashed line and connecting this flipped sharp corner to the finger sleeve at mirror line (refer left dashed window), which forms two vertical U/V grooves (shaped as connected double "V"). When counting the number of grooves, only convex shaped grooves are counted. Concave shaped grooves are not included in the count. Convex vs. concave shape definition will be discussed in later section. Since the finger sleeve in FIG. 11B is line symmetric, there are a total of 4 vertical U/V grooves on the finger sleeve sides.

FIG. 11B shows SHWT glove 130's finger sleeve with vertical U/V grooves (531C in transverse cross section view) on the sleeve exterior wall, the finger sleeve has width (OW) and height (OH). OWae denotes the sleeve width when each side of the finger sleeve has a single extended sharp corner in dashed line. Owa denotes the sleeve width when two vertical U/V grooves (531C in transverse cross section view) are added to each side of the finger sleeve. OWa end point on each side is at ½ PV-W (half distance between peak point and valley point of the U/V grooves). Measuring sleeve transverse cross section width and height when a finger sleeve has U/V grooves will be discussed later in detail. OWa will be shorter than OW and OWae. With the same height (OH) and reduced width (Owa), a finger sleeve with vertical U/V grooves on each side has a smaller width (OW) to height (OH) ratio than a finger sleeve with a single extended sharp corner on each side or a finger sleeve without vertical U/V grooves on each side.

Adding vertical U/V grooves on the sides of the finger sleeve may help reduce the sleeve width to better fit single inserted finger and structurally act like angle bar structure to reinforce the vertical sleeve stiffness. This structural improvement may help when SHWT glove is made of thin and less elastic or non-elastic material such as paper-based material.

In one aspect, adding vertical U/V grooves on the sides of the finger sleeve to replace relatively rounded side corner tip such as that of the finger sleeve in SHWT glove 100 shown in FIG. 10A may further increase the range of finger sizes, number of fingers, or both the range of finger sizes and number of fingers capable of being accommodated in the SHWT glove.

In one aspect, including two sharp side corners at each side of the finger sleeve (as shown in FIG. 10C-expanded window) may have a similar effect as adding two vertical U/V grooves (531C shown in FIG. 11B) in achieving sleeve circumference adaptiveness and reducing sleeve width. This aspect may be useful for inelastic or low elastic material based SHWT glove such as paper based SHWT glove.

FIG. 11B right dashed window also illustrates an example of adding three U/V grooves to the side of the finger sleeve by folding a single sharp corner two times.

The vertical U/V grooves on the sides of a finger sleeve may be implemented with varying groove depth at different vertical heights of the finger sleeve wall. As an illustrative example, vertical U/V grooves may be implemented at certain depth around mid sleeve section and gradually become shallower toward the finger sleeve top aperture and/or bottom sleeve section and may finally disappear near 100% of sleeve height (SH) and/or near 0% of sleeve height (SH).

An SHWT glove that is compressible or foldable (including, for example, a paper-based SHWT glove), may be compressed or folded for purposes such as shipping, storage, packaging in volume, etc. In one aspect, glove measurements (for example sleeve width (OW), height (OH), sleeve height (SH), ratios, and so on) may be made when that SHWT glove is unfolded and expanded to a ready-to-wear state (shape).

In one aspect, accounting for sleeve clamping force for either single or multiple finger insertion in a given finger sleeve, finger sleeve transverse cross section design may be illustrated by the finger sleeve transverse cross section width (OW) to height (OH) ratio at different vertical heights of the sleeve, as explained below.

FIG. 21D illustrates a finger sleeve outer surface with transverse cross sections shown at different % of the sleeve height (SH). The transverse cross sections may have different shapes according to where the transverse cross section is taken. A set of some transverse cross section views are illustrated in FIG. 21E. In one aspect, a transverse cross section at 70% of the sleeve height (SH) is illustrated in FIG. 21D 3D view, while the 2D shape of a transverse cross section of a finger sleeve at 70% of the sleeve height (SH) is illustrated in FIG. 21E. In one aspect, transverse cross sections from FIG. 21D may be illustrated as plane shapes (2D) in FIG. 21E. In one aspect, transverse cross sections from FIG. 21D may not be illustrated as plane shapes (2D) in FIG. 21E.

If the sleeve wall thickness is approximately the same around the circumference of the finger sleeve's transverse cross section, width (OW) and height (OH) may be measured from the sleeve's inner surface as the width (OW) to height (OH) ratios is the same, or the difference may be ignored as compared to an outer surface measurement method.

For the below description of the shape of a transverse cross section of a finger sleeve, the sleeve outer surface is used for width (OW) and height (OH).

FIGS. 22, 23 and 24 may include a number of points, for example points "A", "a", "b", "b'", "c", "c'", "d", "d'", "e", "f", "g", "h", "i", "j", and so on. A point may be designated by point b, or b, or point h, or h, for example. An arc may be designated by reference to two points, for example arc ab. An angle may be designated by reference to three points, for example, angle d(e)f. A straight-line segment may be designated by reference to two points, for example gh. Straight-line segments are referenced, for example, in the shape in FIG. 22B of a transverse cross section with straight-line segments from point "g" to point "h" (referenced as gh) and from point "i" to point "j" (referenced as ij).

Sleeve Transverse Cross Section Shape

The shape of a transverse cross section of a finger sleeve in a SHWT glove can be geometrically considered as a single loop closed shape configured by connecting various arc/angular segments as illustrated in FIG. 22A (arc/angle a to e or a' to e'). From a geometric definition, a closed loop shape may contain single or multiple loops, for example the number "8" is a closed shape with two loops. The shape of a transverse cross section of a finger sleeve from SHWT glove has a single loop.

As illustrated in FIG. 22A, the arc/angular segments can be a pure arc segment (for example, segments a and e), an arc mixed with straight-line segment (for example segments c and d), angles formed by two straight-line segments (for example segment b). These segments can be convex (all segments above dashed tangent line in FIG. 22A) or concave (all segments below tangent line in FIG. 22A). Convex means curving outward creating a dome or a peaked roof. Concave means curving inward like the shape of the inside of a bowl and can be filled. FIG. 22A right side illustrates an example structure when convex and concave arc/angular segments are connected together. Horizontal and vertical U/V grooves discussed earlier are examples of connected convex and concave arc/angular segments. An arc/angular segment may be stretched into a straight-line segment when deformed by external force such as inserted fingers in a finger sleeve, therefore they may be considered as an extendable structure, whereas a single straight-line segment is not an extendable structure from a geometric perspective (disregarding material stretch).

In one aspect, a three sleeve based SHWT glove may have the shape of its finger sleeve's transverse cross sections below 70% of the sleeve height (SH) as flat single loop closed shape. In one aspect, a four sleeve based SHWT glove may have the shape of its finger sleeve's transverse cross sections below 50% of the sleeve height (SH) defined as a flat single loop closed shape. The word "flat" means its width (OW) to height (OH) ratio is greater than 1:1, or width (OW) is greater than height (OH). In the below description, flat single loop closed shape is referred to as a flat loop shape.

The flat loop shape can be categorized into 1) flat convex loop that is flat loop shape with only convex arc/angular segments or 2) flat mixed loop that is a flat loop shape with a mix of both convex and concave arc/angular segments. Either convex loop or mixed loop may contain straight-line segments, since arc/angular segments shown in FIG. 22A may contain straight-line segments as part of an arc/angular segment (for example, segment b, c, d). In the following description, straight-line segments may be described separately from connected arc/angular segment(s) for clarity.

FIG. 22B illustrates a flat convex loop which contains convex arcs ab, bf, fg, hi & ja, and two straight-line segments gh and ij. In one aspect, the approximate flat oval shape shown in FIG. 10B without either horizontal of vertical U/V grooves and/or without concave arc segments may be a flat convex loop. "Approximate" is used with oval in lieu of a strict mathematical definition for oval.

FIG. 22C illustrates a flat mixed loop with convex arc ab, bc, fg, hi & ja, convex angle d(e)f, concave arc cd, two straight-line segments gh and ij. The concave arc cd connected to its two neighboring convex arc bc and convex angle d(e)f may be considered as adding vertical U/V grooves to a finger sleeve from point b to point f. The creases of the vertical U/V groove may allow a finger sleeve to extend, or open, similar to how an accordion expands. The shape of the transverse cross section in FIGS. 10D, 10E, 11B are examples of flat mixed loops.

In one aspect, connected convex and concave arc/angular segments may not be connected directly. Convex and concave arc/angular segments may be connected via a straight-line segment.

Whether the flat loop shape is a mixed loop or convex loop affects how much SHWT finger sleeve width (OW) and height (OH) can extend respectively to follow either circumference 210 of multiple inserted fingers (refer FIG. 2D expanded window) or single inserted finger circumference and shape (see thumb 211C in FIG. 2D) when fingers are inserted into the sleeve.

Convex Loop Vs. Mixed Loop Differentiation-Tangent Line Test

One way to differentiate a convex loop vs. a mixed loop, other than by visual inspection, is to use a tangent line test. FIG. 22A illustrates a curve starting from point A on the tangent line turns its direction (follow the arrows) either left (or counterclockwise) or right (or clockwise). Separately, a straight-line segment starting from point A can follow the tangent line with no turn. Tangent line test method to identify convex loop vs. mixed loop is illustrated in FIGS. 22B and 22C.

A flat convex loop illustrated in FIG. 22B starts from point "a" and follows the arrows' direction to the right (or clockwise), passing b, f, and reach point g, h, i, j and back to a. Each arc and line segment along the way always turns right or clockwise (in this particular example) from their respective tangent line (dashed straight line) or stays on the tangent line and without a left turn (or counterclockwise) from the tangent line (or cross to the other side of the tangent line). Reversing the direction, in other words with the arrows of FIG. 22B pointing the opposite direction on the flat convex loop, all arc and line segments would have left turns (or counterclockwise turns) or no turns.

Flat convex loop in FIG. 22B has the curves start from point a, b, f, h, j and turns right or clockwise (following the arrow direction on the flat convex loop) from their respective tangent lines and two straight-line segments start from point g & i following their tangent lines till their respective end point h & j.

Note: When using tangent line to test angle formed by two straight-line segments such as angle l(m)n on the right side of FIG. 22B, start from angle vertex point (m), we use an extension line from line lm as tangent line to determine the following segment mn turns right in this example.

A flat mixed loop in FIG. 22C starts from point "a", following arrows' direction, convex arc ab, bc turns right (or clockwise) from their tangent lines. When the curve continues from c to d, it turns left (or counterclockwise) from its tangent line (or crosses to the other side of the tangent line) and forms a concave arc. Then from d, it turns right (or clockwise) again following straight-line segment to e. from e, it turns right (or clockwise) and follow straight-line segment to f to form a convex angle d(e)f. Therefore, if a finger sleeve's transverse cross section starts out with arc/angular segment turning right (or clockwise) from the tangent line and then turns left (or counterclockwise) from the tangent line (i.e. cross to the other side of tangent line), it is a mixed loop. The same is true if a finger sleeve's transverse cross section starts out with arc/angular segment turning left (or counterclockwise) from the tangent line and then turns right (or clockwise) from the tangent line. A mixed loop has at least one convex arc/angular segment and at least one concave arc/angular segment. Reversing the direction of the arrows in the flat mixed loop of FIG. 22C yields the same result.

Convex Loop OW and OH Definition

In a convex loop such as those illustrated in FIGS. 21E and 23C, placing the convex loop in an XY coordinate system where y axis is parallel to the bottom grip radius (BRC) at 0% of the sleeve height (SH) or parallel to the grip radius (RC) at non 0% of the sleeve height (SH) (see FIGS. 13C & D for RC and BRC definition). Convex loop height (OH) is parallel to Y axis and is the distance on the Y axis between the highest and lowest point on the transverse cross section of the finger sleeve. Convex loop width (OW) is the distance on the X axis between the leftmost and rightmost point on the sleeve.

Mixed Loop OW and OH Definition

Height (OH) and width (OW) as used for a mixed loop is different than as used for a convex loop. In a mixed loop such as those illustrated in FIGS. 24A I&II, 24B and 24C, height (OH) may be where the start and end point may not be the highest and lowest point on the sleeve shape when both convex and concave arc/angular segments are present on the top or bottom of the transverse cross section. Width (OW) may be where the start and end point may not be the leftmost and rightmost point on the sleeve shape when both convex and concave arc/angular segments are present on the left or right of the sleeve shape.

FIGS. 24A, B and C illustrate a series of flat mixed loops, which in one aspect are transverse cross sections of a finger sleeve and may be configured to change shape, or deform, as one or more fingers are inserted into the sleeve.

FIG. 24A I illustrates a concave arc a(b)c. When this segment expands, arc a(b)c will expand towards a flat line. Hence, height (OH) starts from "½ PV-H" (half point between the highest of the two peak points a or c and the valley point b), and ends at the bottom. In FIG. 24, all PV-H denote peak-valley height, and PV-W denote peak-valley width and S-PV-H denote small-peak-valley-height.

FIG. 24A II illustrates two concave arcs de and ef. height (OH) starts from "½ PV-H" (half point between peak point e and the lowest of the two valley points d or f), and ends at the bottom.

FIG. 24B illustrates U/V grooves such as segment efb in expanded window appended to a concave segment acb. The "PV-H" of segment acb starts at ½ S-PV-H of segment efb as shown in expanded window and ends at the valley point c of segment acb. Height (OH) starts from "½ PV-H" of segment acb and ends at the bottom.

FIG. 24C illustrates a T shape, with concave angle a(b)c and d(e)f connected with convex angle b(c)d and c(d)e. height (OH) starts from the top and ends at "½ PV-H" (half point between the concave angle line segment ab or ef level and convex angle line segment cd level).

Width (OW) in FIG. 24C starts from ½ PV-W on the left (half point between peak point a and valley point b in the concave angle a(b)c) and ends at half point between f and e in the concave angle f(e)d.

Convex Loop Sharp Arc/Angle Definition-Partial Inscribed Circle Sweep Test

The sharpness of arc/angular segments in a flat convex loop affects how much width (OW) and height (OH) can change to follow either circumference 210 of multiple inserted fingers or single inserted finger circumference and shape (refer FIGS. 2D, 2C & 11D) when fingers are inserted into the sleeve. One SHWT sleeve transverse cross section width (OW) to height (OH) ratio of a flat convex loop differs depending on how many sharp arc/angular segments it contains. The term "sharp arc/angular segment" (which is different from common definition of "sharp") in a flat convex loop is determined based on a partial inscribed circle sweep (PICS) test described below. A test circle used in the PICS test may not have tangent point with every segment in the convex loop but will have at least one contact point with the convex loop.

To determine how many sharp arc/angular segments a flat convex loop contains based on one definition, PICS test is used and demonstrated in FIG. 22D and FIG. 23A. PICS test may either start from the center and sweep to the sides, or start from one end to the center then to the other end. The PICS test may be started from the smallest arc/angular segment located in a convex loop and continue until the whole convex loop is covered.

In one aspect, the test circles' radius<=OH/2, but >0. In the case of a flat convex loop with only arc segments (or no angular segments), the smallest test circle can have a radius that is equal to the radius of the smallest arc in the convex loop. In case the smallest arc/angular segment in the convex loop is an angular segment formed by two straight-line segments, or one straight-line segment and one arc connected at angular peak (such as segment c & d in FIG. 22A), the smallest test circle can have a starting radius=1% of OH/2.

For simplicity, "S" may be used in front of an arc/angular segment to denote "sharp arc/angular segment" based on our definition, such as sharp arc ab will be simplified to "Sab". In the following description, sharp arc/angular segment will be referred to as "S" segment. A sharp arc/angular segment containing sub sharp arc/angular segments is defined as a complex sharp arc/angular segment. Complex sharp arc/angular segment will be referred to as complex "S" segment. A sharp arc/angular segment containing no sub sharp arc/angular segments is defined as a simple sharp arc/angular segment. Simple sharp arc/angular segment will be referred to as simple "S" segment.

The flat convex loop in FIG. 22D has left side arc ab composed of larger arc ac with radius r2 and smaller arc bc with radius r1 in the expanded window. Arc bc is the smallest radius arc in this convex loop.

In FIG. 22D, a test circle may have a radius r1. When the test circle's radius is equal to arc bc's radius, part of the test circle overlaps with arc bc as shown in the expanded window. Overlap segment between test circle and convex loop is equivalent to having one contact point. The test circle with radius r1 only contains one overlap segment bc but an overlap segment is equivalent to a contact point.

Other examples of overlap segments equivalent to one contact point are shown in FIG. 23D IV. The convex loop on the left has a test circle creating overlap segment ab, contact points c and d. This test circle divides the convex loop into three "S" segments: Sbc, Scd and Sad. The convex loop on the right has a test circle creating two overlap segment ij and kl and one contact point h. This test circle divides the convex loop into three "S" segments: Shi, Sjk and Slh.

As illustrated in FIG. 23D and FIG. 22D, a contact point and an overlap segment created by a test circle within a convex loop is equivalent in terms of dividing the convex loop into "S" segments. A test circle with two contact locations (either contact point or overlap segment) will divide the convex loop into two "S" segments and a test circle with three contact locations will generate three "S" segments.

The "S" segment length between the two neighboring contact locations is always longer than the test circle's segment length between the two neighboring contact locations. As an example, FIG. 22D solid line convex shape has the test circle in the center creating contact points m and n, resulting in Smdacben and Smd'c'b'e'n. The segment length of both "S" segments' length between their two neighboring contact locations is longer than that of the test circle's. In another example, as illustrated in FIG. 23D IV with a convex loop on the left side, Sbc is an "S" segment and Sbc's segment length is larger than the test circle segment length between points b and c. As illustrated in FIG. 23D IV with a convex loop on the right side, Sjk is an "S" segment and Sjk's segment length is larger than the test circle segment length between points j and k.

Referring again to FIG. 22D, PICS test starting from left solid circle with r1 radius and with the next test circle (dashed circle) of an increased radius, it creates two contact points d and e and divides the flat convex loop into two "S" segments 1) Sdcbe 2) Sdmd'c'b'e'ne.

The test circle radius continues to increase and move to the right. After it hits the maximum radius=OH/2, the radius of the test circle starts to decrease as it moves to the right until reaching the right end of the flat convex loop. Along the sweep path, except the first test circle and last test circle (r1 radius) only creates 1 overlap segment each (bc and b'c'), each of the remaining test circles only creates two contact points within this flat convex loop and divide this convex loop into two "S" segments. Since the sweep path covered the direction of all "S" segments and there is no test circle creating more than two contact points, each "S" segment is a simple "S" segment, therefore, the flat convex loop in FIG. 22D (solid line shape) only has two simple "S" segments from the same test circle. In one aspect, substituting the arc dmd' to be a pointed angle d (h) d', applying PICS test, a test circle (illustrated in FIG. 22D as a circle with a solid circumference line) in the middle will create three contact points g, i, n and divide the flat convex loop into three "S" segments 1) Sg(h)i at top center, 2) Sgdacben at left 3) Sid'c'b'e'n at right. This flat convex loop as modified and shown in FIG. 22D with Sg(h)i has three "S" from the same test circle (as compared to FIG. 22D's original solid line flat convex loop with two "S" segments). Continuing sweeping toward each "S" segment and none of the remaining test circles creating more than two contact points, therefore the modified flat convex loop has three simple "S" segments from the solid line test circle in the middle. Note a flat convex loop with width (OW) longer than height (OH) definitionally has at least two simple "S" segments using PICS test.

FIG. 23A illustrates another flat convex loop applying the PICS test with all the sweep directions shown by dashed arrows. FIG. 23A illustrates the complete PICS test sweep tracing and FIGS. 23B, C and D illustrate a breakdown of the PICS test in steps and their results.

In FIG. 23A, starting at the lower left corner, the test circle overlaps with the corner. (Note this test circle only has an overlap segment with the convex loop, but an overlap segment is equivalent to a contact point). Then following the arrow direction, we gradually increase the test circle radius while keeping two contact points until the test circle hits three contact points at a, b & c. Three contact points a, b & c create three "S" structures Sab, Sbc and Sca shown in FIG. 23B(I). Continue with the PICS test will identify simple "S" segments in the convex loop shown in FIG. 23A.

In FIG. 23B(I), since PICS test started from Sab, Sab is a simple "S" segment and the test continues with moving the test circle toward Sbc direction (arrow pointing upper left), reducing its radius until it overlaps with the tip of Sbc which is shown in FIG. 23D(II) dashed oval window. The PICS test towards Sbc does not generate more than two contact points along the sweep, Sbc is a simple "S" segment.

In FIG. 23B(I), the test circle continues towards the right in the direction of Sca, with an increasing radius. Three new contact points are d, l & n (refer to FIGS. 23A & 23B II) that divide the flat convex loop into Sdn, Sdl & Sn(m)l, as illustrated in FIG. 23B(II). This shows that Sca (in FIG. 23B(I)) is a complex "S" segment as it contains sub "S" segments Sdl and Sn(m)l. (Note: Sdl different with Sdl-s in FIG. 23DI).

Since the sweep started from the left, in FIG. 23B(II) the sweep continues towards Sn(m)l and Sdl. The PICS test continues towards Sn(m)l in FIG. 23B(II), confirming that Sn(m)l is a simple "S" segment because each test circle along the sweep creates no more than two contact points at Sn(m)l.

Next, the PICS test continues towards Sdl in FIG. 23B II, following the arrow with the radius of the test circle decreasing until it hits three new contact points e, g & x (refer to the solid line test circle of FIG. 23A), which generates angle Se(f)g (illustrated in the right expanded window of FIG. 23A), Sg(j)x & Sedcban(m)lx. Since angle e(f)g's segment length minus test circle segment length between points e and g is <1% of the test circle segment between e and g, angle e(f)g does not count as "S" segment. This <1% excluding "S" rule applies to all "S" segments using PICS test.

Skipping angle e(f)g, continuing the PICS test towards Sg(j)x following the top rightmost arrow in FIG. 23A, decreasing the test circle radius until it hits three new contact points h, i & k (refer to FIG. 23A & FIG. 23B III), which generates Shi, Si(j)k & Shk. (Note: Shk in FIG. 23B(III) is the same curve as defined in FIG. 23A by Shgfedcban(m)lxk).

Since the sweep started from the left side, sweeping continues towards the right (towards Shi and Si(j)k) and confirms that both are simple "S" segments. The PICS test stops here as there are no more complex "S" segments.

The 5 simple "S" segments Sbc, Sab, Shi, Si(j)k and Sn(m)l identified by PICS test from the convex loop in FIG. 23A are illustrated as hatched segments in FIG. 23C.

FIG. 23D(I) illustrates breaking apart the original flat convex loop in FIG. 23C into these 5 simple "S" segments (hatched segments) in the surrounding and a new flat convex loop in the center. The center flat convex loop in FIG. 23D(I) still has two "S" segments Sdn-s and Sdl-s as the middle test circle creates overlap segment nl and contact point d. Both Sdn-s and Sdl-s are simple "S" segments in FIG. 23D(I) as all sub "S" segments are already removed and shown as the 5 simple "S" segments in the surrounding.

In FIG. 23D(I), adding one simple "S" segment from two neighboring simple "S" segments determined by the same test circle back to the center convex loop's Sdn-s or Sdl-s will not generate more than two simple "S" segments from the same test circle in the newly created convex loop, i.e. it still can pass the PICS test without having more than two contact locations (either contact point or overlap segment) and generating more than two simple "S" segments from the same test circle.

In FIG. 23D(II), since Sbc and Shi are simple "S" segments and belong to two different test circles (refer FIG. 23C two dashed circles on the left & right), both Sbc and Shi may be added back to Sdn-s & Sdl-s without generating more than two simple "S" segments from the same test circle in the newly created convex loop as shown in FIG. 23D II. However, simple "S" segments Sbc and Sba may not be added back together to their original Sdn-s (FIG. 23D I) as they belong to the same test circle (therefore only one of them can be added back). Similarly, Shi and Si(j)k (Refer FIG. 23C) also belong to same test circle hence they cannot be added back together to Sdl-s in FIG. 23D I.

FIG. 23D(III) illustrates if you want to add Sba and Sn(m)l in FIG. 23D I back to Sdn-s and Sdl-s in the center convex loop in FIG. 23D I without generating more than two simple "S" segments from the same test circle in the newly created convex loop, you have to cut out hatched area Sdhi(j)kl in FIG. 23D III since it belongs to the same test circle as Sn(m)l (with three contact points d, n, l).

In FIG. 23D(III), in one aspect you may keep Sba and replace Sn(m)l with simple "S" segment along test circle segment dl: either Sdl-s in FIG. 23D(I) or Sdl-s plus only one extra simple "S" segment, either Shi or Si(j)k in FIG. 23D(I).

In a flat convex loop, when the PICS test generates three contact locations (either contact point or an overlap segment) from the same test circle, which generates three "S" segments, keeping two simple "S" segments will allow the new modified convex loop to qualify as having two contact locations from the same test circle. Any complex "S" segment may be changed to a simple "S" segment by purging its sub "S" segments but leaving one sub simple "S" segment (from the same test circle). After this modification, the new flat convex loop will qualify with the PICS test with two contact locations generating only two simple "S" segments from the same test circle.

Applying the PICS test, after checking all the test circles in the sweep, if any test circle creates three or more contact locations (either contact points or overlap segments) within the flat convex loop, the flat convex loop has more than two simple "S" segments. If none of the test circle creates three or more contact locations, the flat convex loop has less than three simple "S" segments.

A flat convex loop with more than 2 simple "S" segments (by the PICS test) functions similarly to a flat mixed loop in terms of having more extendable structures (which simulate a stretchable material through design).

A flat mixed loop or a flat convex loop with more than 2 simple "S" segments may have a width (OW) to height (OH) ratio that increases/expands more than that of a convex loop with <=2 simple "S" segments when finger(s) are inserted into a finger sleeve. Hence the flat mixed loop and flat convex loop with more than 2 simple "S" segments can use smaller width (OW) to height (OH) ratios, as defined in Table 2, as they are designs with more expansion capability. See detailed ratios in Table 1 and Table 2 below.

For a SHWT glove with four finger sleeves, since three sleeves may be occupied by single fingers and the fourth sleeve may be occupied by two fingers (in one aspect, the ring and partially inserted pinky finger), the finger sleeve transverse cross section ratio of width (OW) to height (OH) may be further reduced compared to a SHWT glove with three finger sleeves.

FIG. 24D shows a flat convex loop that has two sharp 90-degree corners (corners with hatching) at the top. This is a flat convex loop with a 2:1 ratio of width (OW) to height (OH) and with <3 simple "S" segments from the same test circle. Out of all flat convex loops with <3 simple "S" segments from the same test circle with its 2:1 width (OW) to height (OH) ratio, the shape in FIG. 24D may have the biggest circumference.

Adding two more sharp corners to two bottom sides of the convex loop in FIG. 24D results in the rectangle in FIG. 24E. Illustrated in dashed oval on the right side of FIG. 24E, rotating the lower right sharp corner counter clockwise by 90 degrees to be side by side with the top right sharp corner forms two parallel reverse V shaped structure, which is also a structure with connected convex and concave arc/angular segments.

Flipping the right reverse V down in FIG. 24E lower right corner forms another structure with connected convex and concave arc/angular segments. In FIG. 24E, rotating the lower left sharp corner clockwise forms two parallel reverse V shaped structures on the left side of the rectangle, same as the right side of the rectangle. Therefore, in a flat convex loop, having more than one simple "S" segments on either left or right side (along width (OW) direction) is equivalent to an extendable structure with connected convex and concave arc/angular segments in a mixed loop. FIG. 10C illustrates another example of a finger sleeve's transverse cross section which is a flat convex loop with two sharp corners (shown in the left expanded window's dashed circles) on the left side and two sharp corners on the right side. Adding two sharp corners to the side of the sleeve has similar effect as adding vertical U/V grooves to the side of the sleeve to achieve sleeve circumference adaptiveness and also reduce sleeve width (OW). Hence the finger sleeve transverse cross section shape in FIG. 10C uses width (OW) to (OH) ratio in Table 2.

The design of the finger sleeve helps to control sleeve clamping force with respect to inserted single or multiple fingers. In one aspect, the design may use selected ratios of width (OW) to height (OH) of the sleeve transverse cross sections. The ratios may be selected in a range, for example from 10% to 70%, or 10% to 20%, or 10% to 30%, or 10% to 50%, and so on, of the sleeve height (SH). This range roughly corresponds to five fingers' PIP joints to the upper part of the fingernails (refer FIG. 2A for finger joints position) of a fully inserted hand in a SHWT glove. Controlling the clamping force in this range increases the SHWT glove usability and performance. The width (OW) to height (OH) ratio may not have a selected range below 10% of the sleeve height (SH), because the finger sleeve design below 10% of the sleeve height (SH) may focus on matching an inserted finger's fingertip shape (for example, thumb or index finger), especially near the sleeve tip, therefore width (OW) to height (OH) ratio may vary in a wide range below 10% of the sleeve height (SH).

The average width to height ratio of a single finger's transverse cross section from PIP joint to upper part of the fingernail typically ranges from 1.1:1 to 1.25:1 and may not exceed 1.28:1. The design of conventional finger gloves accounts for this size range and includes ratios in this size range (or slightly larger) in order to fit a single finger. Doubling the above ratios would result in a glove that may be suitable only for multiple finger insertion. The SHWT glove, after multiple testing and design iterations, including analysis of hand and finger movement patterns, includes finger sleeves with ratios as described below. Benefits of the SHWT glove, as previously described, include single or multiple finger insertion and usability, with single hand removal (for both single finger per finger sleeve and multiple fingers inserted into one or more finger sleeves). These benefits are not available in conventional gloves because convention gloves have design goals of fitting an average user's hand or fingers and not those benefits of the SHWT glove. Using width and height of a finger in a user's hand as a design reference, the ratio of width (OW) to height (OH) of a finger sleeve's transverse cross section may be larger to leave room to create enough sleeve side gaps 218*a* shown in FIG. 2D for two parallel inserted fingers, and in accordance with the benefits of the SHWT glove. The width (OW) to height (OH) ratios for a SHWT glove may be determined with the SHWT glove in a neutral position, for example on a flat, level surface with the tips of the finger sleeves on the surface, with no user's hand inside (which also means sleeve body has no distortion by inserted fingers).

TABLE 1 for use with SHWT glove finger sleeve traverse cross section that is a flat convex loop by using tangent line test with <3 simple "S" segments by using PICS test

| Sleeve height (SH)% | Three sleeve based SHWT OW to OH ratio | Four sleeve based SHWT OW to OH ratio |
|---|---|---|
| From 10% to 20% | >2.1:1 | Not constrained |
| From 10% to 30% | >2:1 | >1.5:1 |
| From 10% to 50% | >1.8:1 | >1.4:1 |
| From 10% to 70% | >1.6:1 | Not constrained |

TABLE 2

| Sleeve height (SH)% | Three sleeve based SHWT OW to OH ratio | Four sleeve based SHWT OW to OH ratio |
|---|---|---|
| From 10% to 20% | >1.8:1 | Not constrained |
| From 10% to 30% | >1.7:1 | >1.35:1 |
| From 10% to 50% | >1.5:1 | >1.25:1 |

a) SHWT glove finger sleeve transverse cross section is a flat convex loop by using tangent line test with >2 simple "S" segments by using PICS test; or
b) SHWT glove finger sleeve transverse cross section is a flat mixed loop by using tangent line test.

As illustrated in FIG. 8E (top), in one aspect, SHWT finger sleeve's transverse cross section may be triangular shaped between 20% of the sleeve height (SH) and 70% of the sleeve height (SH). FIGS. 10A, 10C & 10D illustrate a few examples of triangular shaped finger sleeve. Each finger sleeve in these examples have two straight-line segments on the interior wall that are 120-degrees apart. FIG. 13C illustrates SHWT glove 100's triangular shaped sleeve's straight-line segments are parallel to UC line. SHWT glove 100's two neighboring sleeves create a parallel reverse U-shaped tunnel with straight-line segments facing each other on the neighboring sleeves create two parallel flat surfaces. During use, for example by a hand employing a tight gripping action, the parallel flat surfaces can merge together which may increase inter-sleeve gripping contact surface with targeted object and help increase friction. For four sleeve based SHWT glove with triangular shaped sleeve transverse cross sections creating parallel reverse U-shaped tunnels, the two straight-line segments on the sleeve interior wall will be 90 degrees apart.

In one aspect, triangular shaped finger sleeves such as those illustrated in FIGS. 20A, 20B and 20C resemble the triangular shaped finger sleeves of SHWT glove 100, but may not have straight-line segments on the interior wall or the straight-line segments may not be 120 degree apart in a three sleeve based SHWT glove (or 90 degree apart in a four sleeve based SHWT glove).

A rectangular bar test can identify a triangular shaped finger sleeve (transverse cross section) in a SHWT glove. Any extra structure such as print pattern added to the finger sleeve should be excluded for the rectangular bar test. FIGS. 20A, 20B & 20D illustrate a rectangular bar test in a finger sleeve with only convex segments on the interior wall. FIG. 20C illustrates rectangular bar test in a finger sleeve with both convex and concave segments on the interior wall.

Refer to left figure in FIG. 20A, in a three-sleeve based SHWT glove, moving three sleeves towards glove center (GC) (shown as center circle for reference) until each pair of the two neighboring sleeves touch together at touch point "tp" shown in the right expanded window. Length "L" is defined as from glove center (GC) marked as 0% L to two touched sleeves' external top marked as 100% L. If one sleeve's external top is higher than its neighboring sleeve, the average height of the two sleeve's external top may be used as 100% L. Same rule is used to define length "L" in FIG. 20B and FIG. 20C.

Illustrated in FIGS. 20A & 20B expanded window, in a finger sleeve with only convex segments on the interior wall, a rectangular bar with length=½ L and width=1/20 L will be used to test for a triangular shape. The rectangular bar will have its length to width ratio (½) L/(1/20) L=10:1. The rectangular bar has an exterior side "e", center side "c" and middle line "m".

In FIG. 20A, neighboring sleeves' two straight-line segments form touch point "tp" located in a range from >=75% L to <=100% L. In this case, the rectangular bar is center positioned with its exterior side "e" at 100% L. The left sleeve's straight line segment on the interior wall intersects with rectangular bar center side "c". Repeating the same test on the left sleeve with its other neighboring sleeve yields the same results. Therefore, the left sleeve is a triangular shape. If we replace the straight-line segment of the left sleeve with dashed arc A curve, arc A does not intersect with center side "c" but instead intersects with the rectangular bar on the long side. This new sleeve shape with arc A will not be considered a triangular shape. When tp point is located in a range from >=75% L to <=100% L, a sleeve is considered a triangular shape when its interior wall intersects with center side "c" in each rectangular bar test conducted with each of its neighboring sleeve.

In FIG. 20B, neighboring sleeves' two near flat arcs form touch point "tp" located in a range from >=50% L to <75% L. In this case, the rectangular bar is center positioned with its middle line "m" intersecting with "tp". Shown in FIG.

20B enlarged window, the left sleeve near flat arc sleeve segment intersects with rectangular bar exterior side "e" and center side "c". Repeating the same test on the left sleeve with its other neighboring sleeve yields the same results. Therefore, the left sleeve is a triangular shape. When tp is located in a range from >=50% L to <75% L, a sleeve is considered as a triangular shape when its interior wall intersects with both exterior side "e" and center side "c" in each rectangular bar test conducted with each of its neighboring sleeve.

In FIG. 20B, if the near flat arc sleeve segment is replaced with dashed curve arc A, arc A has two intersects with the long side of the rectangular bar. The new sleeve shape with dashed arc A will not be considered a triangular shape.

The same rectangular bar test illustrated in FIG. 20B applies when "tp" point in a finger sleeve with only convex segments on the interior wall is located in a range from >=25% L to <50% L. The rectangular bar is center positioned with its middle line "m" intersecting with "tp". In this case a sleeve is considered a triangular shape when its interior wall intersects with exterior side "e" in each rectangular bar test conducted with each of its neighboring sleeve.

Illustrated in FIG. 20C, for a finger sleeve with both convex and concave segments on the interior wall, a three consecutive block rectangular bar is used for testing triangular shape. The rectangular bar may have length=¾ L and width=3/32 L, which means the rectangular bar has its length to width ratio of (¾) L/(3/32) L=8:1. The rectangular bar has external block "E", middle block "M" and base block "B", with each block having length=¼ L. In a finger sleeve with both convex and concave segments on the interior wall, the most external tp point towards 100% L direction is used as reference when there is more than one touch point. The rectangular bar is positioned with its exterior side "e" at 100% L and centered at two sleeves' touch point.

When the most external tp point is located in a range from >=75% L to <=100% L as illustrated in FIG. 20C, a sleeve is considered a triangular shape if the sleeve's interior wall enters into block "M" or "B" and repeating the same test with its other neighboring sleeve yields the same result. When the most external tp is located in a range from >=50% L to <75% L, a sleeve is considered a triangular shape if the sleeve's interior wall enters into block "E" or "B" and repeating the same test with its other neighboring sleeve yields the same result. When the most external tp is located in a range from >=25% L to <50% L, a sleeve is considered a triangular shape if the sleeve's interior wall enters into block "E" or "M" and repeating the same test with its other neighboring sleeve yields the same result.

FIG. 20D illustrates SHWT glove 230's finger sleeve 231C (also in FIGS. 8E & 10B) is considered not be a triangular shape using rectangular bar test for a finger sleeve with only convex segments on the interior wall because the sleeve's interior wall does not touch rectangular bar center side "c" and exterior side "e", rather, it intersects just outside "c" and "e" with rectangular bar's long side.

When tp for a finger sleeve with its neighboring sleeve is at a different % L test range than the tp with its other neighboring sleeve, for example, tp with one neighboring sleeve is in a range from >=75% L to <=100% L and tp with the other neighboring sleeve is in a range from >=50% L to <75% L, each side should follow rectangular bar test rule for the respective test range, and the test result from both sides will be used to determine triangular shape.

In one aspect, an adjustable angle ruler or 360 degree T-Bevel may be used to test if a SHWT finger sleeve transverse cross section is triangular shaped.

FIG. 20C illustrates using an angle ruler to test if a finger sleeve transverse cross section is triangular shaped. The angle ruler is set at 120 degrees for a 3 finger sleeve based rotationally symmetric SHWT glove and 90 degrees for a 4 finger sleeve based rotationally symmetric SHWT glove. For the example in FIG. 20C, the angle ruler is set at 120 degrees. The angle ruler's vertex is positioned on the grip radius (RC) and both sides of the ruler are set parallel to the corresponding UC lines. Move the angle ruler towards one sleeve along the grip radius (RC) until each side of the ruler touches at least one point "tp" on the interior wall of the finger sleeve (a transverse cross section of a finger sleeve with both convex and concave segments on the interior wall is shown in FIG. 20C). When multiple touch points exist at one side of the angle ruler in a finger sleeve with both convex and concave segments on the interior wall, the touch point located nearest to the external end of the sleeve (or farthest away from the glove center (GC)) is considered as tp.

After the angle ruler creates tp with an interior wall of each finger sleeve, we can find L starting from the angle ruler vertex, along the side of the ruler and ending at the external most end of the sleeve. The start of the L is defined as 0% L and the end of the L is defined as 100% L. This L is equivalent to the L described with respect to the rectangular bar method in FIG. 20A, 20B & expand window in FIG. 20C.

For a finger sleeve with only convex segments on the interior wall, when tp is located in a range from >=75% L to <=100% L, for both sides of the angle ruler, if any distance X from the angle ruler side to a point on the finger sleeve interior wall at 50% L is smaller than 1/40 L, the shape of the finger sleeve transverse cross section is triangular.

For a finger sleeve with only convex segments on the interior wall, when tp is located in a range from >=50% L to <75% L, for both sides of the angle ruler, if any distance X from the angle ruler side to a point on the finger sleeve interior wall at tp-25% L and to a point at tp+25% L is smaller than 1/40 L, the shape of the finger sleeve transverse cross section is triangular.

For a finger sleeve with only convex segments on the interior wall, when tp is located in a range from >=25% L to <50% L, for both sides of the angle ruler, if any distance X from the angle ruler side to a point on the finger sleeve interior wall at tp+25% L is smaller than 1/40 L, the shape of the finger sleeve transverse cross section is triangular.

For a finger sleeve with only convex segments on the interior wall, the 1/40 L threshold for distance X to test for a triangular shape is half of the width of the rectangular bar (1/20 L) used to determine triangular shape discussed prior when the finger sleeves converge at the glove center (GC).

For a finger sleeve with both convex and concave segments on the interior wall, when tp is located in a range from >=75% L to <=100% L, for both sides of the angle ruler, if any distance X from the angle ruler side to a point on the finger sleeve interior wall from >=25% L to <=75% L is smaller than 3/64 L, the shape of the finger sleeve transverse cross section is triangular. The testing range from 25% L to 75% L for Distance X is equivalent to rectangular bar block M+B in FIG. 20C.

For a finger sleeve with both convex and concave segments on the interior wall, when tp is located in a range from >=50% L and <75% L, for both sides of the angle ruler, if any distance X from the angle ruler side to a point on finger sleeve interior wall from >=25% L to <=50% L or to a point on finger sleeve interior wall from >=75% L to <=100% L is smaller than 3/64 L, the finger sleeve transverse cross section is triangular shaped. The testing range for Distance X from 25% L to 50% L is equivalent to rectangular bar block B and testing range for Distance X between 75% L and 100% L is equivalent to rectangular bar block E in FIG. 20C.

For a finger sleeve with both convex and concave segments on the interior wall, when tp is located in a range from >=25% L to <50% L, for both sides of the angle ruler, if any distance from the angle ruler side to a point on finger sleeve interior wall from >=50% L to <=100% L is smaller than 3/64 L, then the finger sleeve transverse cross section is triangular shaped. The testing range from 50% L to 100% L for Distance X is equivalent to rectangular bar block M+E in FIG. 20C.

For a finger sleeve with both convex and concave segments on the interior wall, the 3/64 L threshold for Distance X to test triangular shape is half of the width of the rectangular bar (3/32 L) used to determine triangular shape discussed prior when finger sleeves converge at the glove center (GC).

When tp for one side of the angle ruler is located at a different % L test range than the other side, for example, tp at one side is in a range from >=75% L to <=100% L and tp at the other side is in a range from >=50% L to <75% L, each side should follow angle ruler test rule for the respective test range, and the test result from both sides will be used to determine triangular shape.

To test a finger sleeve in a non rotationally symmetric SHWT glove, the angle ruler's angle is set based on the angle between each finger sleeve's grip radius (RC) in the SHWT glove. For example, referring to FIG. 24F, in a 3 sleeve based non rotationally symmetric SHWT glove, the three finger sleeves and their grip radius (RC) may be labeled clockwise as sleeve 1 with grip radius RC1, sleeve 2 with grip radius RC2 and sleeve 3 with grip radius RC3. The angles between each grip radius are: between RC1 and RC3=160 degrees; between RC3 and RC2=110 degrees; and between RC1 and RC2=90 degrees. For each finger sleeve (the finger sleeves as illustrated in FIG. 24F including sleeve 1, sleeve 2 and sleeve 3), there is a sum angle of the grip radius (RC) of its two neighboring finger sleeves (expressed as SUM-S #), such that SUM-S1 denotes sleeve 1's sum angle of RC1 with its two neighboring finger sleeves RC2 and RC3.

Therefore

Sleeve 1 with RC1 has SUM-S1=160 (RC1 to RC3)+90 (RC1 to RC2)=250 degrees;

Sleeve 2 with RC2 has SUM-S2=90 (RC1 to RC2)+110 (RC3 to RC2)=200 degrees; and Sleeve 3 with RC3 has SUM-S3=110 (RC3 to RC2)+160 (RC1 to RC3)=270 degrees.

Ordering the sum angle from largest to smallest: SUM-S3 (270 degree) is greater than SUM-S1 (250 degree) which is greater than SUM-S2 (200 degree). Sleeve 3 with the largest sum angle will have the angle ruler set at the corresponding largest neighboring RC angle (in this example, RC1 to RC3=160 degrees), sleeve 1 with the second largest sum angle will have the angle ruler set at the corresponding second largest neighboring RC angle (in this example, RC3 to RC2=110 degrees) and sleeve 2 with the third largest sum angle will have the angle ruler set at the corresponding third largest neighboring RC angle (in this example RC1 to RC2=90 degrees).

The above method applies to both three and four sleeve based non rotationally symmetric SHWT gloves. For a given finger sleeve, the angle of the grip radius RC between the given sleeve and its neighbors is ranked from largest to smallest. Then, the sum of each sleeve's RC to its two neighboring RC's angles are ranked and is then used to select neighboring RC angle of the same rank to be the angle for the angle ruler to test the finger sleeve.

After finger sleeve's transverse cross section shape is defined, the sleeve's longitudinal cross section shape may be determined. The longitudinal cross section from mid sleeve section to sleeve tip especially at the bottom sleeve section may fit the natural shape of a human finger. This is beneficial as finger tips assist in grabbing, gripping, holding and picking objects while doing various tasks.

FIGS. 9A, 9B, 9C & 9D list some variations of the sleeve's longitudinal cross section shape cutting along arc C line. The variations shown in FIGS. 9A, 9B, 9C & 9D have sleeve top aperture 903 curving and transition to the arc bridge section 108 and center conjunction area 103 (refer FIG. 1D for arc bridge section 108 and center conjunction area 103). This shape fully mimics the shape of the palm and arc C upper segment curve referencing parallel inserted index and/or middle finger when the hand wearing SHWT glove is in relaxed open posture as shown in FIG. 8B. Also refer to its 2D view in FIGS. 9E and 9F.

FIG. 9A shows SHWT glove 100's finger sleeve longitudinal cross section shape mimicking human finger's natural shape from palm, middle finger to finger tip. The shape of the bottom sleeve section 901 matches the shape of thumb, index, and/or middle finger tip section when they are parallel inserted into the sleeve. FIG. 8B and FIG. 8C illustrate index finger and thumb inserted into a finger sleeve with matching longitudinal cross section shape especially at the bottom sleeve section.

When the sleeve shown in FIG. 9A has non-parallel inserted finger such as the ring finger, it may create more clamping force at the bottom sleeve section 901 than the parallel inserted fingers due to mismatch of the non-parallel inserted finger shape and the bottom sleeve section shape. This extra clamping force may compensate for the reduced clamping force due to non-parallel inserted slim ring finger having smaller circumference than index, middle finger or thumb.

One aspect shown in FIG. 9A reduces sleeve distortion when the hand wearing SHWT glove 100 (or finger protection body 100*f*) grabs an object to mimic a more natural feel. When the hand wearing SHWT glove 100 grabs an object with large force, finger tip's front area (opposite of nail side) might slip and shift towards the sleeve tip. As shown in expanded view window in FIG. 9A, print patterns 206 can be added to the finger sleeve inner surface at the bottom sleeve section 901 to lock the position of the finger tips.

FIG. 9B shows SHWT glove 230 having the same longitudinal cross section sleeve shape as SHWT glove 100 despite having a different transverse cross section sleeve shape illustrated in FIG. 10B than that of SHWT glove 100 in FIG. 10A.

The sleeve longitudinal cross section shape shown in FIGS. 9A and 9B may have good tolerance for parallel inserted fingers with long nails since the bottom sleeve section 901 on the exterior wall has room for the long nail side while the bottom sleeve section 901 on the interior wall matches the curve of the finger tip section opposite to the nail side.

FIG. 9C shows a finger sleeve longitudinal cross section shape at the bottom sleeve section 901 as half oval. FIG. 9D shows a finger sleeve longitudinal cross section shape at bottom sleeve section 901 as rounded or blunt oval. Both aspects may be used with thin, elastic and soft sleeve material that has more elasticity to trace a finger tip section shape. Compared to FIG. 9C's sharp oval that may have more clamping force at bottom sleeve section 901, the aspect illustrated in FIG. 9D may fit for thick finger insertion as it might not create too much clamping force for inserted finger that has blunt (or more round) finger tip section.

The finger sleeve's front shape isometric view along grip radius (RC) may be wider at the top and gradually narrowing towards the bottom as shown in FIGS. 2A, 5A, 5B and 12A I. When multiple fingers are inserted into a single sleeve, such as the index and middle finger inserted into the front sleeve in FIG. 12A, the combined fingers are wider at the top than the bottom. The V shaped or inverted symmetric trapezoid shaped front sleeve shape together with the top sleeve aperture interior wall curvature (illustrated in FIG. 9) may better accommodate multiple finger insertion. The above-described shape may also provide for stackability of SHWT gloves on top of or within each other.

Referring to FIG. 12A I, finger sleeve's bottom wall may have a flat segment 117 in the middle and one round corner 113 on each side. In one aspect, the length of the flat segment 117 may be at least 10% of the width (OW) of the sleeve transverse cross section at 10% of the sleeve height (SH). The radius of the round corners may match the average of the middle, index and ring finger tip section to fit them well. The flat segment 117 may help two parallel inserted fingers reach the bottom of the finger sleeve without leaving too much space between the fingers and the sleeve bottom wall to improve gripping performance using finger tips. The round corners 113 in FIG. 12A I may help reduce center gap 180 near tips 99 (shown in FIGS. 12B, 12C 12D and 12E) when all finger sleeves are squeezed together near the tips 99. The reduced center gap 180 near tips 99 may help with gripping small objects near the tips 99.

The finger sleeve bottom wall middle segment may not be completely flat, but a slightly curved convex arc, concave arc or a mix of convex and concave arcs that may achieve similar gripping performance to that of a flat segment. Refer to FIG. 22A for convex and concave arc segments definition.

The finger sleeve bottom wall may be considered "flat" when using the following rectangle overflow test. "Flat" is from the viewing along bottom grip radius (BRC) direction and the flat segment is parallel to sleeve transverse cross section width (OW) at or close to sleeve tip.

FIGS. 12A I and II and FIG. 12C show the finger sleeve bottom wall having a flat segment 117 (flat segment 117 not labelled in FIG. 12C for clarity) in the middle at 0% of the sleeve height (SH). The flat segment 117 is a flat surface on the sleeve transverse cross section illustrated in FIG. 21E as sleeve transverse cross section at 0% of the sleeve height (SH). FIG. 12A III show a finger sleeve bottom wall having a convex arc segment 117*arc*.

Rectangle overflow test may use a 20:1 rectangle shown in FIG. 12A III with its long side equal to OW/2 and short side equal to OW/40 of the sleeve transverse cross section at 10% of the sleeve height (SH). Here, width (OW) of sleeve's transverse cross section at 10% of the sleeve height (SH) is used as a reference. In addition, we use sleeve outer surface transverse cross section width (OW) and height (OH) as a reference. The test rectangle's bottom long side is positioned at SHWT glove flat standing surface or sleeve tip at 0% of the sleeve height (SH). The test rectangle's top long side is above the bottom long side along SHWT glove vertical axis by the distance of the short side length. The test rectangle's bottom long side is positioned parallel to and centered on width (OW) at 10% of the sleeve height (SH).

A finger sleeve bottom wall may be considered flat when the bottom wall segment intersects with both short sides of the test rectangle and the sub segment between the two intersect points never go above the top long side of the test rectangle. The sub segment may touch the top long side of the test rectangle and the finger sleeve bottom wall may still be considered flat. FIG. 12A III illustrates a sleeve bottom wall with a convex arc segment is considered flat using the rectangle overflow test. FIG. 12A II illustrates a sleeve bottom wall having a flat segment 117 partially overlapping with the test rectangle's bottom long side. Having a flat or straight-line segment on the sleeve bottom wall being a special case may still pass rectangle overflow test. Sleeve bottom wall with a concave arc segment or a mix of convex and concave arc segments may be considered flat using the same rectangle overflow test.

In order to better protect the palm, in one aspect the top skirt can be extended further up to wrist level to protect the palm section. FIG. 18A 3D transparent view illustrates how right hand 202*b* is protected by high top skirt in SHWT glove 137 which approximates the scope of the palm protection coverage. In one aspect, high top skirt may extend above SHWT glove's center conjunction area at least a distance equal to 50% of the sleeve height (SH).

In one aspect, high top skirt may be implemented by extending top skirt SW02 shown in FIG. 6A up to wrist level to create a rotationally symmetric trumpet shaped higher top skirt with large top aperture to allow either left or right palm insertion. However a high top skirt extending from SW02 that has too large of a top aperture may make palm section feel loose. It may also affect the use case of hand wearing SHWT glove with high top skirt trying to reach into a small deep container with its aperture similar or smaller than the top skirt size.

When a hand such as the right hand 202*b* shown in FIG. 2B or FIG. 6A is inserted into a SHWT glove, we can see the shape and position of right hand 202*b* relative to top skirt SW02, SW03 or SW05. Refer to FIG. 3B, FIG. 17B and FIG. 18A, we can easily identify that a rotationally symmetric high top skirt may mostly touch thenar eminence 219 and hypothenar eminence 217 (also FIGS. 17C & 17D) and the two sides of their edge area.

One aspect of a high top skirt may match the shape of hypothenar eminence 217 & thenar eminence 219 area and the rest of their side edge. We may reduce the total high top skirt aperture size for a better fit to the palm. High top skirt shape fitting may be based on a SHWT glove design that is rotational symmetric and line symmetric to improve fit for both left and right hand insertion.

FIG. 17C shows right hand and left hand in fully inserted posture in a SHWT glove at two sides, then merging together to mimic the combined virtual line symmetric left/right hand shape or in short combined virtual inserted left/right hand shape. FIG. 17D illustrates the combined virtual left/right hand inserted into high top skirt SW07. The combined virtual inserted left/right hand shape may be used as a reference to determine the shape of thenar protection section 337 (FIG. 17B), thenar and hypothenar conjunction section 338 and high skirt wall 339. The shapes of these sections relate to high top skirt to be a fit to the palm.

FIG. 17A illustrates one aspect of a high top skirt SW07 added above the finger protection body 100*f* and its comparison with the lower top skirt SW05 on the left. SW07 design carries over some features from SW05 which will be explained later. FIGS. 18B, 18C and 18D show three prospective views of SHWT glove 137 with high top skirt SW07. FIG. 18D dashed circles illustrate the thenar protection section 337, thenar and hypothenar conjunction section 338 and high skirt wall 339 as described above.

FIG. 17B illustrates high top skirt SW07 that can be broken down into three parts and their shapes matching thenar eminence 219 and closely fit hypothenar eminence 217 and two sides of their edge area. The three parts in FIG. 17B are thenar and hypothenar conjunction section 338, two thenar protection sections 337, and high skirt wall 339. The two thenar protection section 337*s* are arranged as line symmetric or mirror shape along thenar and hypothenar conjunction section 338 or UC line to allow universal fit for both left and right hand insertion (refer FIG. 17D).

Based on rotational and line symmetric design of SHWT body, high top skirt SW07 shown in FIGS. 17A, 18A, 18B, 18C and 18D has six thenar protection sections 337, three thenar and hypothenar conjunction sections 338 and three high skirt walls 339.

Selecting the four parts (contain two line symmetric thenar protection sections 337) illustrated in FIG. 17B for the area between thenar and hypothenar up to internal wrist level is one aspect of the high top skirt design, as the high top skirt may be loosely wrapping around the rest of the hand in a rotationally symmetric SHWT glove. The right side thenar protection section 337 in FIG. 17B is relocated to display the pinky finger and side of hypothenar for clarity.

Note: For clarity in FIG. 17B, the relative position and elevation between three sections (thenar protection section 337, thenar and hypothenar conjunction section 338 and high skirt wall 339) and inserted right hand 202*b* may not represent a fully inserted 202*b* but near full insertion. Fully inserted right hand 202*b* relative position to SW07 is illustrated in FIG. 18A.

The thenar protection sections 337 shown in FIG. 17B are extended from notch wings 335 (dashed circle) from SW05 shown in FIGS. 17B, 17D, 7A, 7B & 7C. Each thenar protection section 337 extends notch wing 335 upward to follow the shape of whole thumb root and thenar eminence 219 to form a large U tunnel up to wrist position (also refer FIG. 17D and FIG. 18A's wrist position right arrow).

As illustrated in FIG. 17C, the combined virtual inserted left/right hand shape confirms that thenar eminence section and its bump shape may be the dominant shape to determine the rotational and line symmetric high top skirt which may result in thenar protection section 337 extending upward from notch wing 335 to have its upper section shape mostly follow the thenar eminence shape (illustrated in FIG. 17D).

FIG. 18A illustrates transparent view of SHWT glove 137 on flat surface assuming no deformation from hand insertion. A fully inserted right hand 202*b* is shown to illustrate the relative location of a user's palm, wrist, thumb 211, index finger 212 and middle finger 213 to non-deformed SHWT glove 137.

FIG. 18A dashed circle on the right illustrates the thumb root to wrist area of an inserted hand overlapping with the thenar protection section 337 area of the high top skirt. The thenar protection section 337 may have its wall more vertically extended than the tilted thumb root to wrist area of an inserted hand. With a more vertically extended (or tilt-controlled) thenar protection section 337, a user's thumb root and thenar eminence may push the top wall of the thenar protection section 337 outward during hand insertion.

When the top wall of thenar protection section 337 is pushed outward by inserted thumb root and thenar eminence 219 side section (the right dashed circle and arrow area in FIG. 18A), its two nearby side walls may be pulled inward (illustrated as two connected dash arrows in FIG. 18A) to lightly wrap the nearby palm side area at two sides of hypothenar eminence 217 & thenar eminence 219. Hence the more vertically extended thenar protection section 337 may help to reduce SW07 total aperture size and partially mitigate palm section loose effect to achieve a fit to the palm. The thenar and hypothenar conjunction sections 338 extend from the inter-arc-bridge wings in SW05 (shown in FIG. 17A) and extend upward with a shape following the combined virtual inserted left/right hand shape in FIG. 17D.

Both inter-arc-bridge wing 216*c*1 and thenar and hypothenar conjunction section 338 in a high top skirt are upward extended structures from horizontal inter sleeve reverse U-shaped tunnel. When hand in SHWT glove is performing tight grip action, from structural deformation perspective, either the inter-arc-bridge wing 216*c*1 bend and flip down or the thenar and hypothenar conjunction section 338 in a high top skirt bend and flip outward to follow their connected horizontal inter sleeve reverse U-shaped tunnel. This may help to avoid hard pushing toward palm at hypothenar eminence 217 & thenar eminence 219 areas.

The thenar and hypothenar conjunction section 338 in a high top skirt being taller than inter-arc-bridge wing 216*c*1 may still be more likely to push against the palm at hypothenar eminence 217 & thenar eminence 219 area during tight grip action. This may cause hand to slip out of SHWT glove 137. To avoid hard pushing effect near the edges of thenar and hypothenar conjunction section 338 during tight grip action, the edge wall of thenar and hypothenar conjunction section 338 along two neighboring symmetric thenar protection sections 337 may have a notch shape at the top center of thenar and hypothenar conjunction section 338 to bend top wall edge outward lower and flatter. During SHWT glove 137 tight grip action, palm section at hypothenar eminence 217 & thenar eminence 219 may push/bend down the flatter notch shaped top edge lower and outward and avoid SHWT glove 137's whole body being loose.

The lower sections of both thenar protection sections 337 and its connected thenar and hypothenar conjunction section 338 has the same shape as that of SW05's notch wing 335 connected to lower part of inter-arc-bridge wing 216*c*1 illustrated in FIG. 7A. In FIG. 17D the bottom piece with its dashed oval circle represents the corresponding joint section of inter-arc-bridge wing 216*c*1 connected to its side notch wing 335 in FIG. 7A's dashed circle.

The lower section of thenar protection section 337 and its conjunction section with the lower section of thenar and hypothenar conjunction section 338 in dashed oval circle in FIG. 17D matching the thumb root and its thenar eminence shape may help to improve the thumb gripping performance in the SHWT glove.

The high skirt wall 339*s* may be the connection wall between two thenar protection sections 337 on the straight wall sides (Refer FIG. 18D). In comparison, the curved wall sides of two thenar protection sections 337 are connected by thenar and hypothenar conjunction section 338 in FIG. 18D. The vertical tilt angle of high skirt wall 339 may be partially determined by its two connected wall of thenar protection sections 337.

Increasing the vertical tilt angle of the high skirt wall 339 to make it more vertical may reduce the high top skirt SW07 total aperture size. However, it may also cause skirt wall to tightly touch the outside (back) thumb root next to thenar protection section 337 and high skirt wall 339's connection area partially shown in dashed circle in FIG. 18A.

Implementing vertical U/V grooves on high skirt wall 339U shown in FIG. 18E may make the high skirt wall more adaptive to the shape at thumb root section so that high skirt wall 339U can be more inwardly (or vertically) tilted to further reduce the skirt aperture size. FIG. 18E shows three high skirt walls 339U with vertical U/V grooves added to the original high top skirt SW07. The expanded window in FIG. 18E illustrates the vertical tilt angle difference between a regular high skirt wall 339 and a high skirt wall 339U with added vertical U/V grooves.

Implementing vertical U/V grooves on high skirt wall 339U shown in FIG. 18E may lead to high top skirt top aperture more adaptive for wrist movement when wearing SHWT glove.

Figures 19, 19A, 19B, 19C, 19D:
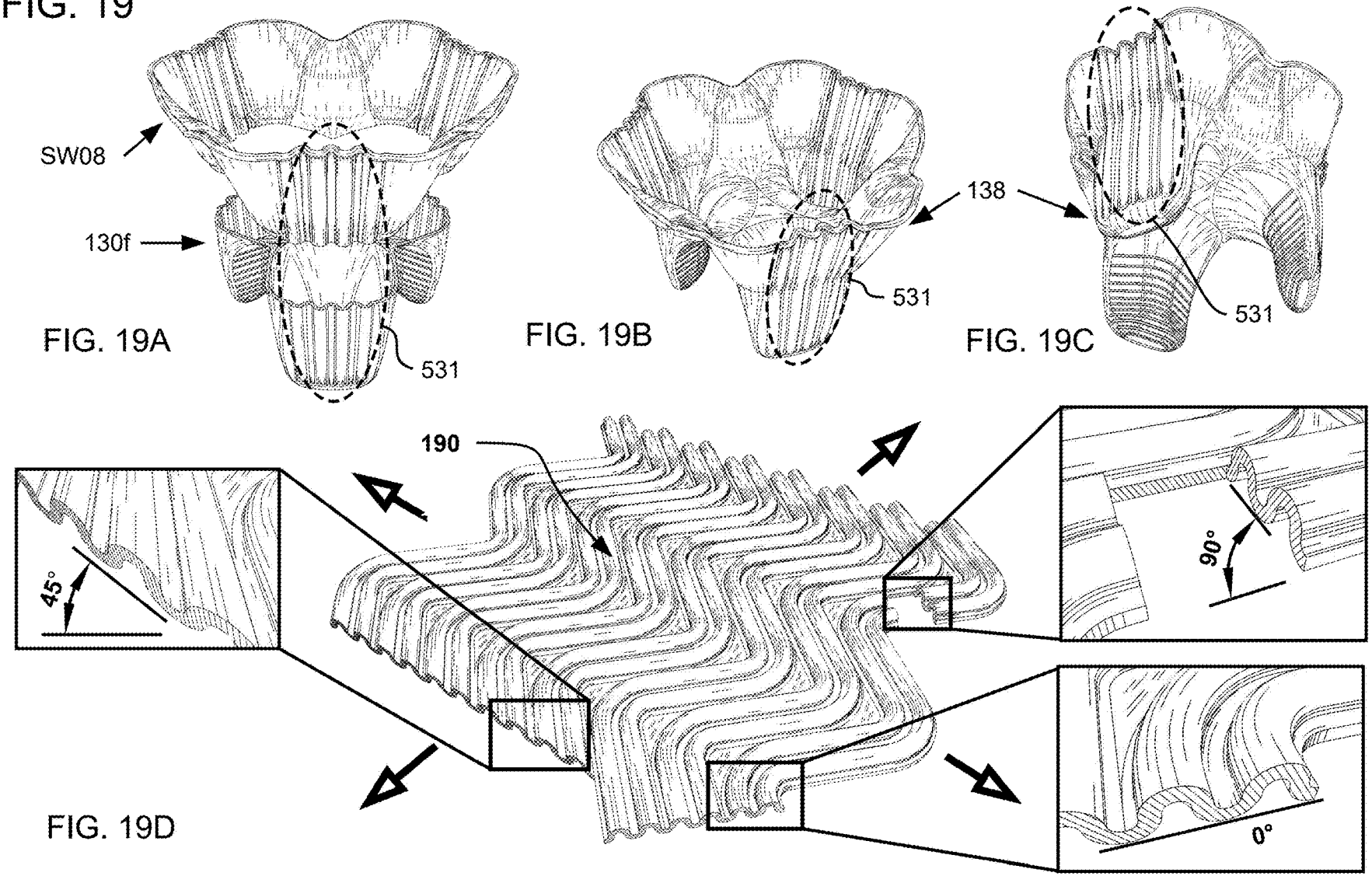
FIG. 19A illustrates a perspective view of SHWT finger protection body 130*f* with vertical U/V grooves 531 and high top skirt SW08 with vertical U/V grooves 531.
FIG. 19B illustrates an upper side perspective view of SHWT glove 138 with vertical U/V grooves 531.
FIG. 19C illustrates a lower side perspective view of SHWT glove 138 with vertical U/V grooves 531.
FIG. 19D illustrates zigzag U/V grooves 190 with 90 degree angle for SHWT glove implementation.

FIG. 19A shows a SHWT glove comprises a high top skirt SW08 with vertical U/V grooves 531 and a lower finger protection body 130*f* with vertical U/V grooves 531 on the finger sleeves. FIGS. 19B and 19C illustrate top and bottom perspective view of SHWT glove 138 with vertical U/V grooves 531.

In one aspect, an SHWT glove with high top skirt and both vertical and horizontal U/V grooves may be described as extending the top skirt of the SHWT glove 136 (shown in FIG. 16D). Vertical U/V grooves may be implemented as gradually becoming shallower and disappearing at certain height of the high top skirt, similar as how vertical U/V grooves 531 on the sleeve are implemented as gradually becoming shallower and disappearing near the sleeve tip as shown in FIG. 13F. Adding horizontal U/V grooves to SHWT glove 138 may make both HUV arc B and HUV arc C length adaptive.

FIG. 3A demonstrates an application of the SHWT glove 100 for heat isolation while holding a hot pan 300, with food 303 cooking inside. A left hand 202*a* wearing SHWT glove 100 grabs the curved side wall of the pan 300. On the other side, a right hand 202*b* wearing the SHWT glove 100 holds the hot metal handle of the pan 300.

FIG. 4A demonstrates another application of the SHWT glove for heat isolation while cleaning a hot pan 406 right after cooking. A right hand 202*b* wearing the SHWT glove 100 holds a wipe 403 to clean the curved inner and outer wall of the hot pan 406. A left hand 202*a* wearing the SHWT glove 100 holds a wipe 403 to clean the curved inner wall and the bottom of the hot pan 406.

There are other applications of the SHWT glove. In FIG. 3A, a hand wearing the SHWT glove 100 made of high temperature resistance glove material can flip or stir hot food 303 such as fried egg or sausage during cooking without a spatula for a short period of time.

FIGS. 4B and 4C demonstrate the use of the SHWT glove 100 as a utensil holder for spatula, spoon, fork, chopsticks etc. when the finger glove is flipped on its head.

Print patterns may be added to both inner and outer surface of the finger sleeve. Adding print patterns has benefits. In one aspect, print patterns 206 on the outer surface of the finger sleeves (shown in FIG. 2A) may increase friction when grabbing objects to avoid object slipping. In one aspect, print patterns 206 on the inner surface of the finger sleeve (shown in FIG. 9A rectangular window) may help to prevent finger from slipping inside the sleeve especially at the bottom sleeve section. In one aspect, print patterns on either inner or outer surface of the finger sleeves may improve heat isolation because it can reduce contact surface with the heat source.

Print patterns may be implemented as concave or convex in different ways, such as curved line, stripe line, dotted or block patterns running horizontally, vertically or other directions. One may choose the appropriate print pattern to suit the needs. In one example shown in FIG. 2A, long striped print pattern 206 is added to the finger sleeve's outer surface of SHWT glove 100. In another example shown in in FIG. 16B and expanded window in FIG. 16C, short stripped print pattern 206 is added to the finger sleeve's outer surface of SHWT glove 133.

Print patterns on the finger sleeve outer surface may also be implemented with certain depth to become bristles. SHWT glove with bristles may be used to scrub away debris.

When either horizontal or vertical U/V grooves are implemented on SHWT glove with small U/V cross-section size and with a high number of grooves (i.e. high density), those U/V grooves may also serve the print pattern functions.

FIG. 19D illustrates a 4 way stretchable structural design-zigzag U/V grooves 190 which may be applied to SHWT glove. The zigzag U/V grooves 190 in FIG. 19D may be used with flexible and elastic type II material but may benefit more for low or non-elastic and less stretchable (such as paper based) but bendable type I material.

In one aspect, the zigzag U/V grooves have multiple parallel stacked orthogonal U/V grooves together, with each U/V groove has its 90 degree turning angle.

Under same material thickness flexibility, stretch ability, and transverse cross-section dimension such as depth of U/V grooves, the length of each U/V groove segment between two 90 degree turning points may be adjusted to change material stretch ability. The longer and deeper the U/V groove segment between two 90 degree turning points, the more stretchable it is.

While 90 degree parallel U/V groove turning angle may create same expanding distance for both X and Y axis, this turning angle may deviate from 90 degree (for example 60 degree) to create different expanding distance at X than at Y axis. This property may help SHWT glove achieve different stretch-ability requirements.

Similar to horizontal or vertical U/V grooves, when the zigzag U/V grooves are implemented with small U/V grooves and in high density, the zigzag U/V grooves may mimic print patterns on finger sleeve.

The SHWT glove material may also possess properties such as thermal isolation, anti-corrosion or graded for food safe, medical safe in order to serve the needs of different types of tasks.

SHWT glove may have varying combinations in structural design, type of material used and material thickness at different sections of the finger glove to achieve the desired performance.

Although U/V grooves are illustrated in the Figures as continuous (side-by-side, one immediately leading into another), one of skill in the art will recognize that a single U/V groove (sharp corner referenced above as one example), spaced apart from another single U/V groove (by a straight section, for example), and so on, may achieve a similar result as U/V grooves recited above.

The terms "center SH line" and "sleeve height (SH)" reference a line and a length of that line, respectively. The above description uses the terms separately. One of skill in the art will recognize that in the Figures, "SH" is used for brevity and clarity, but may be referenced by the description for either "center SH line" or "sleeve height (SH)", or both, as needed to describe various aspects of a SHWT glove. The above description is clear as to which terms or term applies, and when, with respect to the Figures.

One of skill in the art will recognize that measurements, angles, arcs, geometric relationships, etc. for a SHWT glove may be determined with the SHWT glove in various positions and configurations. For example, comparing a free-standing SHWT glove to a glove being worn by a user may result in different measurements of the SHWT glove in those two different situations. Some figures show and the specification describes SHWT gloves being free-standing (for example on a flat surface). Some Figures show and the specification describes SHWT gloves with respect to a virtual plane, for example the sitting plane. Some Figures show and the specification describes SHWT gloves worn on a hand. One of skill in the art will recognize that measurements and determinations made with respect to a SHWT glove may be made with the glove on a flat and level surface, with the finger sleeves' tips against the surface, and without fingers in the finger sleeves. In one aspect, a SHWT glove may start in a compressed form, for example if made from paper and need to be expanded before it can rest on a flat and level surface with the finger sleeves' tips against the surface. One of skill in the art will recognize that expanding a SHWT glove made from a compressible or foldable material, for example paper, prior to making measurements or determinations, fits within the scope of this description.

The aspects and features mentioned and described together with one or more of the previously detailed examples and figures, may as well be combined with one or more of the other examples in order to replace a like feature of the other example or in order to additionally introduce the feature to the other example.

The description and drawings merely illustrate the principles of the disclosure. Furthermore, all examples recited herein are principally intended expressly to be only for pedagogical purposes to aid the reader in understanding the principles of the disclosure and the concepts contributed by the inventor(s) to furthering the art. All statements herein reciting principles, aspects, and examples of the disclosure, as well as specific examples thereof, are intended to encompass equivalents thereof.

It is to be understood that the disclosure of multiple acts, processes, operations, steps, or functions disclosed in the specification or claims may not be construed as to be within the specific order, unless explicitly or implicitly stated otherwise, for instance for technical reasons. Therefore, the disclosure of multiple acts or functions will not limit these to a particular order unless such acts or functions are not interchangeable for technical reasons. Furthermore, in some examples a single act, function, process, operation or step may include or may be broken into multiple sub-acts, functions, processes, operations or—steps, respectively. Such sub acts may be included and part of the disclosure of this single act unless explicitly excluded.

Furthermore, the following claims are hereby incorporated into the detailed description, where each claim may stand on its own as a separate example. While each claim may stand on its own as a separate example, it is to be noted that—although a dependent claim may refer in the claims to a specific combination with one or more other claims—other examples may also include a combination of the dependent claim with the subject matter of each other dependent or independent claim. Such combinations are explicitly proposed herein unless it is stated that a specific combination is not intended. Furthermore, it is intended to also include features of a claim to any other independent claim even if this claim is not directly made dependent on the independent claim.

What is claimed is:

1. A single hand wear and take off glove, comprising:

a center conjunction area; and exactly three finger sleeves connected to the center conjunction area, each finger sleeve having an open end and a tip, the open end at the connection to the center conjunction area and opposite the tip, the tips of the three finger sleeves forming a sitting plane, each finger sleeve having a sleeve height (SH) measured on a vertical axis orthogonal to the sitting plane from the tip to the center conjunction area, with 0% of the sleeve height (SH) at the tip to 100% of the sleeve height (SH) at the center conjunction area, each finger sleeve having a transverse cross section that is in a plane orthogonal to the vertical axis, the transverse cross section having a width (OW) and a height (OH), the shape of the transverse cross section being a closed shape with convex segments and having less than three simple "S" segments, the transverse cross section of each finger sleeve having a ratio of width (OW) to height (OH), at the sleeve height (SH), the ratio selected from the group consisting of greater than 2.1:1-sleeve height (SH) from 10% to 20%, and greater than 2:1-sleeve height (SH) from 10% to 50%.

2. The single hand wear and take off glove of claim 1, each finger sleeve having an interior wall and an exterior wall, the interior wall closer to the center conjunction area, along the transverse cross section, than the exterior wall, the glove further comprising:

a plurality of horizontal U/V grooves across at least some part of the interior wall of at least one of the finger sleeves.

3. The single hand wear and take off glove of claim 1 further comprising:

a print pattern on at least one of the finger sleeves.

4. The single hand wear and take off glove of claim 1, the three finger sleeves being rotationally symmetric around a line orthogonal to the sitting plane.

5. The single hand wear and take off glove of claim 1, each finger sleeve having an interior wall and an exterior wall, the interior wall closer to the center conjunction area, along the transverse cross section, than the exterior wall, the glove further comprising:

the tips of the three finger sleeves configured to contact a contact circle in the sitting plane, for each finger sleeve the contact point being on the interior wall at 0% of the sleeve height (SH), the center of the contact circle being a glove bottom center (GBC), for each finger sleeve, at 0% of the sleeve height (SH), there being a clamp angle β with a vertex at the glove bottom center (GBC) and the clamp angle β contacting the finger sleeve at each side, the clamp angle β bisected by a bottom grip radius (BRC), the height (OH) being parallel to the bottom grip radius (BRC), the height (OH) configured to have an OH end level line perpendicular to the height (OH) and contacting the interior wall, the bottom grip radius (BRC) measured from the glove bottom center (GBC) to the OH end level line; and there being an average of the bottom grip radius (BRC) for all the finger sleeves, a ratio of the average to sleeve height (SH) being between 1:0.9 and 1:1.65.

6. The single hand wear and take off glove of claim 1 wherein the convex segments include a straight line.

7. A single hand wear and take off glove, comprising:

a center conjunction area; and exactly three finger sleeves connected to the center conjunction area, each finger sleeve having an open end and a tip, the open end at the connection to the center conjunction area and opposite the tip, the tips of the three finger sleeves forming a sitting plane, each finger sleeve having a sleeve height (SH) measured on a vertical axis orthogonal to the sitting plane from the tip to the center conjunction area, with 0% of the sleeve height (SH) at the tip to 100% of the sleeve height (SH) at the center conjunction area, each finger sleeve having a transverse cross section that is in a plane orthogonal to the vertical axis, the transverse cross section having a width (OW) and a height (OH), the shape of the transverse cross section being a closed shape with convex segments and having more than two simple "S" segments, the transverse cross section of each finger sleeve having a ratio of width (OW) to height (OH), at the sleeve height (SH), the ratio selected from the group consisting of greater than 1.8:1-sleeve height (SH) from 10% to 20%, greater than 1.7:1-sleeve height (SH) from 10% to 30%, and greater than 1.5:1-sleeve height (SH) from 10% to 50%.

8. The single hand wear and take off glove of claim 7, each finger sleeve having an interior wall and an exterior wall, the interior wall closer to the center conjunction area, along the transverse cross section, than the exterior wall, the glove further comprising: a plurality of horizontal U/V grooves across at least some part of the interior wall of at least one of the finger sleeves.

9. The single hand wear and take off glove of claim 7 further comprising:

a print pattern on at least one of the finger sleeves.

10. The single hand wear and take off glove of claim 7, the three finger sleeves being rotationally symmetric around a line orthogonal to the sitting plane.

11. The single hand wear and take off glove of claim 7, each finger sleeve having an interior wall and an exterior wall, the interior wall closer to the center conjunction area, along the transverse cross section, than the exterior wall, the glove further comprising:

the tips of the three finger sleeves configured to contact a contact circle in the sitting plane, for each finger sleeve the contact point being on the interior wall at 0% of the sleeve height (SH), the center of the contact circle being a glove bottom center (GBC), for each finger sleeve, at 0% of the sleeve height (SH), there being a clamp angle β with a vertex at the glove bottom center (GBC) and the clamp angle β contacting the finger sleeve at each side, the clamp angle β bisected by a bottom grip radius (BRC), the height (OH) being parallel to the bottom grip radius (BRC), the height (OH) configured to have an OH end level line perpendicular to the height (OH) and contacting the interior wall, the bottom grip radius (BRC) measured from the glove bottom center (GBC) to the OH end level line; and there being an average of the bottom grip radius (BRC) for all the finger sleeves, a ratio of the average to sleeve height (SH) being between 1:0.9 and 1:1.65.

12. The single hand wear and take off glove of claim 7 wherein the convex segments include a straight line.

13. A single hand wear and take off glove, comprising:

a center conjunction area; and exactly three finger sleeves connected to the center conjunction area, each finger sleeve having an open end and a tip, the open end at the connection to the center conjunction area and opposite the tip, the tips of the three finger sleeves forming a sitting plane, each finger sleeve having a sleeve height (SH) measured on a vertical axis orthogonal to the sitting plane from the tip to the center conjunction area, with 0% of the sleeve height (SH) at the tip to 100% of the sleeve height (SH) at the center conjunction area, each finger sleeve having a transverse cross section that is in a plane orthogonal to the vertical axis, the transverse cross section having a width (OW) and a height (OH), with the shape of the transverse cross section being a closed shape and having at least one concave segment and at least one convex segment, the transverse cross section of each finger sleeve having a ratio of width (OW) to height (OH), at the sleeve height (SH), the ratio selected from the group consisting of greater than 1.8:1-sleeve height (SH) from 10% to 20%, greater than 1.7:1-sleeve height (SH) from 10% to 30%, and greater than 1.5:1-sleeve height (SH) from 10% to 50%.

14. The single hand wear and take off glove of claim 13, each finger sleeve having an interior wall and an exterior wall, the interior wall closer to the center conjunction area, along the transverse cross section, than the exterior wall, the glove further comprising: a plurality of horizontal U/V grooves across at least some part of the interior wall of at least one of the finger sleeves.

15. The single hand wear and take off glove of claim 13 further comprising:

a plurality of vertical U/V grooves across at least some part of at least one of the finger sleeves.

16. The single hand wear and take off glove of claim 13 further comprising:

a plurality of zigzag U/V grooves across at least some part of at least one of the finger sleeves.

17. The single hand wear and take off glove of claim 13 further comprising:

a print pattern on at least one of the finger sleeves.

18. The single hand wear and take off glove of claim 13, the three finger sleeves being rotationally symmetric around a line orthogonal to the sitting plane.

19. The single hand wear and take off glove of claim 13, each finger sleeve having an interior wall and an exterior wall, the interior wall closer to the center conjunction area, along the transverse cross section, than the exterior wall, the glove further comprising:

the tips of the three finger sleeves configured to contact a contact circle in the sitting plane, for each finger sleeve the contact point being on the interior wall at 0% of the sleeve height (SH), the center of the contact circle being a glove bottom center (GBC), for each finger sleeve, at 0% of the sleeve height (SH), there being a clamp angle β with a vertex at the glove bottom center (GBC) and the clamp angle β contacting the finger sleeve at each side, the clamp angle β bisected by a bottom grip radius (BRC), the height (OH) being parallel to the bottom grip radius (BRC), the height (OH) configured to have an OH end level line perpendicular to the height (OH) and contacting the interior wall, the bottom grip radius (BRC) measured from the glove bottom center (GBC) to the OH end level line; and there being an average of the bottom grip radius (BRC) for all the finger sleeves, a ratio of the average to sleeve height (SH) being between 1:0.9 and 1:1.65.

20. A single hand wear and take off glove, comprising:

a center conjunction area; and at least three finger sleeves connected to the center conjunction area, each finger sleeve having an open end and a tip, the open end at the connection to the center conjunction area and opposite the tip, the tips of the at least three finger sleeves forming a sitting plane, each finger sleeve having a sleeve height (SH) measured on a vertical axis orthogonal to the sitting plane from the tip to the center conjunction area, with 0% of the sleeve height (SH) at the tip to 100% of the sleeve height (SH) at the center conjunction area, each finger sleeve having a transverse cross section that is in a plane orthogonal to the vertical axis, the transverse cross section having a width (OW) and a height (OH), with the width (OW) being greater than the height (OH) between 10% and 50% of the sleeve height (SH), the shape of the transverse cross section between 20% and 70% of the sleeve height (SH) being a triangular shape.

21. The single hand wear and take off glove of claim 20, each finger sleeve having an interior wall and an exterior wall, the interior wall closer to the center conjunction area, along the transverse cross section, than the exterior wall, the glove further comprising:

a plurality of horizontal U/V grooves across at least some part of the interior wall of at least one of the finger sleeves.

22. The single hand wear and take off glove of claim 20 further comprising:

a plurality of vertical U/V grooves across at least some part of at least one of the finger sleeves.

23. The single hand wear and take off glove of claim 20 further comprising:

a plurality of zigzag U/V grooves across at least some part of at least one of the finger sleeves.

24. The single hand wear and take off glove of claim 20 further comprising:

a print pattern on at least one of the finger sleeves.

25. The single hand wear and take off glove of claim 20, the at least three finger sleeves being rotationally symmetric around a line orthogonal to the sitting plane.

* * * * *